US009201319B2

(12) United States Patent
Nagai et al.

(10) Patent No.: US 9,201,319 B2
(45) Date of Patent: Dec. 1, 2015

(54) IMAGE BEARING MEMBER, MANUFACTURING METHOD OF THE SAME, IMAGE FORMING METHOD, IMAGE FORMING APPARATUS, AND PROCESS CARTRIDGE

(71) Applicants: Kazukiyo Nagai, Shizuoka (JP); Yuuji Tanaka, Shizuoka (JP); Tetsuro Suzuki, Shizuoka (JP); Yuusuke Koizuka, Shizuoka (JP)

(72) Inventors: Kazukiyo Nagai, Shizuoka (JP); Yuuji Tanaka, Shizuoka (JP); Tetsuro Suzuki, Shizuoka (JP); Yuusuke Koizuka, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 37 days.

(21) Appl. No.: 14/096,593

(22) Filed: Dec. 4, 2013

(65) Prior Publication Data

US 2014/0178810 A1 Jun. 26, 2014

(30) Foreign Application Priority Data

Dec. 25, 2012 (JP) ..... 2012-281106

(51) Int. Cl.

| | |
|---|---|
| ***G03G 5/04*** | (2006.01) |
| ***G03G 5/07*** | (2006.01) |
| ***G03G 5/05*** | (2006.01) |
| ***G03G 5/06*** | (2006.01) |

(52) U.S. Cl.

CPC ..... *G03G 5/075* (2013.01); *G03G 5/0525* (2013.01); *G03G 5/0592* (2013.01); *G03G 5/0614* (2013.01)

(58) Field of Classification Search

CPC ..... G03G 5/14708; G03G 5/14713; G03G 5/1476; G03G 5/14791

See application file for complete search history.

(56) References Cited

U.S. PATENT DOCUMENTS

| | | | | |
|---|---|---|---|---|
| 2007/0110488 | A1* | 5/2007 | Kabata et al. | 399/351 |
| 2007/0254224 | A1 | 11/2007 | Sugino | |
| 2012/0021346 | A1 | 1/2012 | Nagayama et al. | |

FOREIGN PATENT DOCUMENTS

| | | | | |
|---|---|---|---|---|
| JP | 2000-066425 | | 3/2000 | |
| JP | 2000-171900 | | 6/2000 | |
| JP | 2003-186223 | | 7/2003 | |
| JP | 2004-184991 | | 7/2004 | |
| JP | 2006-084711 | | 3/2006 | |
| JP | 2006-251771 | | 9/2006 | |
| JP | 2007-293197 | | 11/2007 | |
| JP | 2008-299327 | | 12/2008 | |
| JP | 2009-229549 | | 10/2009 | |
| JP | 2012-027124 | | 2/2012 | |
| WO | WO 2012/099181 | * | 7/2012 | G03G 5/147 |

* cited by examiner

*Primary Examiner* — Peter Vajda

(74) *Attorney, Agent, or Firm* — Oblon, McClelland, Maier & Neustadt, L.L.P.

(57) ABSTRACT

An image bearing member includes a substrate, and a photosensitive layer overlying the substrate, wherein an uppermost surface layer of the image bearing member has a hydrocarbon compound represented by the following Chemical Formula 1; and a three-dimensionally cross-linked polymer formed by polymerization reaction of a charge transport compound having three or more [tetrahydro-2H-pyran-2-yl)oxy]methyl groups linked with aromatic rings, wherein, in the polymerization reaction, part of the three or more [(tetrahydro-2H-pyran-2-yl)oxy]methyl groups is severed and detached from the charge transport compound, $Ph_1$-$Q_1$-$Ph_2$-$Q_2$-$Ph_3$ Chemical Formula 1 where $Q_1$ and $Q_2$ independently represent methylene groups or ethylene groups, $Ph_1$ and $Ph_3$ independently represent phenyl groups with which one or two methyl groups are bonded, and $Ph_2$ represents a phenylene group or a phenylene group having one methyl group.

16 Claims, 13 Drawing Sheets

CLEANING BLADE ABRASION SCHEMATIC DIAGRAM AND DEPTH OF ABRASION

IMAGE BEARING MEMBER, MANUFACTURING METHOD OF THE SAME, IMAGE FORMING METHOD, IMAGE FORMING APPARATUS, AND PROCESS CARTRIDGE

CROSS-REFERENCE TO RELATED APPLICATIONS

This patent application is based on and claims priority pursuant to 35 U.S.C. §119 to Japanese Patent Application No. 2012-281106, filed on Dec. 25, 2012, in the Japan Patent Office, the entire disclosure of which is hereby incorporated by reference herein.

BACKGROUND

1. Technical Field

The present invention relates to an image bearing member (photoreceptor), a manufacturing method of the image bearing member, an image forming method, an image forming apparatus, and a process cartridge.

2. Background Art

Organic photoconductors (OPC) (photoreceptors) have good properties and have been used in place of inorganic photoreceptors in photocopiers, facsimile machines, laser printers, and multi-functional devices thereof in light of various advantages. Specific advantages for this supersession include, for example, (1) good optical characteristics, for example, a broad range of optical absorption wavelengths and a large amount of light absorption; (2) superior electrical characteristics, for example, high sensitivity and stable chargeability; (3) a wide selection of materials; (4) ease of manufacturing; (5) low cost; and (6) non-toxicity.

However, such an organic photoconductor is soft in general because the charge transport layer therein contains a low molecular weight charge transport material, an inert polymer, etc. as its main component. For this reason, the organic photoconductor involves problems about abrasion resistance, durability to damage, etc., because of the mechanical stress applied to the photoconductor by a development system or a cleaning system during repetitive use in a long period of time in the electrophotography system. Such abrasion and damage of the image bearing member lead to degradation of electric characteristics such as sensitivity and chargeability, resulting in production of defective images with low image density, background fouling, etc. Local damage to a photoreceptor caused by the abrasion involves problems of production of defective images with streaks ascribable to bad cleaning performance for the photoreceptor.

For example, JP-2000-066425-A, JP-2000-171990, JP-2003-186223-A, JP-2007-293197-A, JP-2008-299327-A, JP-4262061-B1 (JP-2004-184991-A), JP-2006-251771-A, JP-2009-229549-A, and JP-2006-084711-A disclose organic photoconductors having charge transport layers containing three-dimensionally cross-linked polymers to improve the mechanical durability of the organic photoconductors.

JP-2000-066425-A mentioned above discloses a charge transport layer containing a three-dimensionally cross-linked polymer formed by radically-polymerizing hole carrier transport compounds having two or more chain-rectionally polymerizable functional group in a molecule by exposure to ultraviolet ray or electron beam. However, this requires elaborate irradiation devices for ultraviolet ray or electron beam, which is a disadvantage in terms of productivity. In addition, charge transport compounds are degraded by ultraviolet ray or electron beam, which leads to deterioration of voltage properties of a photoreceptor.

JP-2000-171990, JP-2003-186223-A, JP-2007-293197-A, JP-2008-299327-A, JP-4262061-B1 (JP-A), JP-2006-251771-A, and JP-2009-229549-A mentioned above disclose charge transport layers containing three-dimensionally cross-linked polymers formed by using charge transport compounds having polar groups such as hydroxyl groups. Although these are successful to some degrees, the charging level lowers because such polar groups remain in the three-dimensionally cross-linked polymers. In addition, the image density tends to deteriorate in high temperature and humidity environment or due to exposure to $NO_x$ gases produced by a charger.

JP-2006-084711-A mentioned above discloses a charge transport layer containing a compound in which a polar group such as hydroxyl group of a charge transport compound is blocked and a three-dimensionally cross-linked polymer formed by curing a reaction active species such as melamine.

In this case, although it is possible to prevent such polar groups from remaining in the charge transport layer, the blocked polar group and the reactive activated species tend not to react easily. Therefore, the mechanical durability of the thus-formed layer is inferior.

As described above, in order to improve the mechanical durability of an organic photoconductor, providing a charge transport layer containing a three-dimensionally cross-linked polymer to an organic photoconductor have been intensively investigated. On the other hand, abrasion of a cleaning blade that contacts an organic photoconductor relatively arises as a large problem as the abrasion resistance of the organic photoconductor increases. This creates a new problem of a short working life of a cleaning blade. For this reason, the working life of a process cartridge having an organic photoconductor and a cleaning blade is not prolonged substantially because the durability of the cleaning blade is worsened while the mechanical strength of the organic photoconductor ameliorates.

In addition, in an attempt to improve the cleanability, a lubricant is applied to an organic photoconductor to reduce friction between the organic photoconductor and the cleaning blade. This is successful to some degree but the abrasion of a cleaning blade is not completely prevented.

A charge transport layer having a three-dimensionally cross-linked polymer is generally hard but mostly a cleaning blade is formed of urethane rubber, meaning it is relatively soft. For this reason, when particles such as silica having a grinding feature are contained in toner and frictioned between the photoreceptor and the cleaning blade, the cleaning blade tends to be scraped more and more as the organic photoconductor is less scraped. To decrease the hardness of a charge transport layer having a three dimensionally cross-linked polymer, for example, monomers to soften the charge transport layer, a non-reactive plasticizer, etc. can be copolymerized or mixed. However, adding such a material even in a few amount leads to a substantial degradation of the abrasion resistance of a typical charge transport layer containing a three dimensionally cross-linked polymer. That is, the trade-off between the organic photoconductor and the cleaning blade is not overcome. The mechanism is inferred as follows: Such a non-reactive plasticizer mixed with has poor compatibility so that it is not possible to form a uniform three-dimensionally cross-linked polymer, thereby inhibiting curing reaction, resulting in a significant degradation of mechanical durability. Copolymerization of a monomer to soften a charge transport layer leads to reduction of the cross-linking density of matrix, which directly degrades abrasion resistance.

For that reason, a photoreceptor that has excellent mechanical durability and can reduce abrasion of a cleaning blade that contacts the photoreceptor and a manufacturing method thereof are in demand. An image forming apparatus, an image forming method, and a process cartridge that are able to stably produce quality images over the entire process with a long working life have not appeared on market yet. Development thereof is in strong demand.

SUMMARY

The present invention provides an improved image bearing member that includes a substrate, and a photosensitive layer overlying the substrate, wherein the uppermost surface layer of the image bearing member has a hydrocarbon compound represented by the following Chemical Formula 1; and a three-dimensionally cross-linked polymer formed by polymerization reaction of a charge transport compound having three or more [tetrahydro-2H-pyran-2-yl)oxy]methyl groups linked with aromatic rings, wherein, in the polymerization reaction, part of the three or more [(tetrahydro-2H-pyran-2-yl)oxy]methyl groups is severed and detached from the charge transport compound, $Ph_1$-$Q_1$-$Ph_2$-$Q_2$-$Ph_3$ Chemical Formula 1 where $Q_1$ and $Q_2$ independently represent methylene groups or ethylene groups, $Ph_1$ and $Ph_3$ independently represent phenyl groups with which one or two methyl groups are bonded, and $Ph_2$ represents a phenylene group or a phenylene group having one methyl group.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION

Figure 1:
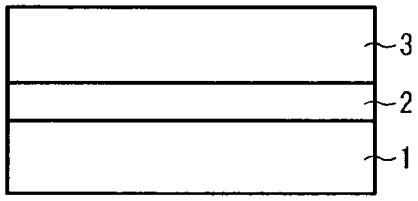
FIG. 1 is a cross section illustrating the layer structure of the image bearing member according to the first embodiment of present invention.

The present invention is to provide an image bearing member (photoreceptor) that has excellent mechanical durability and can reduce abrasion of a cleaning blade that contacts the photoreceptor.

As a result of an investigation made by the present inventors, it has been found that a three-dimensionally cross-linked polymer having a high cross-linking density is formed without inhibition of curing reaction by using a charge transport compound having a particular structure.

Moreover, it has been also found that when such a three-dimensionally cross-linked polymer is mixed with a particular hydrocarbon compound, the particular hydrocarbon compound is uniformly dispersed in gaps of the three dimensional network structure of the three-dimensionally cross-linked polymer, thereby forming a structure that subdues degradation of the mechanical properties such as film hardness by non-cross-linked portion to the minimum and reduces abrasion of a cleaning blade that contacts the structure. The structure element having a structure in which a particular hydrocarbon compound, specifically the hydrocarbon compound represented by the Chemical Formula 1 illustrated later, is uniformly molecule-dispersed in gaps of the three dimensional network structure of the three-dimensionally cross-linked polymer is referred to an aromatic ring enclosure structure element.

In addition, the present inventors have found that it is possible to provide an image bearing member (photoreceptor) that has excellent mechanical durability and can reduce abrasion of a cleaning blade that contacts the image bearing member by forming an uppermost surface layer containing such an aromatic ring enclosure structure element.

Furthermore, the present inventors have also found that such an image bearing member makes it possible to provide an image forming method, an image forming apparatus, and a process cartridge that are able to stably produce quality images over the entire process for an extended period of time. The present invention was thus made.

In view of these findings of the present inventors, the present invention provides the following: An image bearing member having a substrate and a photosensitive layer overlying the substrate, wherein the uppermost surface layer of the image bearing member contains a hydrocarbon compound represented by the following Chemical formula 1 and a three-dimensionally cross-linked polymer formed by polymerization reaction of a charge transport compound having three or more [tetrahydro-2H-pyran-2-yl)oxy]methyl groups linked with aromatic rings. In the polymerization reaction, part of the three or more [(tetrahydro-2H-pyran-2-yl)oxy] methyl groups is severed and detached from the charge transport compound.

$Ph_1$-$Q_1$-$Ph_2$-$Q_2$-$Ph_3$ Chemical Formula 1 where $Q_1$ and $Q_2$ independently represent methylene groups or ethylene groups, $Ph_1$ and $Ph_1$ independently represent phenyl groups with which one or two methyl groups are bonded, and $Ph_2$ represents a phenylene group or a phenylene group having one methyl group.

Image Bearing Member

The image bearing member of the present disclosure includes an electroconductive substrate, a photosensitive layer overlying the electroconductive substrate, and other optional layers.

Electroconductive Substrate

There is no specific limit to the selection of materials for use in the electroconductive substrate which have a volume resistance of not greater than $10\times10^{10}$ Ω·cm. An endless belt (endless nickel belt and endless stainless belt) described in JP-S52-36016-A can be used as the electroconductive substrate.

There is no specific limitation to the method of manufacturing the electroconductive substrate. For example, there can be used plastic or paper having a film form or cylindrical form covered with a metal such as aluminum, nickel, chrome, nichrome, copper, gold, silver, and platinum or a metal oxide such as tin oxide and indium oxide by depositing or sputtering.

It is also possible to use a tube which is manufactured from a board formed of aluminum, an aluminum alloy, nickel, and a stainless metal followed by a treatment of a crafting technique such as extruding and extracting and surface-treatment such as cutting, super finishing, and grinding.

The electroconductive substrate optionally has an electroconductive layer thereon.

There is no specific limit to the method of forming an electroconductive layer. For example, an electroconductive layer is formed by: applying to the substrate mentioned above a liquid application in which electroconductive powder is dispersed in a binder resin with an optional solvent; or using a heat contraction tube of a material such as polyvinyl chloride, polypropylene, polyester, polystyrene, polyvinylidene chloride, polyethylene, chloride rubber, or TEFLON® to which the electroconductive powder mentioned above is added.

There is no specific limit to the electroconductive powder. Specific examples of such electroconductive powder include, but are not limited to, carbon black, acetylene black, metal powder, such as powder of aluminum, nickel, iron, nichrome, copper, zinc and silver, and metal oxide powder, such as electroconductive tin oxide powder and ITO powder.

There is no specific limit to the binder resin for use in the electroconductive layer. A specific binder resin is selected to a particular application. Specific examples of thereof include, but are not limited to, polystyrene resins, copolymers of styrene and acrylonitrile, copolymers of styrene and butadiene, copolymers of styrene and maleic anhydrate, polyesters resins, polyvinyl chloride resins, copolymers of a vinyl chloride and a vinyl acetate, polyvinyl acetate resins, polyvinylidene chloride resins, polyarylate resins, phenoxy resins, polycarbonate reins, cellulose acetate resins, ethyl cellulose resins, polyvinyl butyral resins, polyvinyl formal resins, polyvinyl toluene resins, poly-N-vinylcarbazole, acrylic resins, silicone resins, epoxy resins, melamine resins, urethane resins, phenolic resins, and alkyd resins.

There is no specific limitation to the selection of the solvent for use in the electroconductive layer. A suitable solvent is selected to a particular application. Specific examples thereof include, but are not limited to, tetrahydrofuran, dichloromethane, methylethyl ketone, and toluene.

Photosensitive Layer

The photosensitive layer has a charge generating layer, a charge transport layer, a cross-linked charge transport layer in this order, and other optional layers.

The cross-linked charge transport layer contains a hydrocarbon compound represented by the following Chemical Formula 1 and an aromatic ring enclosure structure element containing a three-dimensionally cross-linked polymer.

Any of known charge generating layer, charge transport layer, and other optional layers can be used.

Cross-Linked Charge Transport Layer (Uppermost Layer)

The cross-linked charge transport layer forms the uppermost surface layer of the photosensitive layer.

The cross-linked charge transport layer contains the hydrocarbon compound represented by the Chemical Formula 1, the three-dimensionally cross-linked polymer, and other optional components.

Hydrocarbon Compound Represented by Chemical Formula 1

There is no specific limit to the hydrocarbon compound represented by the Chemical Formula 1 and a suitable hydrocarbon compound can be selected to a particular application.

$Ph_1$-$Q_1$-$Ph_2$-$Q_2$-$Ph_3$ Chemical Formula 1

In Chemical Formula 1, $Q_1$ and $Q_2$ independently represent methylene groups or ethylene groups, $Ph_1$ and $Ph_3$ independently represent phenyl groups with which one or two methyl groups are bonded, and $Ph_2$ represents a phenylene group or a phenylene group having one methyl group.

In Chemical Formula 1, the methyl group of $Ph_1$ and $Ph_3$ takes any of the ortho-position, meta-position, and para-position. In addition, there is no specific limit to the substitution position when the methyl group of $Ar_2$ is bonded.

There is no specific limit to the hydrocarbon compound represented by the Chemical Formula 1 and a suitable hydrocarbon compound can be selected to a particular applications. Specific examples thereof include, but are not limited to, the compounds represented by the Chemical Structures 1-1, 1-2, 1-3, and 1-4. The compound represented by the Chemical Structure 1-2 is preferable in particular.

Chemical Structure 1-1

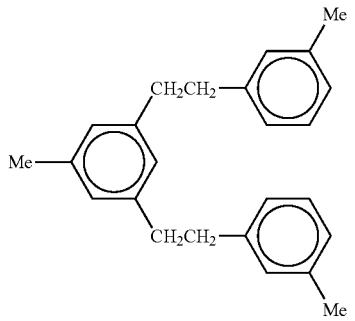

Chemical Structure 1-2

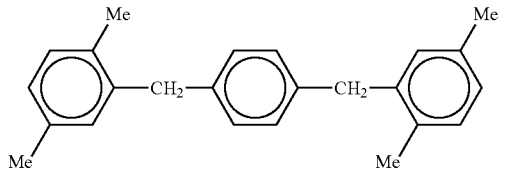

Chemical Structure 1-3

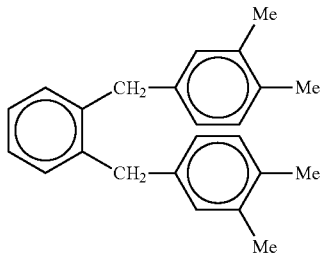

-continued

Chemical Structure 1-4

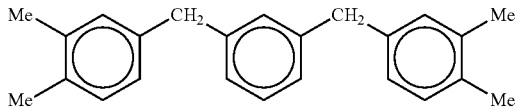

In the Chemical Structures 1-1 to 1-4, Me represents a methyl group.

There is no specific limit to the synthesis method of the hydrocarbon compound represented by the chemical formula 1 and a suitable synthesis method can be selected to a particular application. A specific example thereof is synthesis by reduction of a bisstyryl benzene derivative.

Three-Dimensionally Cross-Linked Polymer

The three-dimensionally cross-linked polymer has a three dimensional network structure and is formed by mutual reaction of monomers having three or more reaction bond-forming functional groups in a molecule to obtain a macromolecule polymer.

The three-dimensionally cross-linked polymer is formed by polymerization reaction of a charge transport compound having three or more [tetrahydro-2H-pyran-2-yl)oxy]methyl groups linked with aromatic rings. In the polymerization reaction, part of the three or more [(tetrahydro-2H-pyran-2-yl)oxy]methyl groups is severed and detached from the charge transport compound.

Charge Transport Compound Having Three or More [tetrahydro-2H-pyran-2-yl)oxy]methyl Groups are Linked with Aromatic Rings The three-dimensionally cross-linked polymer is formed by polymerization reaction of a charge transport compound having three or more [tetrahydro-2H-pyran-2-yl)oxy]methyl groups linked with aromatic rings. In the polymerization reaction, part of the three or more [(tetrahydro-2H-pyran-2-yl)oxy]methyl groups is severed and detached from the charge transport compound.

There is no specific limit to the charge transport compound having three or more [tetrahydro-2H-pyran-2-yl)oxy]methyl groups linked with aromatic rings and a suitable charge transport compound can be selected to a particular application. Specific examples thereof include, but are not limited to, a compound having a triaryl amine structure, an aminobiphenyl structure, a benzidine structure, an amino stilbene structure, a naphthalene tetracarboxylic acid diimide structure, or a benzhydrazine structure.

There is no specific limit to the charge transport compound having three or more [tetrahydro-2H-pyran-2-yl)oxy]methyl groups linked with aromatic rings and such a charge transport compound can be selected to a particular application. Specific examples thereof include, but are not limited to, a compound represented by the following Chemical Formula 2, the following Chemical Formula 3, or the following Chemical Formula 4. These can be used alone or in combination.

Compound Represented by Chemical Formula 2

The charge transport compound represented by Chemical Formula 2 has a high ratio of [tetrahydro-2H-pyran-2-yl)oxy]methyl group per molecular weight. For this reason, a three dimensional cross-linked layer having a higher cross-linking density is formed so that a hard and durable image bearing member (photoreceptor) having a high damage resistance can be provided.

Chemical Formual 2

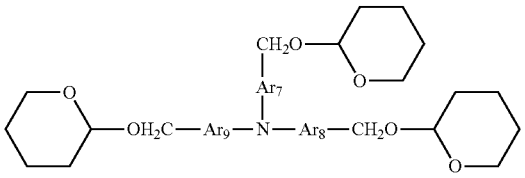

In Chemical Formula 2, $Ar_7$, $Ar_8$, and $Ar_9$ independently represent divalent aromatic hydrocarbon groups having 6 to 18 carbon atoms that optionally have alkyl substitution groups.

In the Chemical Formula 2, specific examples of the alkyl group in $Ar_7$, $Ar_8$, and $Ar_9$ include, but are not limited to, linear or branch-chained aliphatic alkyl groups such as a methyl group, an ethyl group, a propyl group, a butyl group, a pentyl group, a hexyl group, a heptyl group, and an octyl group.

In the Chemical Formula 2, specific examples of the aromatic hydrocarbon having 6 to 18 carbon atoms in $Ar_7$, $Ar_8$, and $Ar_9$ include, but are not limited to, benzene, naphthalene, fluorene, phenanthrene, anthracene, pyrene, biphenyl, terphenyl, and stilbene.

There is no specific limit to the compound represented by Chemical Formula 2 and a suitable compound is selectable to a particular application. For example, the compound represented by the following Chemical Formula 2-1 is preferable in terms of cross-linking reaction.

Chemical Formula 2-1

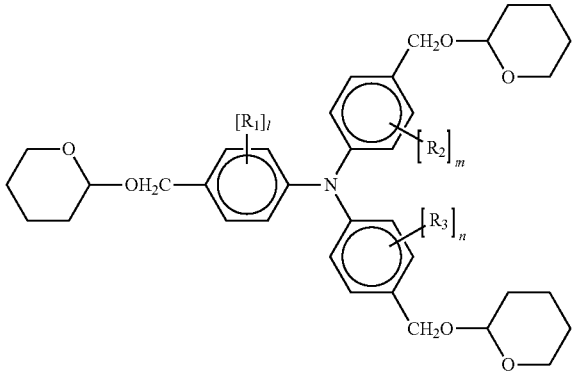

In Chemical Formulae 2-1, R1, R2, and R3 independently represent hydrogen atoms, methyl groups, or ethyl groups and l, m, and n independently represent integers of from 1 to 4.

The compound represented by Chemical Formula 2-1 is particularly excellent among the compounds represented by Chemical Formula 2 and the mutual polymerization reactivity is particularly good. Although the polymerization reaction between [(tetrahydro-2H-pyran-2-yl)oxy]methyl groups is not all clear, the reaction proceeds fastest when the aromatic ring with which [tetrahydro-2H-pyran-2-yl)oxy]methyl group is linked is a benzene ring having a tertiary amino group, thereby forming a cross-linked protective layer having a higher cross-linking density.

There is no specific limit to the compound represented by Chemical Formula 2 and a suitable compound is selectable to a particular application. For example, the compounds represented by the following Chemical Structures 2-1 to 2-11 are suitable. Specific examples of the compound represented by the Chemical Structures 2-1 to 2-8 include, but are not limited to, the following.

Chemical Structure 2-1

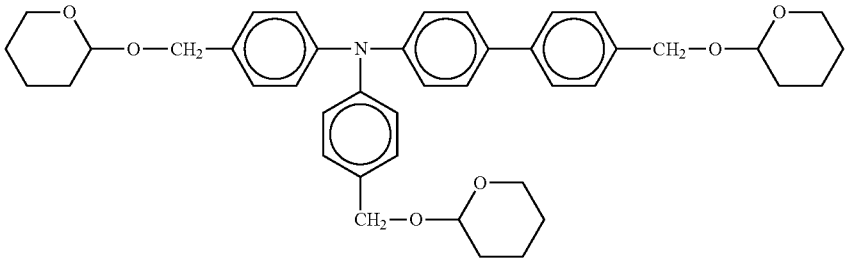

Chemical Structure 2-2

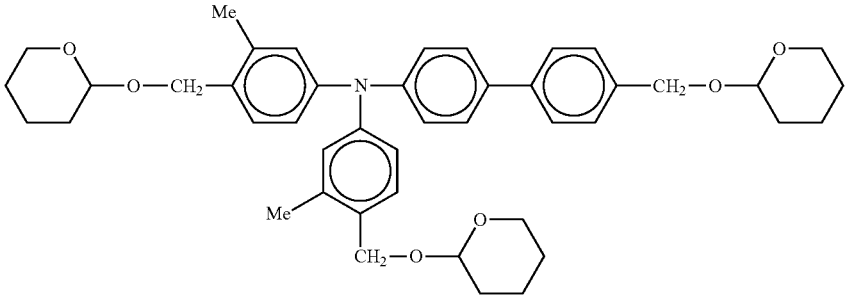

-continued
Chemical Structure 2-3
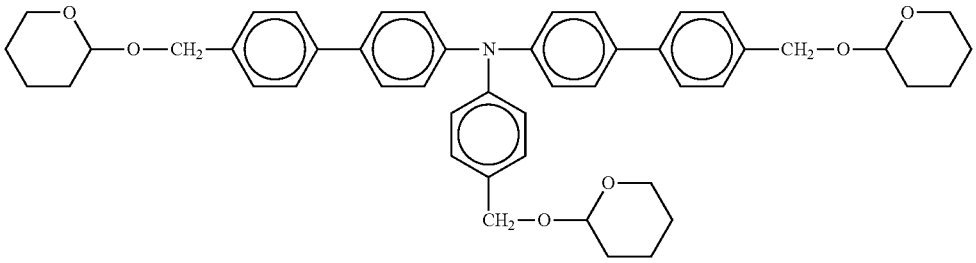
Chemical Structure 2-4
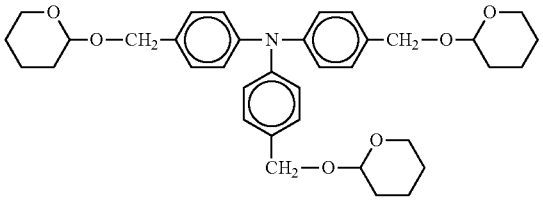
Chemical Structure 2-5
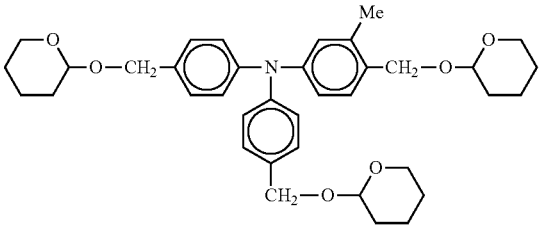
Chemical Structure 2-6
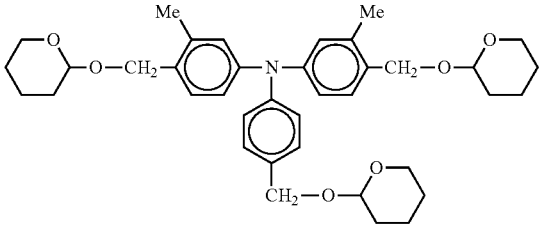
Chemical Structure 2-7
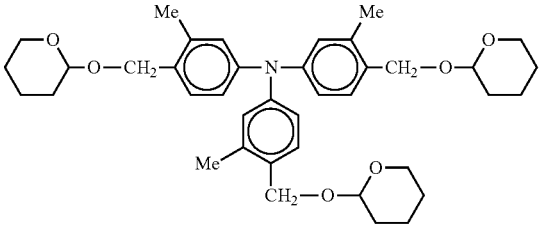
Chemical Structure 2-8
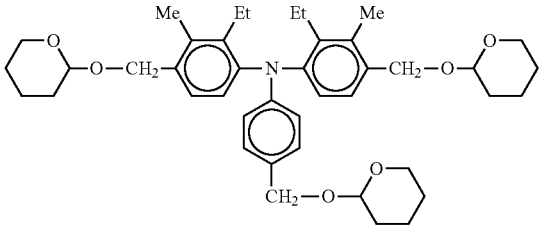
Chemical Structure 2-9
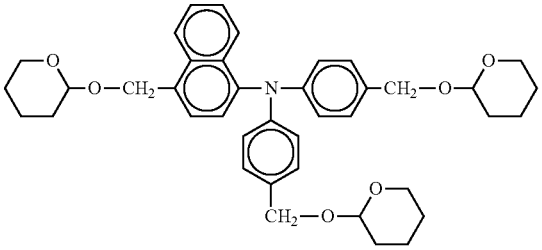
Chemical Structure 2-10
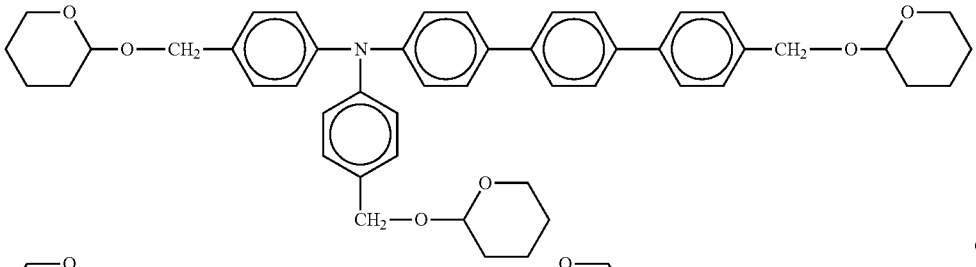
Chemical Structure 2-11
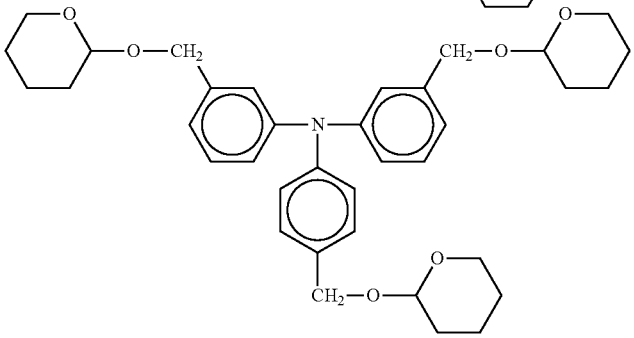

In the Chemical Structures, Me represents a methyl group and Et represents an ethyl group.

Compound Represented by Chemical Formula 3

The charge transport compound represented by the Chemical Formula 3 contains four [(tetrahydro-2H-pyran-2-yl)oxy]methyl groups linked with the aromatic rings and has a moderate molecular movement property because of $X_3$ as a non-conjugated linking group. As a result, a three-dimensionally cross-linked layer in which part of [(tetrahydro-2H-pyran-2-yl)oxy]methyl groups remains in polymerization reaction tends to be formed. For this reason, the balance between the hardness and elasticity of the formed three-dimensionally cross-linked layer is good, which makes it possible to form a durable surface protective layer having excellent damage resistance and abrasion resistance. Furthermore, due to the structure of $X_3$, the oxidation potential of the molecule is relatively large so that the compound is relatively stable and not easily oxidized by exposure to an oxidized gas such as ozone gas and an $NO_x$ gas. That is, it is possible to provide a photoreceptor having a good gas resistance.

Chemical Formula 3

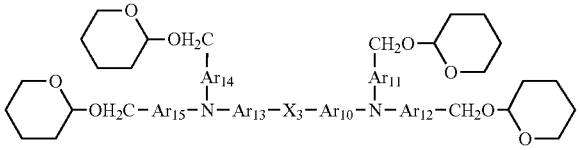

In Chemical Formula 3, $X_3$ represents an alkylene group having 1 to 4 carbon atoms, an alkylidene group having 2 to 6 carbon atoms, a divalent group in which two alkylidene groups having 2 to 6 carbon atoms are bonded with a phenylene group, or an oxygen atom and $Ar_{10}$, $Ar_{11}$, $Ar_{12}$, $Ar_{13}$, $Ar_{14}$, and $Ar_{15}$ independently represent divalent aromatic hydrocarbon groups having 6 to 18 carbon atoms that optionally have alkyl substitution groups.

In the Chemical Formula 3, specific examples of the alkylene group having one to four carbon atoms in $X_3$ include, but are not limited to, linear or branch-chained alkylene groups such as a methylene group, an ethylene group, a propylene group, and a buthylene group.

In the Chemical Formula 3, specific examples of the alkylidene group having 2 to 6 carbon atoms in $X_3$ include, but are not limited to, 1,1-ethylidene group, 1,1-propylidene group, 2,2-propylidned group, 1,1-butylidene group, 2,2-butylidene group, 3,3-pentanilidene, and 3,3-hexanylidene.

In Chemical Formula 3, specific examples of the divalent group in $X_3$ in which two alkylidene groups having 2 to 6 carbon atoms are bonded via a phenylene group include, the following represented by the following chemical structures:

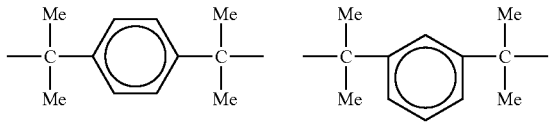

In the chemical structures, Me represents a methyl group.

There is no specific limit to the compound represented by Chemical Formula 3 and any known compound is selectable to a particular application. For example, the compound represented by the following Chemical Formula 3-1 is preferable in terms of cross-linking reaction.

Chemical Formula 3-1

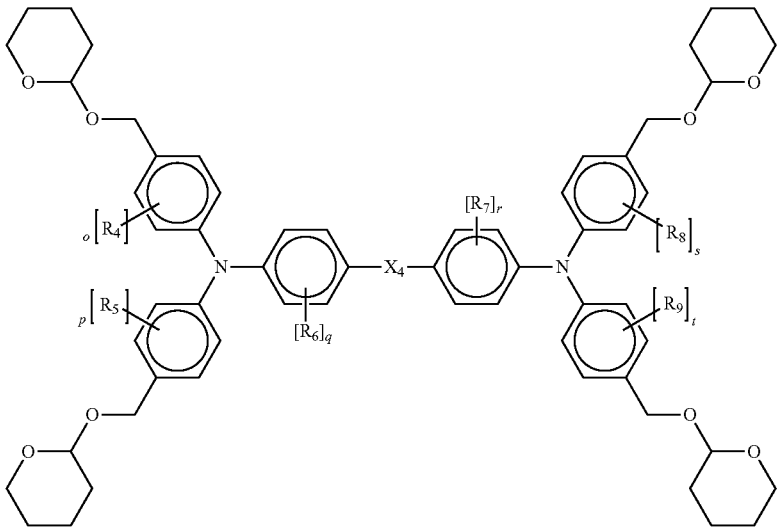

In Chemical Formula 3-1, $X_4$ represents —$CH_2$—, $CH_2CH_2$—, —$C(CH_3)_2$-Ph-$C(CH_3)_2$—, —$C(CH_2)_5$— or —O—, $R_4$, $R_5$, $R_6$, $R_7$, $R_8$, and $R_9$ independently represent hydrogen atoms, methyl groups, or ethyl groups, Ph represents a phenylene group, and o, p, q, r, s, and t independently represent integers of from 1 to 4.

The compound represented by the Chemical Formula 3-1 is particularly excellent among the compounds represented by the Chemical Formula 3 and the mutual polymerization reactivity is particularly good. In addition, this compound has the same characteristics as the compound represented by Chemical Formula 3 and makes it possible to form a high dense surface protective layer having a good balance between the hardness and elasticity thereof with excellent toxicity resistance.

There is no specific limit to the compound represented by Chemical Formula 3 and a suitable compound is selectable to a particular application. For example, the compounds represented by the following Chemical Structures 3-1 to 3-29 are suitable. The Chemical Structures 3-1 to 3-24 are specific examples of the Chemical Formula 3-1.

Chemical Structures 3-1 to 3-6

Chemical Structure 3-1

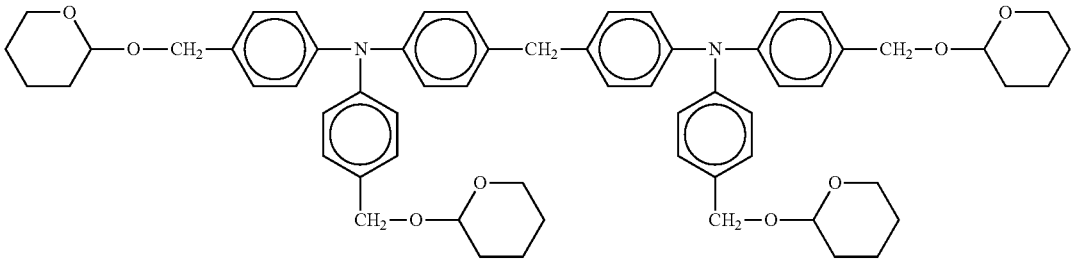

Chemical Structure 3-2

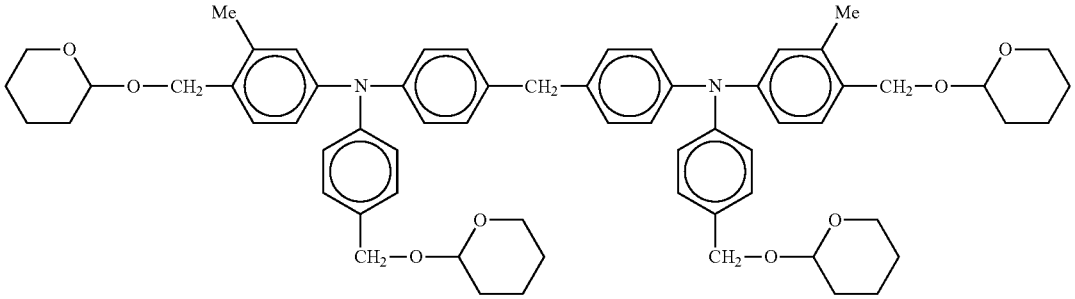

Chemical Structure 3-3

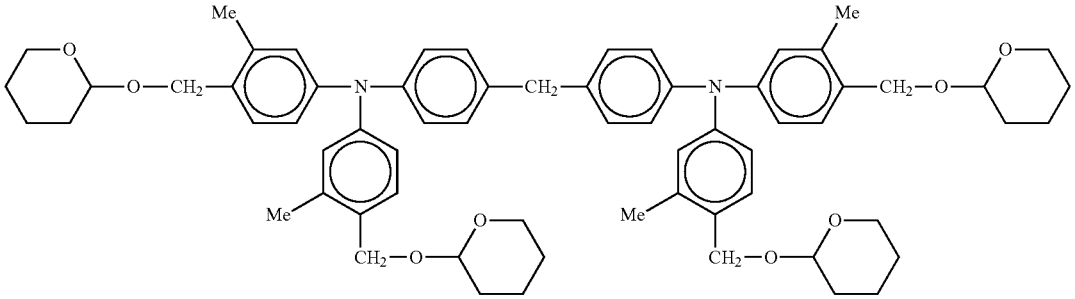

Chemical Structure 3-4

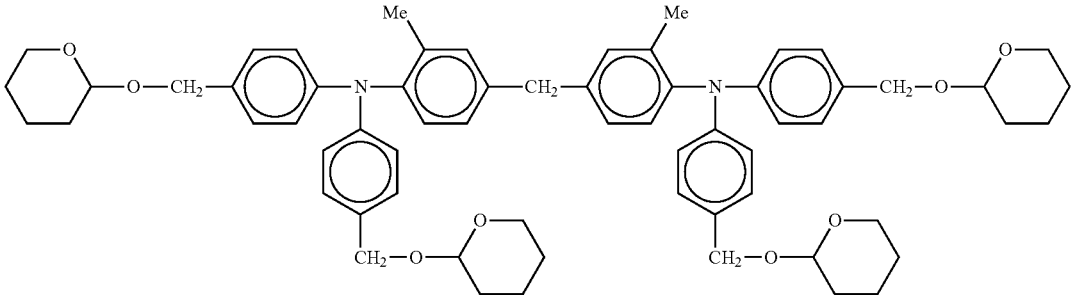

-continued
Chemical Structure 3-5
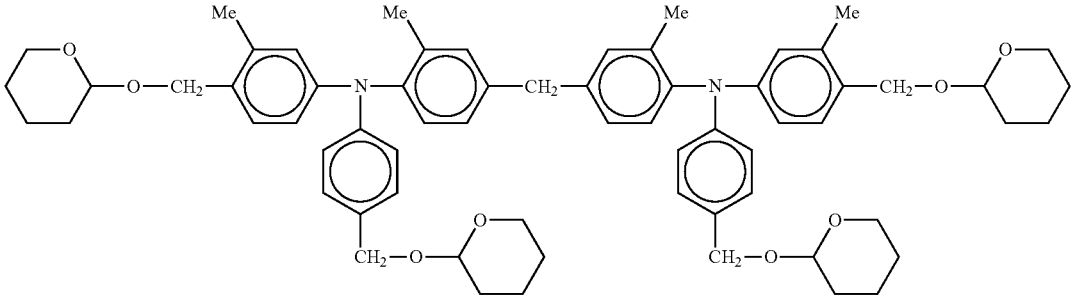
Chemical Structure 3-6
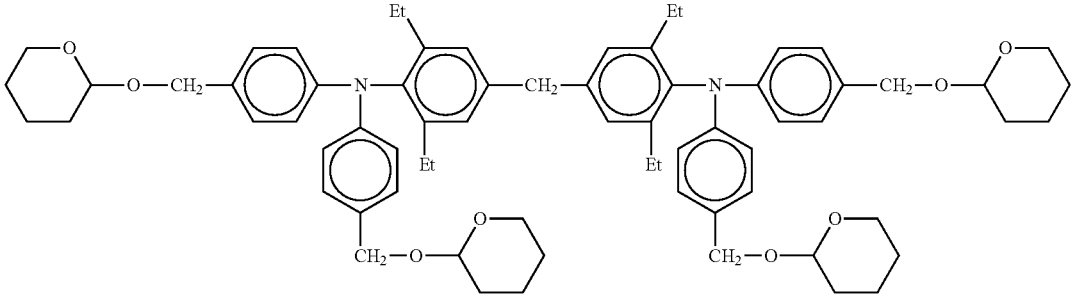
Chemical Structure 3-7
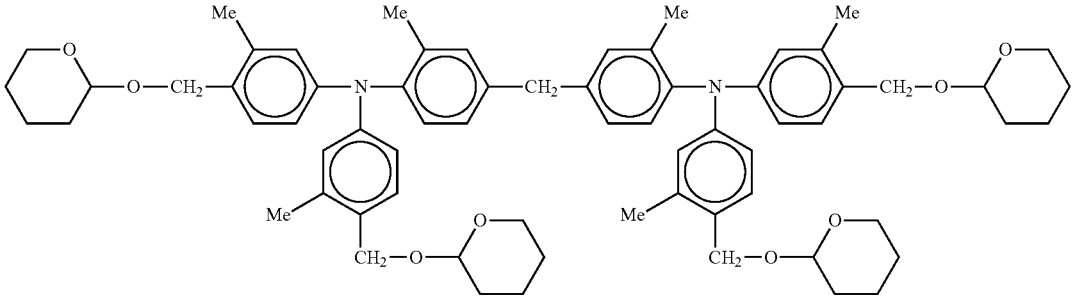
Chemical Structure 3-8
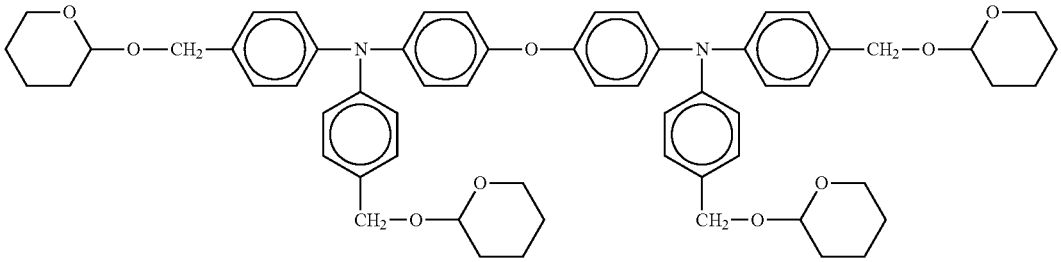
Chemical Structure 3-9
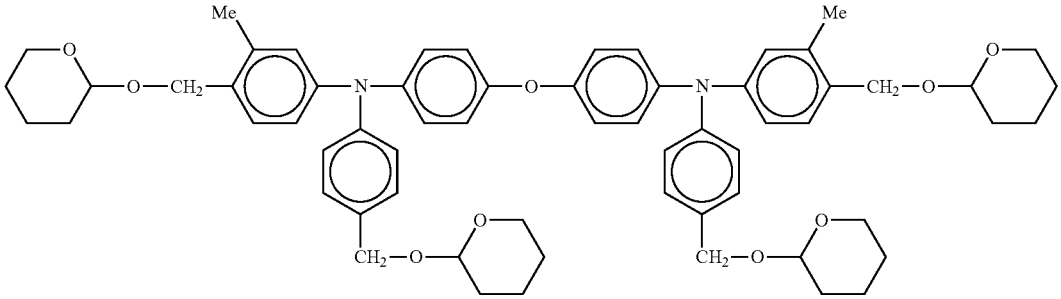

-continued
Chemical Structure 3-10
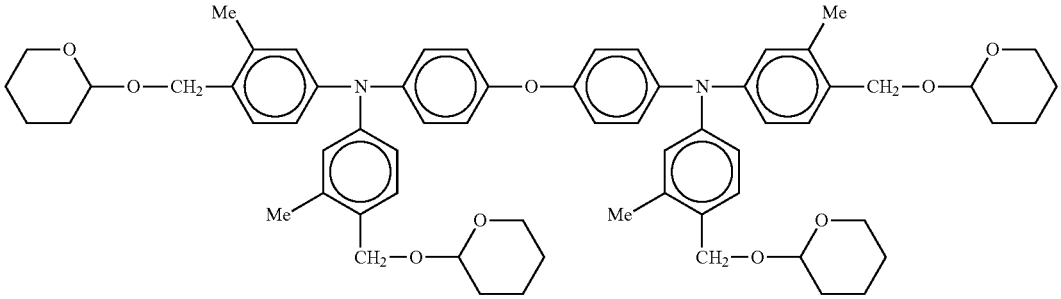
Chemical Structure 3-11
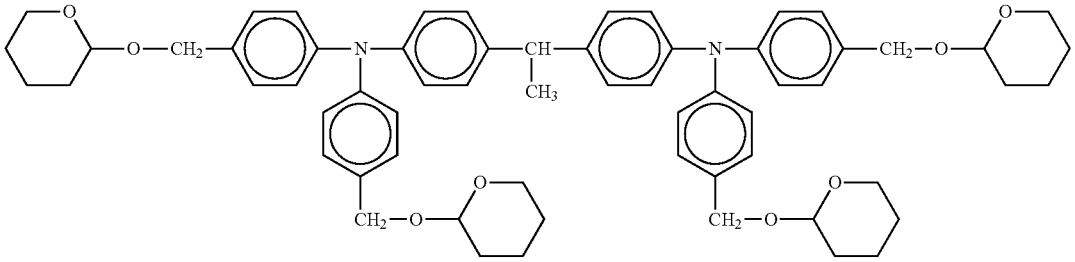
Chemical Structure 3-12
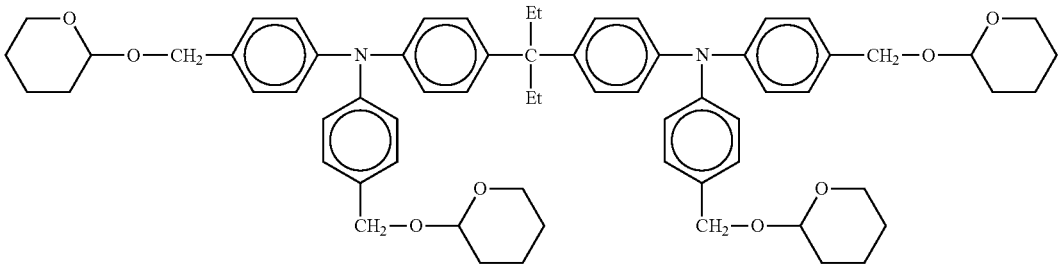
Chemical Structure 3-13
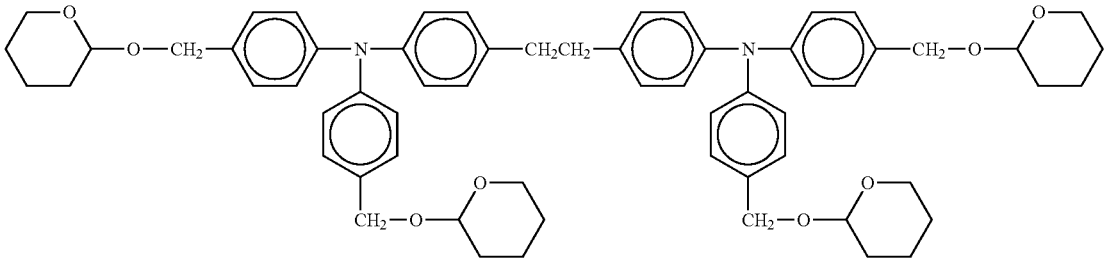
Chemical Structure 4-14
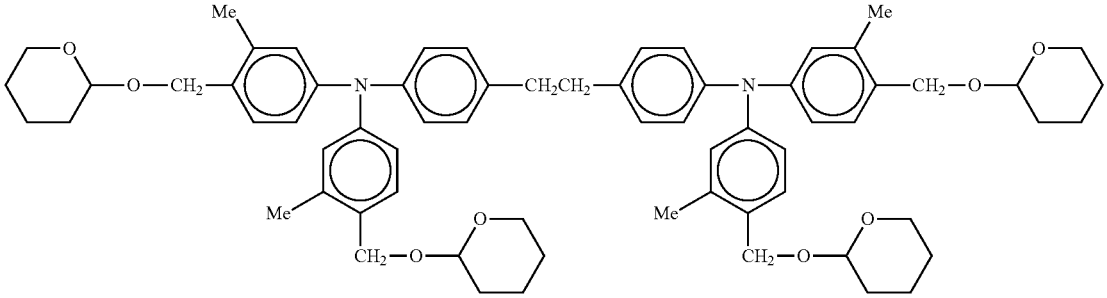

-continued
Chemical Structure 3-15
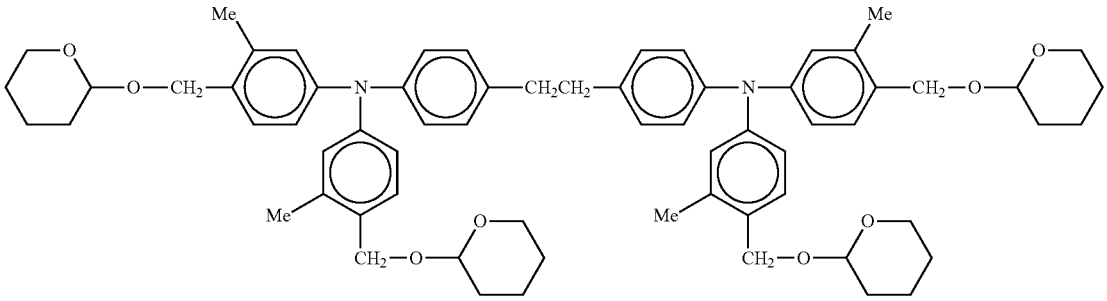
Chemical Structure 3-16
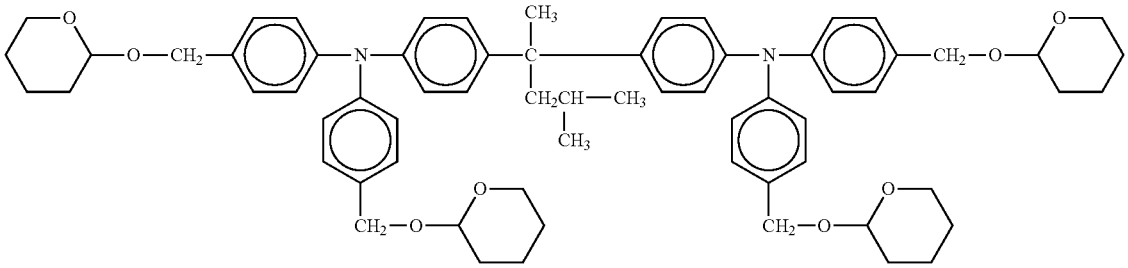
Chemical Structure 3-17
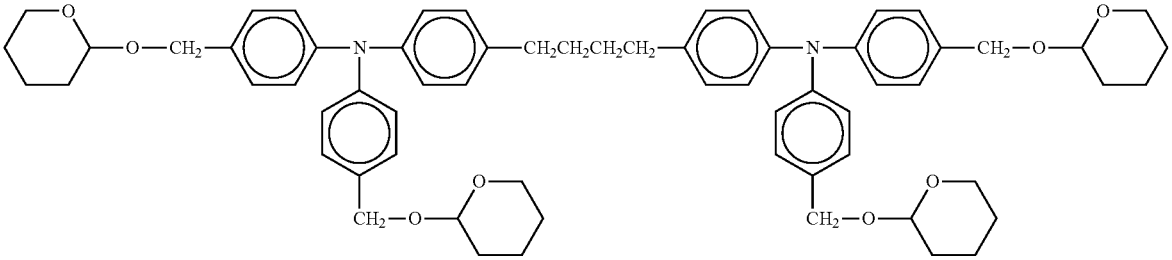
Chemical Structure 3-18
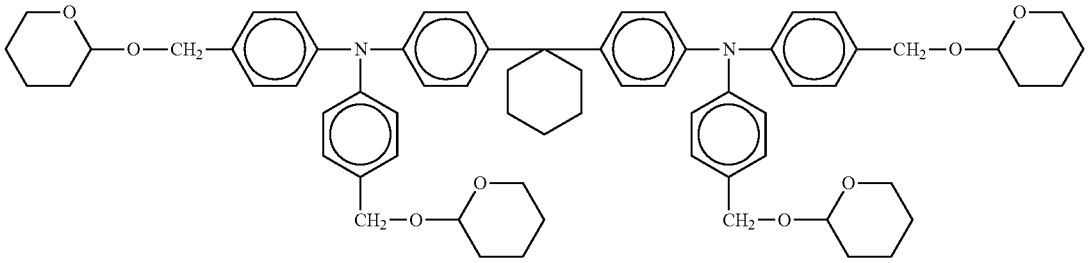
Chemical Structure 3-19
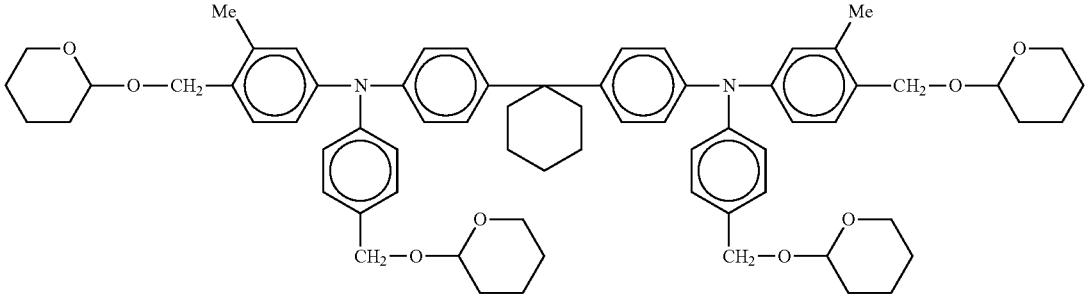

-continued
Chemical Structure 3-20
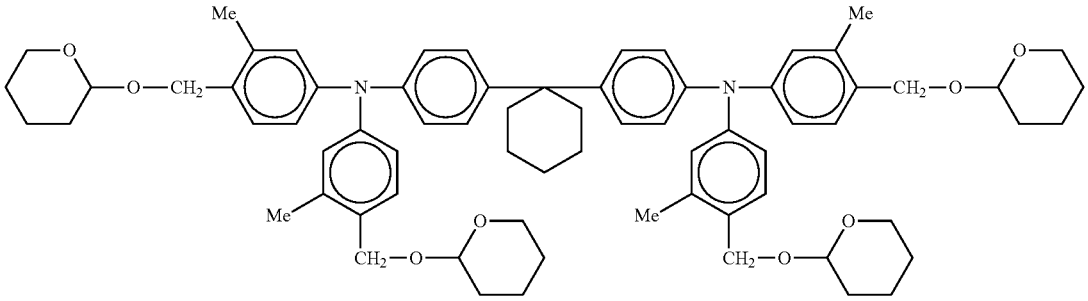
Chemical Structure 3-21
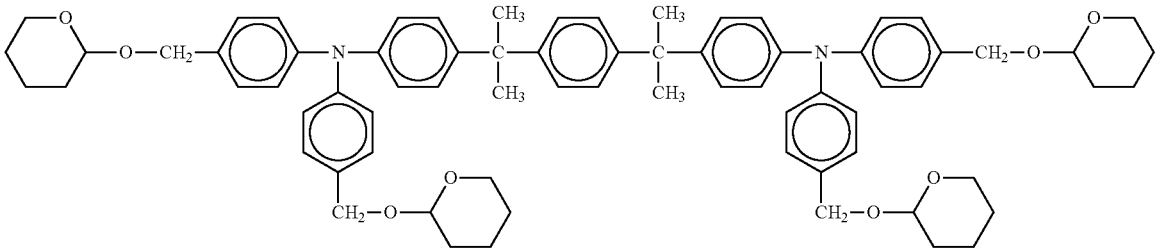
Chemical Structure 3-22
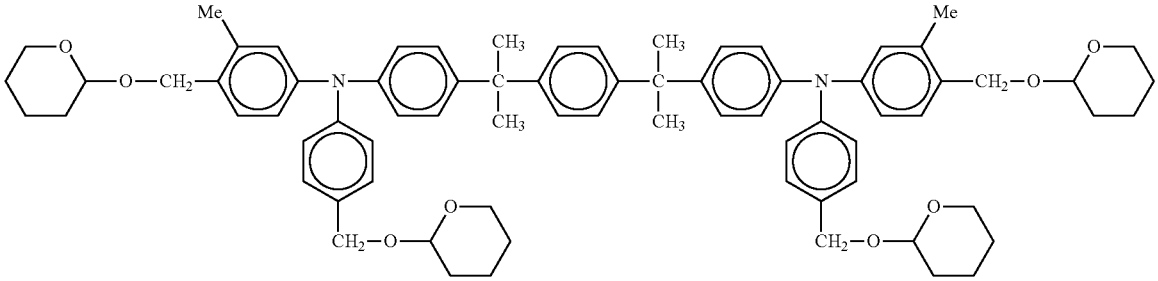
Chemical Structure 3-23
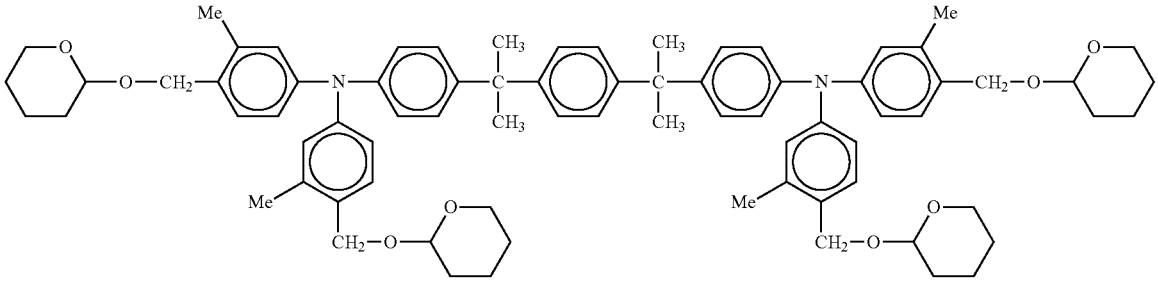
Chemical Structure 3-24
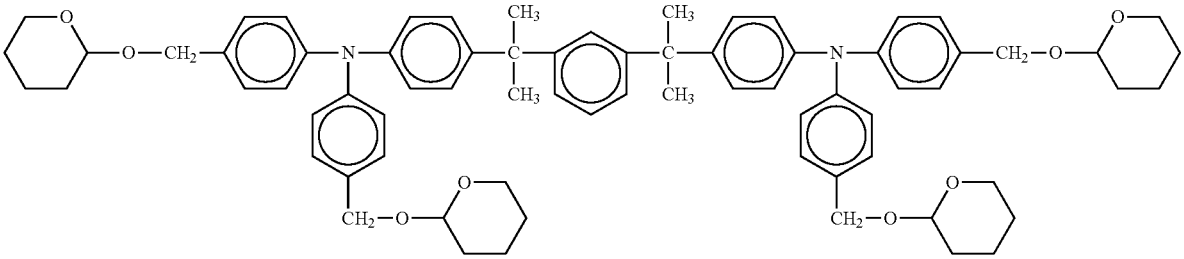

-continued
Chemical Structure 3-25
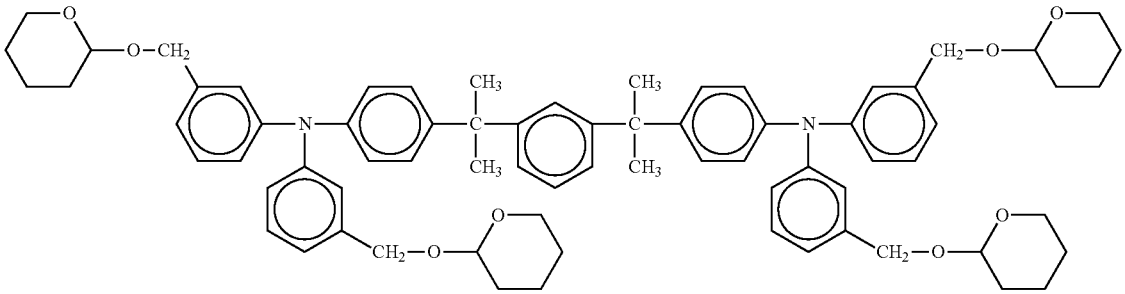
Chemical Structure 3-26
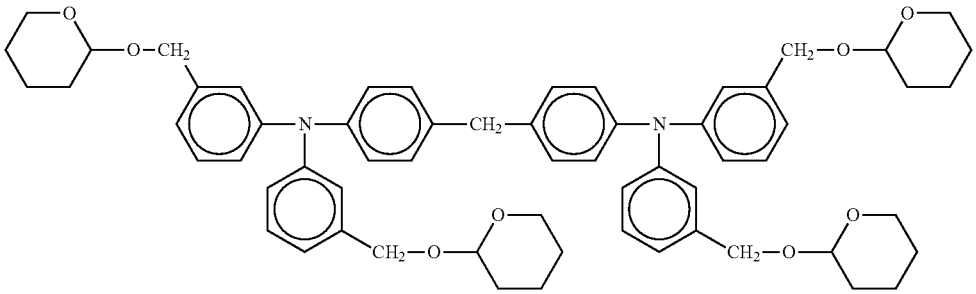
Chemical Structure 3-27
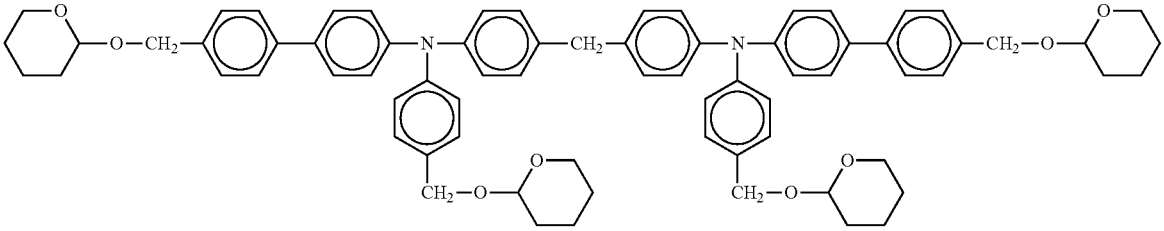
Chemical Structure 3-28
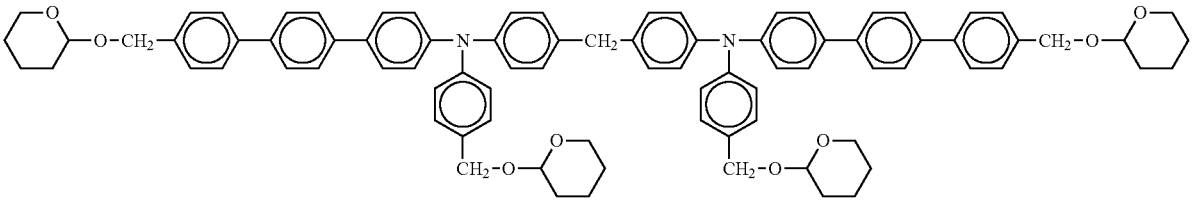
Chemical Structure 3-29
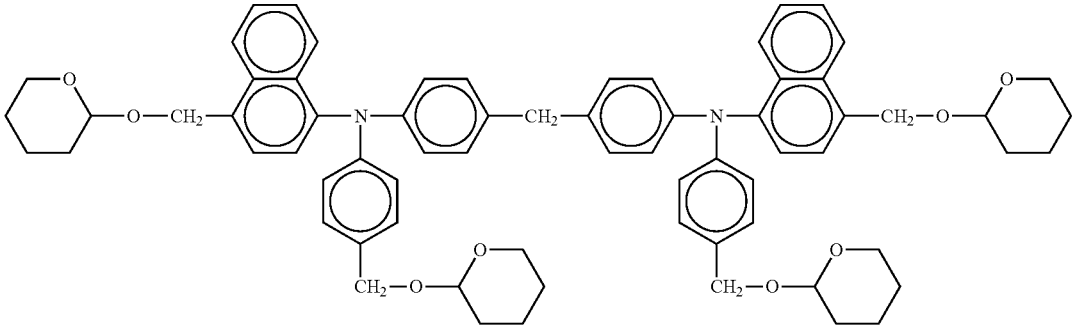

In the Chemical Structures, Me represents a methyl group and Et represents an ethyl group.

Compound Represented by Chemical Formula 4

The charge transport compound represented by the Chemical Formula 4 contains four [(tetrahydro-2H-pyran-2-yl)oxy] methyl groups linked with the aromatic rings and easily forms three dimensional cross-linked layer in polymerization reaction in which part of [(tetrahydro-2H-pyran-2-yl)oxy]methyl groups remains. In addition, the compound has a diamine structure via a particular aromatic hydrocarbon structure represented by $Y_1$ and the charges are mobile in a molecule so that a cross-linked protective layer having a high hole mobility can be formed. For this reason, it is possible to provide a photoreceptor having a low voltage at a light portion, which can be used even when the time to be taken from optical writing to development is shortened because of high speed printing or a photoreceptor drum having a small diameter.

Chemical Formula 4

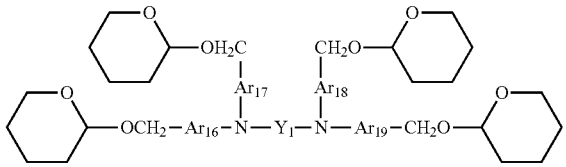

In Chemical Formula 4, $Y_1$ represents a divalent group of benzene, biphenyl, terphenyl, stilbene, distyryl benzene, or a condensed polycyclic aromatic hydrocarbon, $Ar_{16}$, $Ar_{17}$, $Ar_{18}$, and $Ar_{19}$ independently represent divalent aromatic hydrocarbon groups having 6 to 18 carbon atoms that optionally have alkyl substitution groups.

In Chemical Formula 4, specific examples of the condensed polycyclic aromatic hydrocarbons in $Y_1$ include, but are not limited to, naphthalene, phenanthrene, anthracene, and pyrene.

There is no specific limit to the compound represented by Chemical Formula 4 and any known compound is selectable to a particular application. For example, the compound represented by the following Chemical Formula 4-1 is preferable in terms of cross-linking reaction.

Chemical Formula 4-1

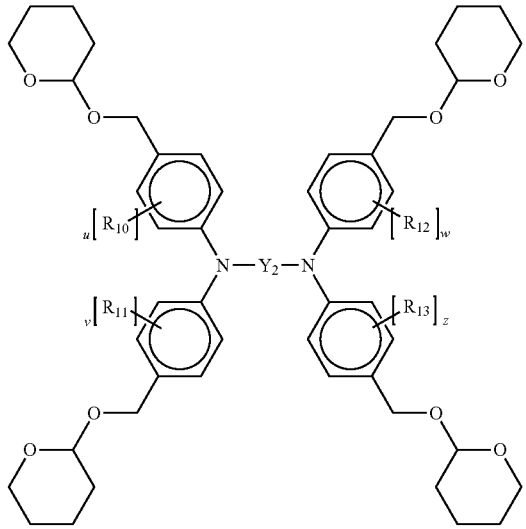

In Chemical Formula 4-1, $Y_2$ represents a divalent group of benzene, biphenyl, terphenyl, stilbene, and naphthalene, $R_{10}$, $R_{11}$, $R_{12}$, and $R_{13}$ independently represent hydrogen atoms, methyl groups, or ethyl groups, and u, v, w, and z independently represent integers of from 1 to 4.

The compound represented by the Chemical Formula 4-1 is particularly excellent among the compounds represented by the Chemical Formula 4 so that the mutual polymerization reactivity is particularly good. In addition, this compound has the same characteristics as the compound represented by Chemical Formula 4 and makes it possible to form a high dense surface protective layer.

There is no specific limit to the compound represented by Chemical Formula 4 and a suitable compound can be selected to a particular application. For example, the compounds represented by the following Chemical Structures 4-1 to 4-26 are suitable. The following compounds represented by Chemical Structures 4-3 to 4-5, 4-12 to 4-14, and 4-17 to 4-24 are also specific examples of the compound represented by the Chemical Formula 4-1.

Chemical Structure 4-1

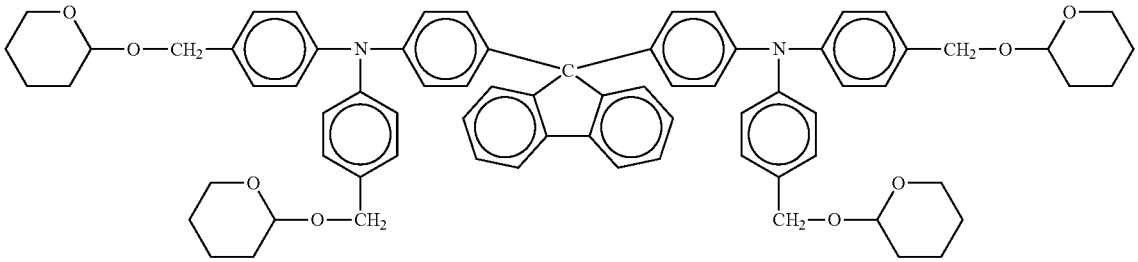

-continued
Chemical Structure 4-2
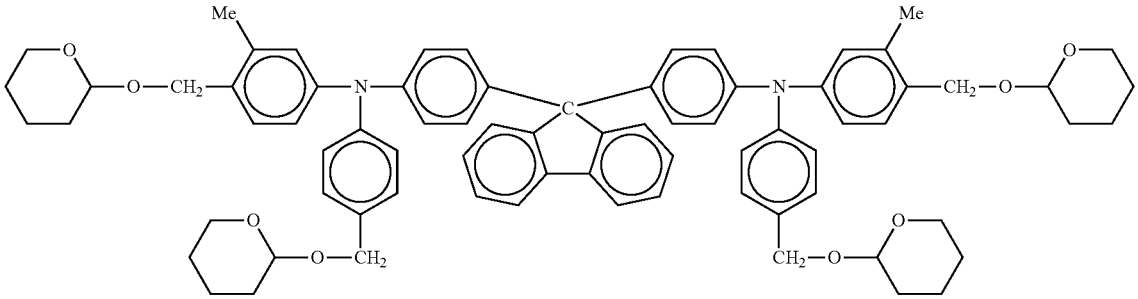
Chemical Structure 4-3
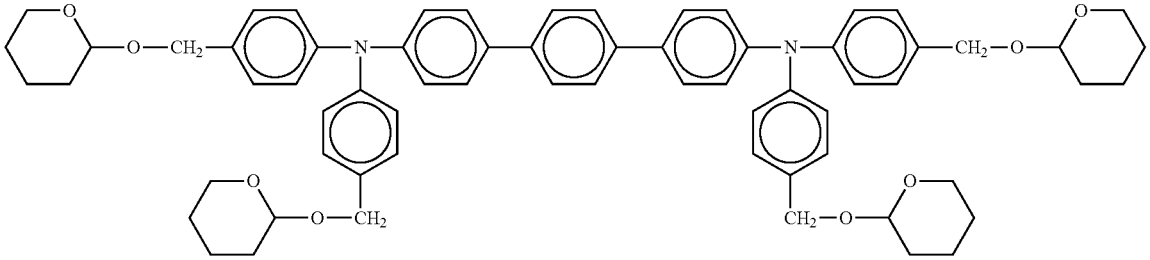
Chemical Structure 4-4
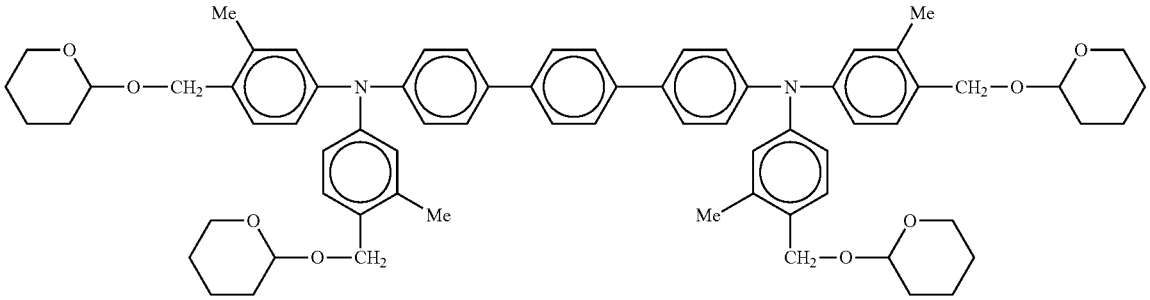
Chemical Structure 4-5
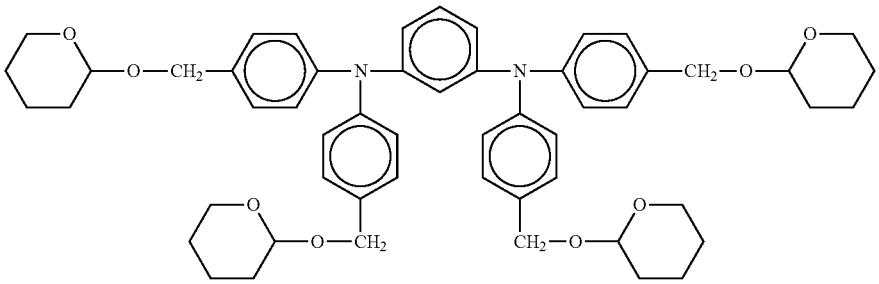
Chemical Structure 4-6
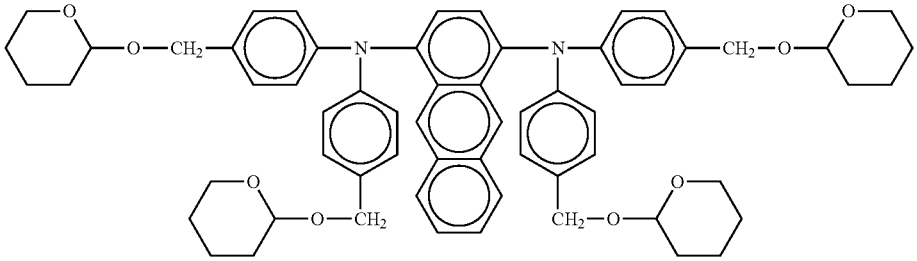

-continued
Chemical Structure 4-7
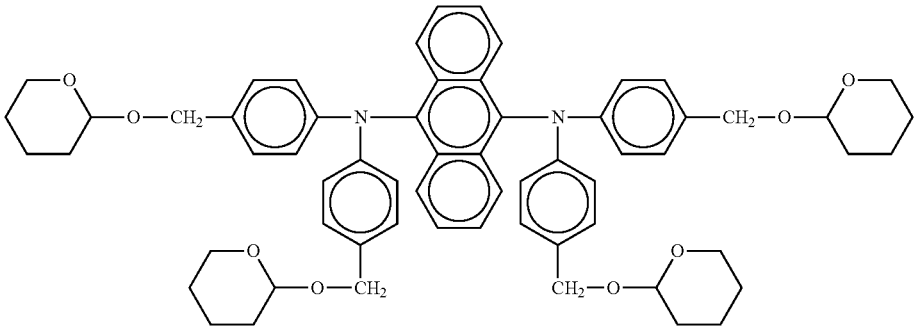
Chemical Structure 4-8
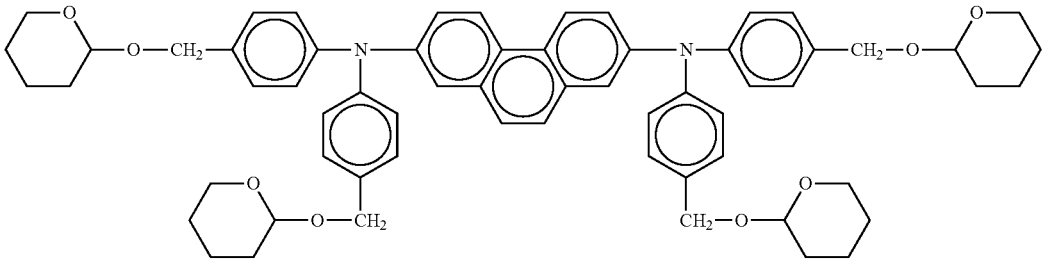
Chemical Structure 4-9
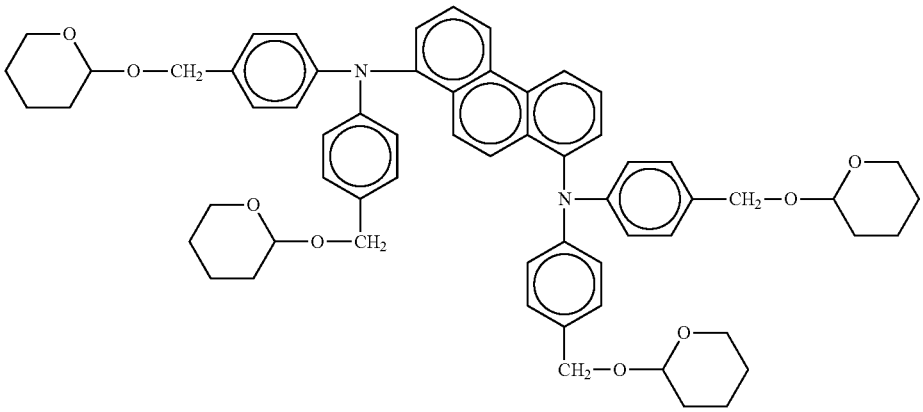
Chemical Structure 4-10
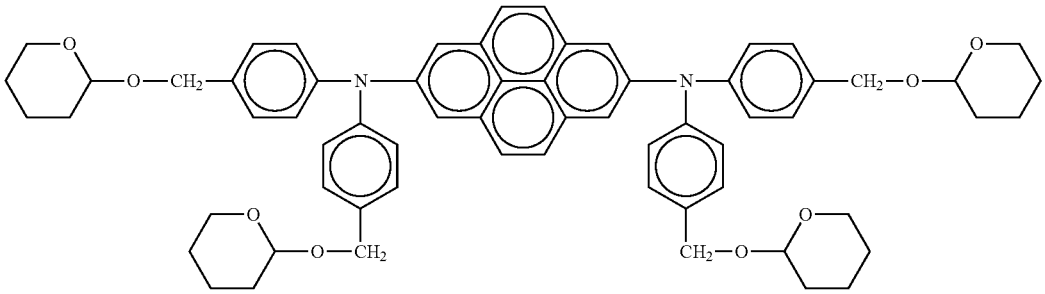

-continued
Chemical Structure 4-11
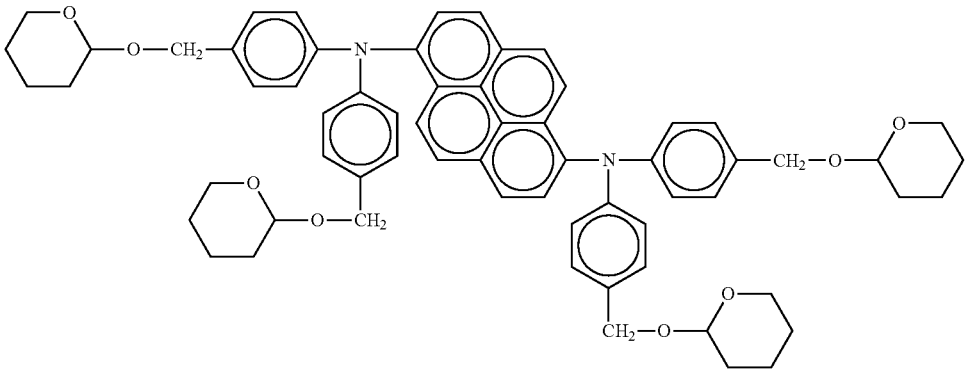
Chemical Structure 4-12
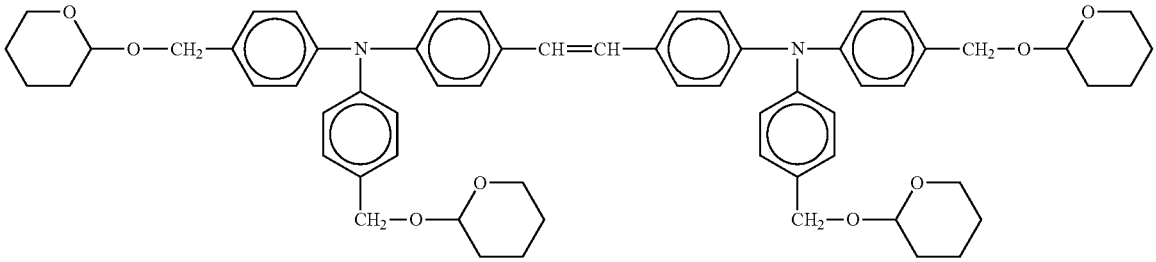
Chemical Structure 4-13
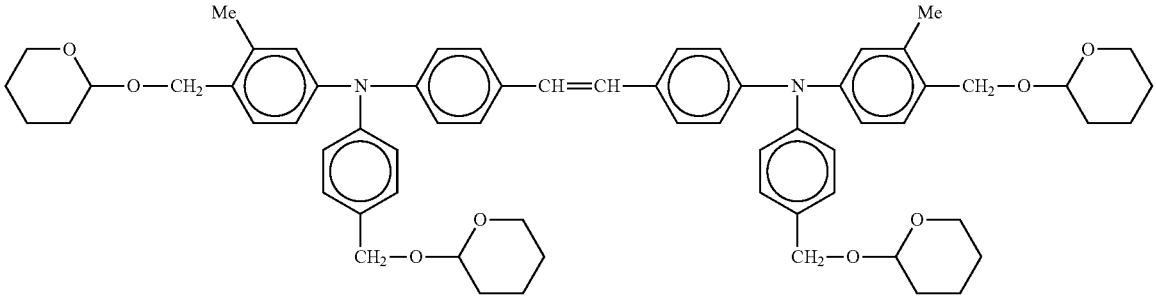
Chemical Structure 4-14
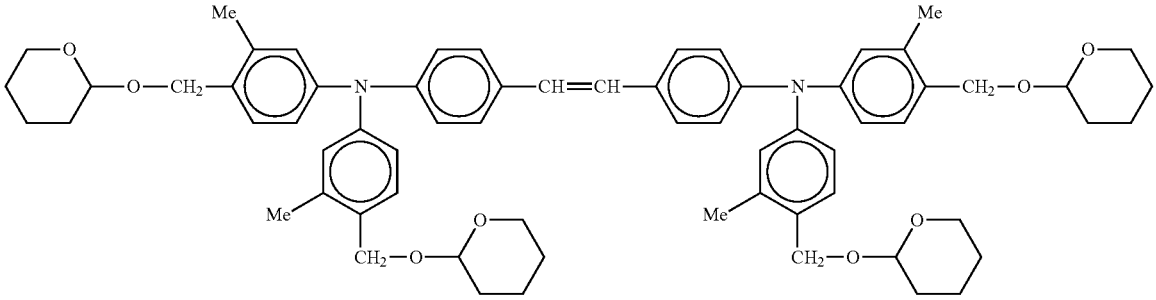
Chemical Structure 4-15
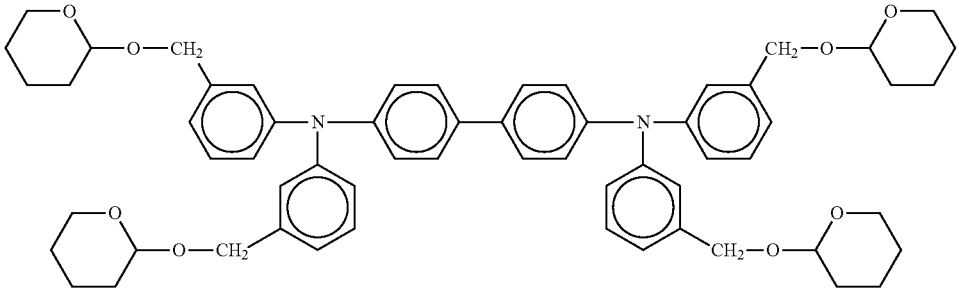

-continued
Chemical Structure 4-16
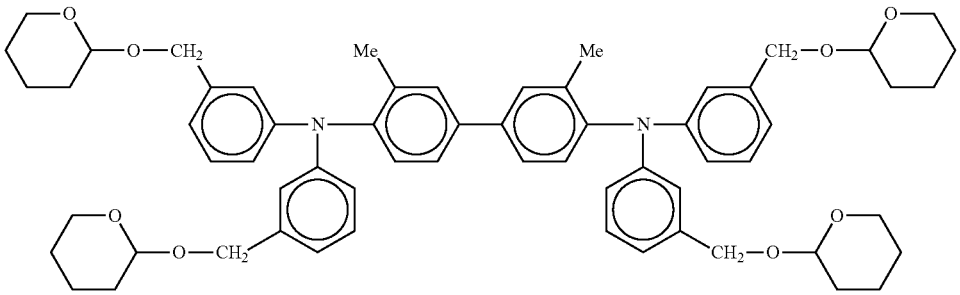
Chemical Structure 4-17
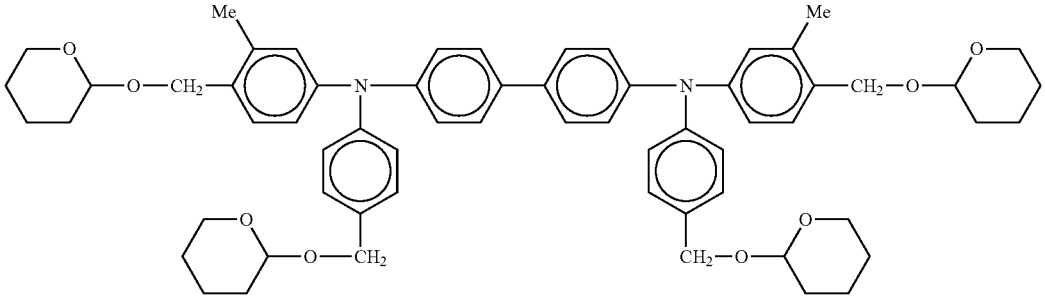
Chemical Structure 4-18
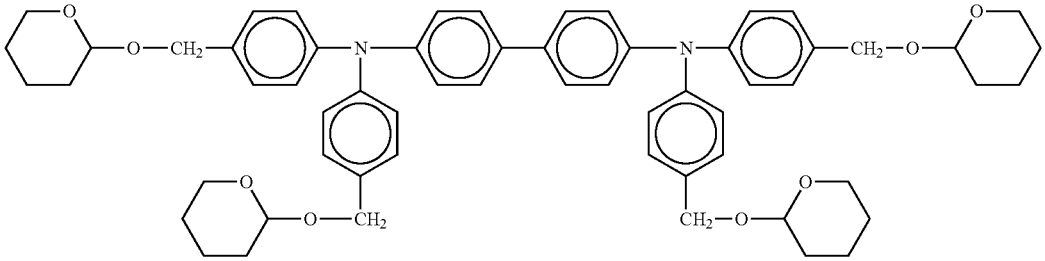
Chemical Structure 4-19
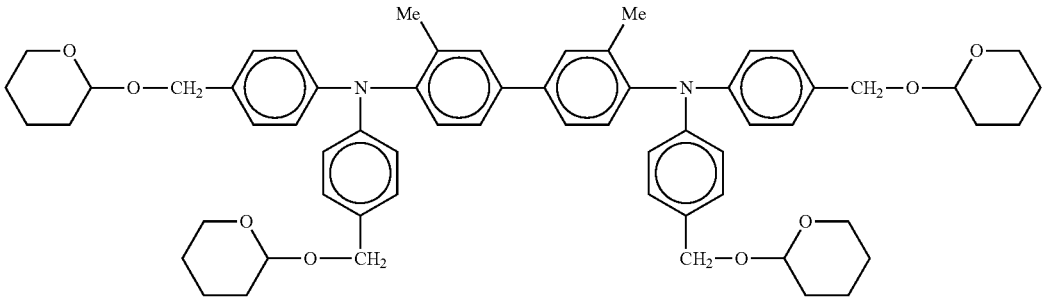
Chemical Structure 4-20
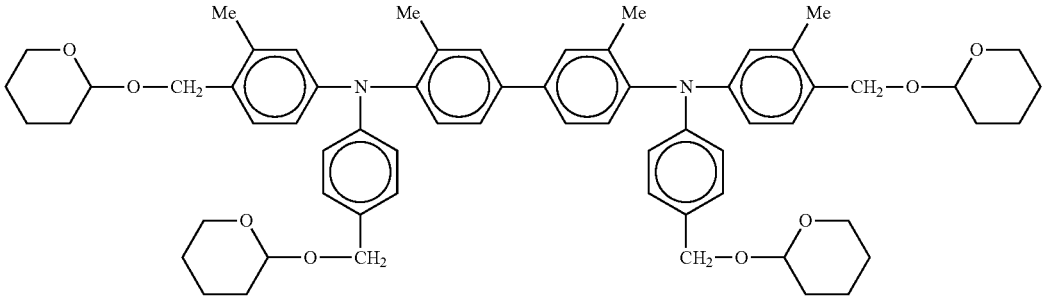

-continued
Chemical Structure 4-21
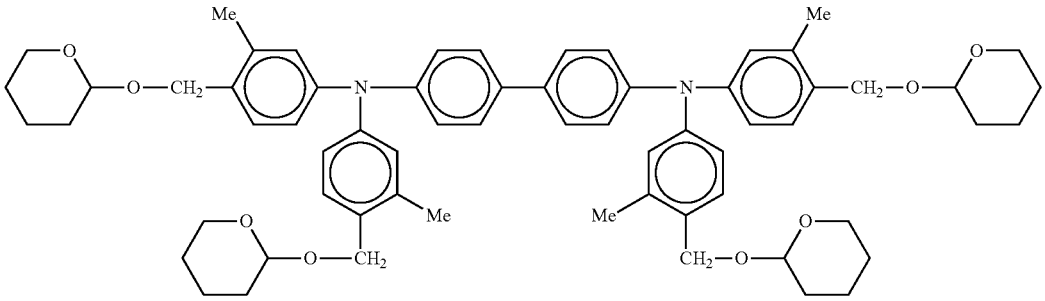
Chemical Structure 4-22
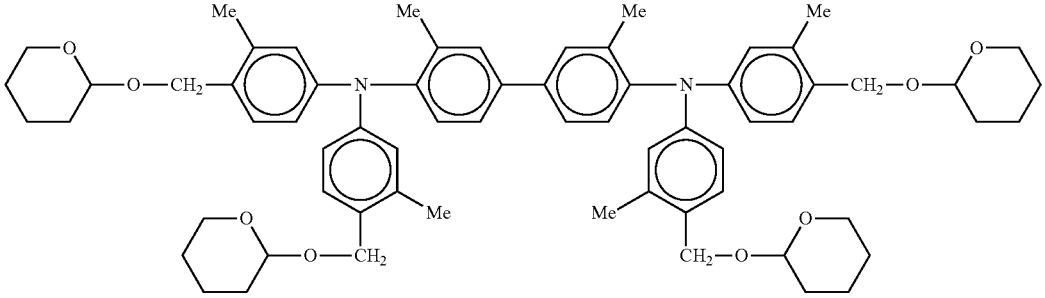
Chemical Structure 4-23
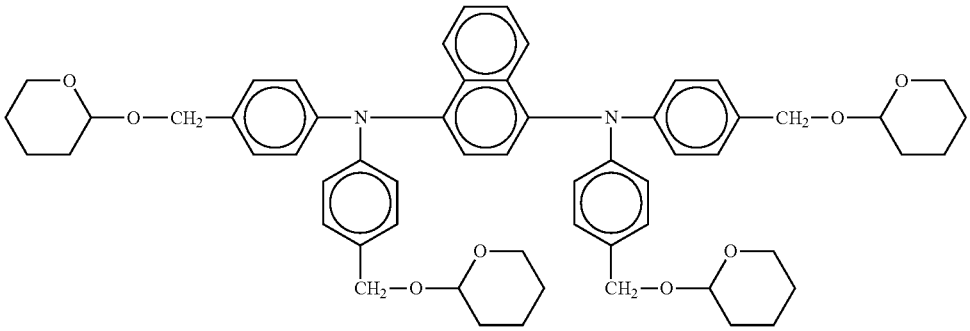
Chemical Structure 4-24
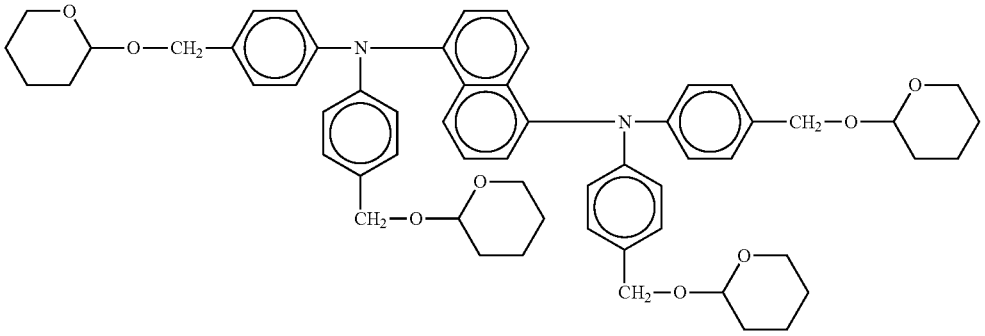
Chemical Structure 4-25
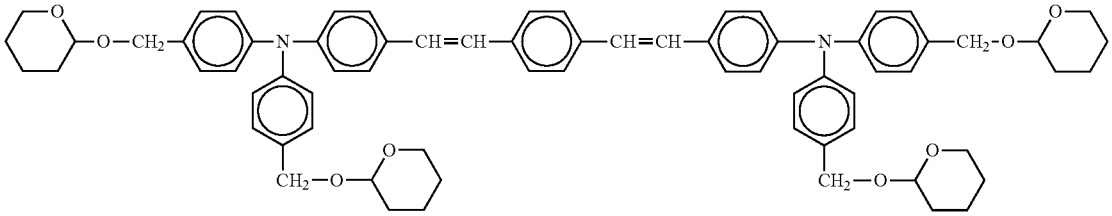

-continued

Chemical Structure 4-26

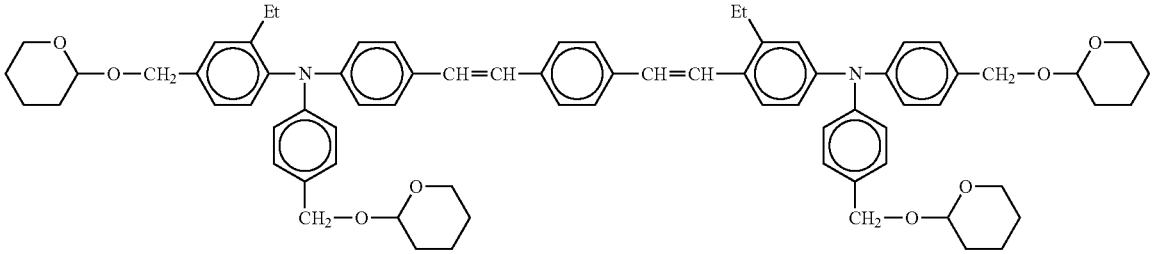

In the Chemical Structures 44 to 4-26, Me represents a methyl group and Et represents an ethyl group.

Synthesis Method of Charge Transport Compound Having Three or More [tetrahydro-2H-pyran-2-yl)oxy]methyl Groups Linked with Aromatic Rings The charge transport compound having three or more [tetrahydro-2H-pyran-2-yl)oxy]methyl groups linked with aromatic rings can be synthesized by the following first or second synthesis method.

First Synthesis Method

A specific example of the first synthesis method is (1): synthesizing an aldehyde compound of the charge transport compound; (2): synthesizing a methylol compound by reacting the obtained aldehyde compound with a reducing agent: and (3): synthesizing the charge transport compound having three or more [tetrahydro-2H-pyran-2-yl)oxy]methyl groups linked with aromatic rings by reacting the obtained methylol compound and 3,4-dihydro-2H-pyran.

There is no specific limit to the synthesis method of the aldehyde compound of the charge transport compound of (1). A suitable aldehyde compound can be selected to a particular application. As represented in the following Chemical Reaction 1, a charge transport compound (raw material) is formylated by a known method (for example, Vilsmeier reaction) to synthesize an aldehyde compound. JP-3943522-B1 (JP-2003-300941-A) discloses formylation in detail. These methods can be used.

There is no specific limit to the method of formylating three or more positions of the aromatic rings of a charge transport compound. Suitable methods is selectable to a particular application. For example, methods using zinc stearate, phosphorous oxychloride, dimethylformaldehyde, etc. can be used.

Chemical Reaction 1

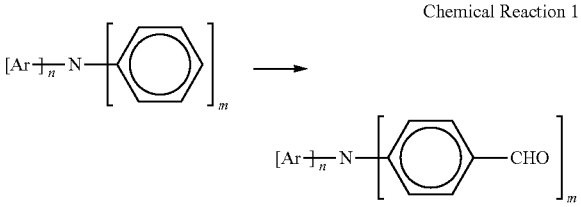

In Chemical Reaction 1, Ar represents an aromatic group, n represent 0 or an integer of from 1 to 2 and m represents an integer of from 3-n.

There is no specific limit to the synthesis method of methylol compound of the charge transport compound of (2). A suitable synthesis method can be selected to a particular application. For example, as represented in the Chemical Reaction 2, such a methylol compound can be synthesized by a known reduction method using an aldehyde compound as an intermediate.

There is no specific limit to reducing method used when synthesizing a methylol compound of the charge transport compound. A suitable method can be selected to a particular application. A reducing method of using sodium tetrahydroborate is preferable.

Chemical Reaction 2

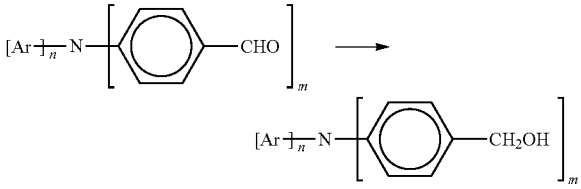

In Chemical Reaction 2, Ar represents an aromatic group, n represent 0 or an integer of from 1 to 2 and m represents an integer of from 3-n.

There is no specific limit to the synthesis method of the charge transport compound having three or more [tetrahydro-2H-pyran-2-yl)oxy]methyl groups linked with aromatic rings of (3) and a suitable synthesis method is selected to a particular application. For example, as illustrated in the following Chemical Reaction 3, a charge transport compound having three or more [tetrahydro-2H-pyran-2-yl)oxy]methyl groups linked with the aromatic rings is synthesized by addition reaction of 3,4-dihydro-2-pyran to a methylol compound serving as an intermediate under the presence of an acid catalyst.

Chemical Reaction 3

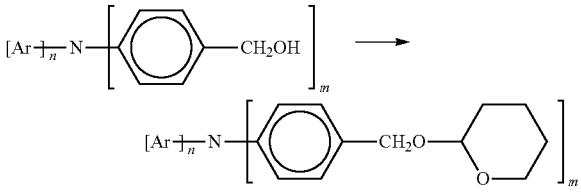

In Chemical Reaction 3, Ar represents an aromatic group, n represent 0 or an integer of from 1 to 2 and m represents an integer of from 3-n.

Second Synthesis Method

One of the specific examples of the second synthesis method is: (1) Synthesizing an intermediate compound having [(tetrahydro-2H-pyran-2-yl)oxy]methyl groups; and (2)

conducting coupling reaction of this intermediate compound and an amine compound to synthesize a charge transport compound.

For example, as illustrated in the following Chemical Reaction 4, the intermediate compound having [(tetrahydro-2H-pyran-2-yl)oxy]methyl groups in (1) can be synthesized by using a material compound having a halogen and a methylol group in an aromatic ring to conduct reaction of the methylol group and 3,4-dihydro-2H-pyran under the presence of an acid catalyst to obtain the intermediate compound having a halogen and [(tetrahydro-2H-pyran-2-yl)oxy]methyl groups.

Chemical Reaction 4

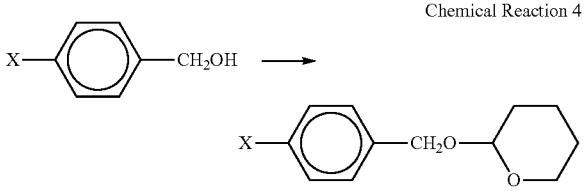

In Chemical Reaction 4, X represents a halogen.

As illustrated in Chemical Reaction 5, the charge transport compound having [(tetrahydro-2H-pyran-2-yl)oxy]methyl groups in (2) can be synthesized by, for example, conducting coupling reaction of the intermediate compound having [(tetrahydro-2H-pyran-2-yl)oxy]methyl groups and an amide compound to obtain the charge transport compound. It is possible to introduce a number of [(tetrahydro-2H-pyran-2-yl)oxy]methyl groups at once depending on the number of the amines and the number of H's attached to the amines. In addition, when the halogen compound is an iodine element, coupling can be made by Ullmann reaction and when the halogen compound is a bromine element or chlorine element, coupling can be made by Suzuki-Miyaura coupling using a palladium catalyst, etc.

Chemical Reaction 5

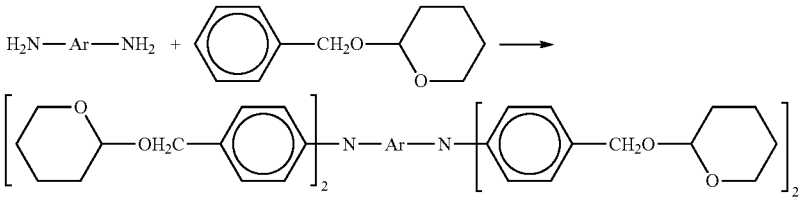

In Chemical Reaction 5, X represents a halogen and Ar represents an aromatic group, Polymerization Method Next, the polymerization reaction is described.

The charge transport compound (compound B) having three or more [tetrahydro-2H-pyran-2-yl)oxy]methyl groups linked with the aromatic rings forms a gigantic molecule having a three dimensional network structure by polymerization reaction between the charge transport compounds in which part of [tetrahydro-2H-pyran-2-yl)oxy]methyl groups is severed and detached by adding an acid to a curing catalyst followed by heating. Some of [tetrahydro-2H-pyran-2-yl)oxy]methyl groups remain unreacted as they are. Although the mechanism of the reaction in which part of [tetrahydro-2H-pyran-2-yl)oxy]methyl groups is severed and detached is not clear, the reaction is not a single reaction but is a linking reaction in which multiple reactions competitively proceed among the compounds as described below.

Reaction Pattern

The reaction patterns are described below.

The charge transport compound having three or more [(tetrahydro-2H-pyran-2-yl)oxy]methyl groups liked with aromatic rings forms a gigantic molecule as a result of three-dimensional network polymerization by combinations of the reaction pattern 1 and the reaction pattern 2 described below taking complex bonding patterns.

In these reaction patterns, part of (tetrahydro-2H-pyran-2-yl)oxy groups is severed and detached with a mass decrease. Such a mass decrease can be monitored by heating the composition together with an acid catalyst by a thermal analysis instrument (TG-DTA=Thermo Gravimetry-Differential Thermal Analyzer).

In addition, by analyzing the gas component produced during the heating reaction by a gas chromatograph mass spectrometer (GC-MS), detached products such as 3,4-dihydro-2H-pyran and 5-hydroxypentanal that indicate that part of (tetrahydro-2H-pyran-2-yl)oxy group is severed are detected.

Reaction Pattern 1

In the Reaction Pattern 1 represented below, the portion of tetrahydro-2H-pyran-2-yl group of one of the [tetrahydro-2H-pyran-2-yl)oxy]methyl groups is severed and detached and the other portion of (tetrahydro-2H-pyran-2-yl)oxy group of the other [tetrahydro-2H-pyran-2-yl)oxy]methyl group is severed and detached to form a dimethylene ether bonding.

Reaction Pattern 1

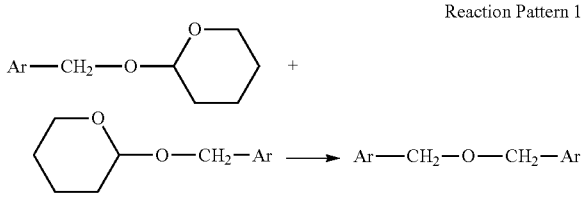

A symbol "Ar" represents an arbitrary aromatic ring of the charge transport compound for use in the present disclosure.

Reaction Pattern 2

In the Reaction Pattern 2, the portion of (tetrahydro-2H-pyran-2-yl)oxy group of one of the [tetrahydro-2H-pyran-2-yl)oxy]methyl groups is severed, detached, and linked with the other aromatic ring to form a methylene bonding.

Reaction Pattern 2

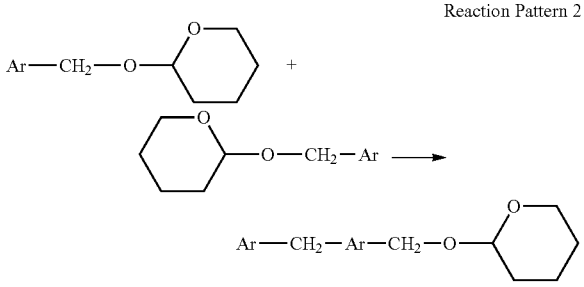

A symbol "Ar" represents an arbitrary aromatic ring of a charge transport compound for use in the present disclosure.

Method of Forming Three-Dimensionally Cross-Linked Polymer or Aromatic Ring Enclosure Structure Element The three-dimensionally cross-linked polymer can be formed at the same time with forming the aromatic ring enclosure structure element.

There is no specific limitation to the forming method of the three-dimensionally cross-linked polymer and a suitable forming method can be selected to a particular application. For example, the three-dimensionally cross-linked polymer can be formed by: applying a liquid application containing a charge transport compound having three or more [tetrahydro-2H-pyran-2-yl)oxy]methyl groups linked with aromatic rings and a curing catalyst while optionally diluting the liquid application with a solvent, etc. to the surface of an image bearing member followed by heating and drying to conduct polymerization.

For example, the three-dimensionally cross-linked polymer can be formed by: applying a liquid application containing a charge transport compound having three or more [tetrahydro-2H-pyran-2-yl)oxy]methyl groups linked with aromatic rings and a curing catalyst while optionally diluting the liquid application with a solvent, etc. to the surface of an image bearing member followed by heating and drying to conduct polymerization. In the polymerization, at the same time when the three-dimensionally cross-linked polymer is formed, the hydrocarbon compound represented by the chemical formula 1 is enclosed in the gap in the network structure of the three-dimensionally cross-linked polymer in some cases to form an aromatic ring enclosure structure element having a certain hardness.

In the step of mixing the charge transport compound having three or more [tetrahydro-2H-pyran-2-yl)oxy]methyl groups linked with aromatic rings and the hydrocarbon compound represented by the Chemical Formula 1, there is no specific limit to the mixing ratio of the hydrocarbon compound hydrocarbon compound by the Chemical Formula 1 and a suitable ratio can be selected to a particular application. The mixing ratio is preferably from 5% by weight to 50% by weight and more preferably from 20% by weight to 50% by weight in light of a combination of abrasion resistance and reduction of the abrasion of a cleaning blade. When the mixing ratio is too small, the abrasion of a cleaning blade tends to be not reduced. When the mixing ratio is too large, the cross-linked portion easily decreases weakening the durability of an aromatic ring enclosure structure element. Consequently, crystallization tends to occur, which invites problems such that the surface of an image bearing member is clouded.

The heating temperature when forming the three-dimensionally cross-linked polymer or the aromatic ring enclosure structure element is arbitrarily determined to a particular condition because the reaction speed changes depending on the kind and the content of a catalyst. The heating temperature is preferably from 80° C. to 160° C., more preferably from 100° C. to 150° C., and furthermore preferably from 135° C. to 150° C. When the heating temperature is too low, the reaction speed tends to be slow accordingly, which arises a problem that a sufficient cross-linking density is not obtained regardless of the reaction time. When the heating temperature is too high, the reaction speed increases but the cross-linking density easily becomes too high, thereby degrading the charge transportability. This leads to problems such as a rise in the voltage at irradiated portions of a photoreceptor, thereby degrading the sensitivity thereof or increasing the impact of heating to the other layers of a photoreceptor, thereby degrading the photoreceptor.

The heating time when forming the three-dimensionally cross-linked polymer or the aromatic ring enclosure structure element is preferably from 20 minutes to 60 minutes when heated and dried at temperatures from 135° C. to 150° C.

Other Components

There is no specific limitation to the selection of the other components. A suitable component can be selected to a particular application. Specific examples thereof include, but are not limited to, a curing catalyst, a solvent, a leveling agent, an antioxidant, a filler, and a surfactant.

Curing Catalyst

There is no specific limit to the curing catalyst and a suitable catalyst is selected to a particular application. For example, an acid compound is preferable.

There is no specific limit to the acid compound and a suitable acid compound is selected to a particular application. Specific examples thereof include, but are not limited to, organic sulfuric acids such as paratoluene sulfuric acid, naphthalene sulfuric acid, dodecyl benzene sulfuric acid, vinyl sulfuric acid; derivatives of organic sulfuric acid; salts of organic sulfuric acid; and heat potential compounds (which demonstrate acidity when heated to a particular temperature or higher).

In particular, organic sulfuric acids and derivatives of organic sulfuric acids are preferable.

There is no specific limit to the curing catalyst and a suitably synthesized curing catalyst is usable to a particular application. Also, marketed products are usable. Specific examples of such marketed products include, but are not limited to, heat latent protonic acid catalysts (which are blocked by an amine) such as NACURE 2500, NACURE 5225, NACURE 5543, and NACURE 5925, manufactured by King Industries Inc.), SI-60 (manufactured by SANSHIN Co., Ltd.), and Adekaoptomer SP-300 (manufactured by Adeka Corporation).

There is no specific limit to the content of a curing catalyst and a suitable content is determined to a particular application. The content is preferably from 0.02% by weight to 5% by weight to the concentration of the solid portion concentration of a liquid application.

The simple content of an acid such as paratoluene sulfuric acid is preferably from 0.02% by weight to 0.4% by weight to the concentration of the solid portion concentration of a liquid application. When the content is too high, the acidity of a liquid application tends to become high, thereby corroding application devices.

The content of the heat potential compound is preferably from 0.2% by weight to 2% by weight to the concentration of the solid portion of a liquid application. Such heat latent compounds do not give rise to a corrosion problem at the step of application of liquid. Therefore, it is possible to increase the content thereof. However, when the content is too large, an amine compound serving as the blocking agent tends to remain in a liquid application, which may have an adverse impact on the photoreceptor characteristics such as the residual voltage.

Solvent

There is no specific limit to the solvent mentioned above and a suitable solvent is selected to a particular application. Specific examples of such solvents include, but are not limited to, alcohols such as methanol, ethanol, propanol and butanol; ketones such as acetone, methyl ethyl ketone, methyl isobutyl ketone, and cyclo hexanone; esters such as ethyl acetate and butyl acetate; ethers such as tetrahydrofuran and methyl tetrahydrofuran, dioxane, propylether, diethylene glycol dimethylether, and propylene glycol 1-monomethylether-2-acetate; halogen based solvent such as dichloromethane, dichloroethane, trichloroethane, and chlorobenzene; aromatic series based solvents such as benzene, toluene, and xylene; and cellosolve-based solvents such as methyl cellosolve, ethyl cellosolve, and cellosolve acetate. These can be used alone or in combination.

There is no specific limit to the dilution ratio of the solvent mentioned above. A suitable ratio can be determined to the solubility of a composition, the method of liquid application such as a dip coating method, a spray coating method, a bead coating method, and a ring coating method, and/or a target thickness.

Leveling Agent

There is no specific limitation to the leveling agent mentioned above. Specific examples thereof include, but are not limited to, silicone oils such as dimethylsilicone oil and methylphenyl silicone oil and polymers and oligomers having a perfluoroalkyl group in the side chain.

In addition, there is no specific limitation to the content of the leveling agent. The content thereof is preferably 1% by weight or less based on the total amount of the solid portion in the liquid application.

Anti-Oxidant

Anti-oxidants can be added to prevent degradation of the sensitivity and a rise of the residual voltage of an image bearing member (photoreceptor).

Such anti-oxidants can be added to the cross-linked charge transport layer, the charge transport layer, the charge generating layer, and the other optional layers.

There is no specific limitation to the anti-oxidants. Specific examples thereof include, but are not limited to, phenol-based compounds, paraphenylene diamines, hydroquinones, organic sulfur compounds, and organic phosphorus compounds. These can be used alone or in combination.

There is no specific limit to the phenol-based compounds and a suitable phenol-based compound is selected to a particular application. Specific examples of the phenol-based compounds include, but are not limited to, 2,6-di-t-butyl-p-cresol, butylated hydroxyanisol, 2,6-di-t-butyl-4-ethylphenol, stearyl-β-(3,5-di-t-butyl-4-hydroxyphenyl)propionate, 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), 1,1,3-tris-(2-methyl-4-hydroxy-5-t-butylphenyl) butane, 1,3,5-trimethyl-2,4,6-tris(3,5-di-t-butyl-4-hydroxybenzyl)benzene, tetrakis-[methylene-3-(3',5'-di-t-butyl-4'-hydroxyphenyl)propionate]methane, bis[3,3'-bis(4'-hydroxy-3'-t-butylphenyl)butyric acid]glycol ester, and tocopherols.

There is no specific limit to the paraphenylene diamines and a suitable paraphenylene diamine is selected to a particular application. Specific examples of paraphenylene diamines include, but are not limited to, N-phenyl-N'-isopropyl-p-phenylene diamine, N,N'-di-sec-butyl-p-phenylene diamine, N-phenyl-N-sec-butyl-p-phenylene diamine, N,N'-di-isopropyl-p-phenylene diamine, and N,N'-dimethyl-N,N-di-t-butyl-p-phenylene diamine.

Specific examples of hydroquinones include, but are not limited to, 2,5-di-t-octyl hydroquinone, 2,6-didodecyl hydroquinone, 2-dodecyl hydroquinone, 2-dodecyl-5-chloro hydroquinone, 2-t-octyl-5-methyl hydroquinone, and 2-(2-octadecenyl)-5-methyl hydroquinone.

There is no specific limit to the hydroquinones and a suitable hydroquinone is selected to a particular application. Specific examples thereof include, but are not limited to, 2,5-di-t-octyl hydroquinone, 2,6-didodecyl hydroquinone, 2-dodecyl hydroquinone, 2-dodecyl-5-chloro hydroquinone, 2-t-octyl-5-methyl hydroquinone, and 2-(2-octadecenyl)-5-methyl hydroquinone.

There is no specific limit to the organic phosphorous compounds and a suitable organic phosphorous compound is selected to a particular application. Specific examples thereof include, but are not limited to, triphenyl phosphine, tri(nonylphenyl)phosphine, tri(dinonylphenyl)phosphine, tricresyl phosphine, and tri(2,4-dibutylphenoxy)phosphine.

There is no specific limit to the anti-oxidant and a suitably synthesized anti-oxidant is usable to a particular application. Also, marketed products known as anti-oxidants such as rubber, plastic, and oils are usable.

There is no specific limitation to the addition amount of the anti-oxidants. The content thereof is preferably from 0.01% to 10% by weight and more preferably 1% by weigh for less based on the total amount of the solid portion in the liquid application.

Filler

Fillers can be added to the liquid application mentioned above to further improve the abrasion resistance of an image bearing member (photoreceptor). Furthermore, fillers can be added to the liquid application to further improve the abrasion resistance of the photoreceptor.

There is no specific limit to the selection of such filler materials and a suitable filler material can be selected to a particular application. Specific examples thereof include, but are not limited to, organic filler materials and inorganic filler materials.

There is no specific limit to the selection of such organic fillers materials and a suitable organic filler can be selected to a particular application. Specific examples thereof include, but are not limited to, powder of a fluorine resin such as polytetra fluoroethylene, silicone resin powder, and a-carbon powder.

There is no specific limit to the selection of such inorganic fillers materials and a suitable inorganic filler can be selected to a particular application. Specific examples of the inorganic fillers include, but are not limited to, powders of metals such as copper, tin, aluminum, and indium; metal oxides such as silica, tin oxide, zinc oxide, titanium oxide, alumina, zirconium oxide, indium oxide, antimony oxide, bismuth oxide, calcium oxide, tin oxide doped with antimony, and indium oxide doped with tin; fluorinated metals such as fluorinated tin, fluorinated calcium, and fluorinated aluminum; potassium titanate; and arsenic nitride.

In addition, inorganic materials are preferable because of its good abrasion resistance. In particular, a type alumina having a hexagonal close-packed structure in light of insulation property, thermal stability, and abrasion resistance.

There is no specific limitation to the average primary particle diameter of the filler. The filler preferably has an average primary particle diameter of from 0.1 μm to 1.0 μm and more preferably from 0.01 μm to 5 μm in terms of optical transmittance and abrasion resistance. Filler particulates that have an excessively small average primary particle diameter tend to degrade abrasion resistance and dispersion property. Filler particulates that have an excessively large average primary particle diameter tend to accelerate sedimentation of the filler in the liquid dispersion, which leads to filming of toner.

There is no specific limit to the content of the filler in a liquid application and a suitable content is determined to a particular application. For example, the content is preferably from 5% by weight to 50% by weight and more preferably from 10% by weight to 40% by weight. When the content is too small, abrasion resistance tends to be insufficient. When the content is too large, transparency tends to be worsened.

Surfactant

The surfactant mentioned above is added in order to conduct surface-treatment of the filler mentioned above.

The dispersability of the filler is improved by the surface-treatment of the filler by the surfactant. When the filler is poorly dispersed, the following problems may occur, which are: (1) the residual potential of an resultant image bearing member increases; (2) the transparency of the resultant coated layer decreases; (3) coated layer deficiency occurs; and, (4) abrasion resistance deteriorates. These possibly develop into greater problems with regard to the durability of the resultant image bearing member and the quality of the images produced thereby.

There is no specific limit to the surfactant and a suitable surfactant can be selected to a particular application, Specific examples thereof include, but are not limited to, titanate based coupling agents, aluminum based coupling agents, zircoaluminate based coupling agents, higher aliphatic acids and mixtures of these and silane coupling agents. Also, for example, $Al_2O_3$, $TiO_2$, $ZrO_2$, silicon, aluminum stearate, and mixtures thereof are suitable. These are preferable in terms of dispersability of the filler and prevention of image blurring. Treatment on the filler particulates by a silane coupling agent has an adverse impact with regard to production of blurred images. However, a combinational use of the surfactant specified above and a silane coupling agent subdue this adverse impact in some cases.

There is no specific limit to the content of the surfactant mentioned above. The content of the surfactant changes depending on the average primary particle diameter of a filler to be used. A suitable content is selected to a particular application. The content is preferably from 3% by weight to 30% by weight and more preferably from 5% by weight to 20% by weight. When the content is too small, the dispersion effect of the filler mentioned above is not easily obtained. When the content is too large, the residual voltage tends to significantly increase.

Forming Method of Cross-Linked Charge Transport Layer (Uppermost Surface Layer)

There is no specific limit to the method of forming the cross-linked charge transport layer (uppermost surface layer) and a suitable method can be selected to a particular application. For example, a cross-linked charge transport layer can be formed by applying a liquid application that contains a charge transport compound having three or more [tetrahydro-2H-pyran-2-yl)oxy]methyl groups linked with aromatic rings, a curing catalyst, a hydrocarbon compound represented by the Chemical Formula 1, and other components such as the solvent mentioned above according to a casting method.

There is no specific limitation to the casting method and a suitable casting method can be selected to a particular application. Specific examples thereof include, but are not limited to, a dip coating method, a spray coating method, a bead coat method, and a ring coating method.

The three-dimensionally cross-linked layer of the present disclosure, which is formed by polymerization reaction of the charge transport compound having three or more [tetrahydro-2H-pyran-2-yl)oxy]methyl groups linked with aromatic rings and in which the hydrocarbon compound represented by the Chemical Formula 1 is molecule-dispersed, has a relatively good charge transportability among cross-linked layers and a wide range of applicability as the charge transport layer. However, the charge transportability is inferior to a conventional molecule dispersion type charge transport layer. Therefore, it is preferable that the layer is thin. A photoreceptor having such a structure demonstrates the most excellent properties.

There is no specific limitation to the thickness of the cross-linked charge transport layer and a suitable thickness is determined to a particular application. The charge transport layer preferably has an average thickness of from 1 μm to 10 μm and more preferably from 3 μm to 8 μm. When the thickness is 1 μm or greater, the length of working life of a resultant photoreceptor is sufficiently prolonged. When the thickness is 10 μm or less, images are stably output without degradation of the sensitivity, a rise of the voltage at an irradiated portion, etc.

Charge Transport Layer

The charge transport layer holds charges and the held charges are combined with held charges moved from the charge generating layer which are generated and separated in the charge generating layer upon irradiation on the charge transport layer. In addition, in order to hold the charges, the electric resistance of the charge transport layer is required to be high. Furthermore, in order to obtain a high surface voltage by the held charges, a small dielectric constant and good charge mobility are required for the charge transport layer.

The charge transport layer contains a charge transport material, preferably a binder resin, and other optional materials.

Charge Transport Material

There is no specific limit to the charge transport material and a suitable charge transport material is selected to a particular application. Specific examples thereof include, but are not limited to, electron transport materials, a hole carrier transport material, and a charge transport polymer.

Charge Transport Material

There is no specific limit to such electron transport material (electron accepting materials) and a suitable electron transport material can be selected to a particular application. Specific examples thereof include, but are not limited to, chloranil, bromanil, tetracyano ethylene, tetracyanoquino dimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophene-4-one, and 1,3,7-trinitro dibenzo thiophene-5,5-dioxide. These can be used alone or in combination.

Hole Carrier Transport Material

There is no specific limit to the hole carrier transport materials (electron donating materials) and a suitable hole carrier transport material is selected to a particular application. Specific examples thereof include, but are not limited to, oxazole derivatives, oxadiazole derivatives, imidazole derivatives, triphenyl amine derivatives, 9-(p-diethylaminostyryl anthracene), 1,1-bis-(4-dibenzyl aminophenyl)propane, styrylanthracene, styrylpyrazoline, phenylhydrazones, α-phenylstilbene derivatives, thiazole derivatives, triazole derivatives, phenazine derivatives, acridine derivatives, benzfuran derivatives, benzimidazole derivatives and thiophen derivatives. These can be used alone or in combination.

Charge Transport Polymer

There is no specific limit to the charge transport polymer and a suitable charge transport polymer is selected to a particular application. Specific examples thereof include, but are not limited to, a polymer having a carbazole ring, a polymer having a hydrazone structure, a polysilylene polymer, a polymer having a triaryl amine structure, a polymer having an electron donating group, and other polymers.

There is no specific limit to the polymer having a carbazole ring and a suitable polymer having a carbazole ring is selected to a particular application. Specific examples thereof include, but are not limited to, poly-N-vinylcarbazole and the compounds disclosed in JP-S50-82056-A, JP-S54-9632-A, JP-S54-11737-A, JP-H04-175337-A, JP-H04-183719-A, and JP-H06-234841-A.

There is no specific limit to the polymers having a hydrozone structure and a suitable polymer having a carbazole ring is selected to a particular application. Specific examples thereof include, but are not limited to, the polymers having carbazole rings disclosed in JP-S57-78402-A, JP-S61-20953-A, JP-S61-296358-A, JP-H01-134456-A, JP-H01-179164-A, JP-H03-180851-A, JP-H03-180852-A, JP-H03-50555-A, JP-H05-310904-A, and JP-H06-234840-A.

There is no specific limit to the polysilylene polymer and a suitable polysilylene polymer is selected to a particular application. Specific examples thereof include, but are not limited to, the polysilylene polymers disclosed in JP S63-285552-A, JP-H01-88461-A, JP-H04-264130-A, JP-H04-264131-A, JP-H04-264132-A, JP-H04-264133-A, and JP-H04-289867-A.

There is no specific limit to the polymers having a triaryl amine structure and a suitable polymer having a triaryl amine structure is selected to a particular application. Specific examples thereof include, but are not limited to, N,N,bis(4-methylphenyl)-4-aminopolystyrene, the compounds disclosed in JP-H01-134457-A, JP-H02-282264-A, JP-H02-304456-A, JP-H04-133065-A, JP-H04-133066-A, JP-H05-40350-A, and JP-H05-202135-A.

There is no specific limit to the polymer having an electron donating group and a suitable polymer having an electron donating group is selected to a particular application. For example, copolymers, block polymers, graft polymers, and star polymers with known monomers, and cross-linked polymers having electron donating groups disclosed in JP-H03-109406-A can be used.

Specific examples of the other polymers include, but are not limited to, a condensation polymerized formaldehyde compound of nitropropylene, and the compounds disclosed in JP-S51-73888-A, JP-S56-150749-A, JP-H06-234836-A, and JP-H06-234837-A.

Other specific examples of the charge transport polymers include, but are not limited to polycarbonate resins having triaryl amine structures, polyurethane resins having triaryl amine structures, polyester resins having triaryl amine structures, and polyether resins having triaryl amine structures. Specific examples of such other charge transport polymers include, but are not limited to, compounds disclosed in JP-S64-1728-A, JP-S64-13061-A, JP-S64-19049-A, JP-H04-11627-A, JP-H04-225014-A, JP-H04-230767-A, JP-H04-320420-A, JP-H05-232727-A, JP-H07-56374-A, JP-H09-127713-A, JP-H09-222740-A, JP-H09-265197-A, JP-H09-211877-A, and JP-H09-304956-A.

Binder Resin

Specific examples of the binder resin include, but are not limited to, polycarbonate resins, polyester resins, methacryl resins, acrylic resins, polyethylene resins, polyvinyl chloride resins, polyvinyl acetate resins, polystyrene resins, phenol resins, epoxy resins, polyurethane resins, polyvinylidene chloride resins, alkyd resins, silicone resins, polyvinyl carbazole resins, polyvinyl butyral resins, polyvinyl formal resins, polyacrylate resins, polyacryl amide resins, and phenoxy resins. These can be used alone or in combination.

The charge transport layer can also contain a copolymer of a cross-linkable binder resin and a cross-linkable charge transport material.

Other Components

There is no specific limitation to the selection of the other components mentioned above and such other components can be selected to a particular application. Specific examples thereof include, but are not limited to, a solvent, a plasticizer, a leveling agent, and the anti-oxidant specified above.

Solvent

There is no specific limit to the solvent and a suitable solvent can be selected to a particular application. The same solvent specified for the charge generating layer can be used as the solvent for use in application of the charge transport layer. Among these, it is suitable to use a solvent that dissolves the charge transport material and the binder resin. These can be used alone or in combination.

Plasticizer

There is no specific limitation to the selection of the plasticizer and a suitable plasticizer can be selected to a particular application. Specific examples thereof include, but are not limited to, plasticizers for conventional resins such as dibutyl phthalate and dioctyl phthalate.

There is no specific limit to the content of the plasticizer and it is suitably determined to a particular application. It is preferably from 0 parts by weight to 30 parts by weight to 100 parts by weight of the binder resin mentioned above.

Leveling Agent

There is no specific limitation to the leveling agent and a suitable leveling agent can be selected to a particular application. Specific examples thereof include, but are not limited to, silicone oil such as dimethylsilicone oil and methylphenyl silicone oil; and polymers and oligomers having a perfluoroalkyl group in the side chain.

There is no specific limit to the content of the leveling agent and it is suitably determined to a particular application. It is preferably from 0 parts by weight to 1 part by weight to 100 parts by weight of the binder resin mentioned above.

Method of Forming Charge Transport Layer

There is no specific limitation to the forming method of the charge transport layer. Typically, a liquid application obtained by dissolving or dispersing the charge transport material and the binder resin mentioned above in the other component such as the solvent is applied to the charge generating layer described above followed by drying. The liquid application is applicable by the casting method described above.

There is no specific limitation to the thickness of the charge transport layer. The charge transport layer preferably has an average thickness of from 5 μm to 40 μm and more preferably from 10 μm to 30 μm.

Charge Generating Layer

The charge generating layer contains a charge generating material, preferably a binder resin, and other optional materials such as the anti-oxidant mentioned above.

Charge Generating Material

There is no specific limitation to the selection of the charge generating material. For examples, inorganic materials and organic materials can be suitably used.

Inorganic Material

There is no specific limit to the inorganic material and a suitable inorganic material can be selected to a particular application. Specific examples thereof include, but are not limited to, crystal selenium, amorphous-selenium, selenium-tellurium-halogen, selenium-arsenic compounds, and amorphous-silicon (Preferably, for example, those in which a dangling-bond is terminated with a hydrogen atom or a halogen atom, and those in which boron atoms or phosphorous atoms are doped are preferably used).

Organic Material

There is no specific limit to the selection of the organic materials and a suitable organic material can be selected to a particular application. Specific examples thereof include, but are not limited to, phthalocyanine pigments, for example, metal phthalocyanine and metal-free phthalocyanine; azulenium salt pigments; squaric acid methine pigments; azo pigments having a carbazole skeleton; azo pigments having a triphenylamine skeleton; azo pigments having a diphenylamine skeleton; azo pigments having a dibenzothiophene skeleton; azo pigments having a fluorenone skeleton; azo pigments having an oxadiazole skeleton; azo pigments having a bis-stilbene skeleton; azo pigments having a distilyloxadiazole skeleton; azo pigments having a distylylcarbazole skeleton; perylene pigments, anthraquinone or polycyclic quinone pigments; quinoneimine pigments; diphenylmethane and triphenylmethane pigments; benzoquinone and naphthoquinone pigments; cyanine and azomethine pigments, indigoid pigments, and bis-benzimidazole pigments. These can be used alone or in combination.

Binder Resin

There is no specific limit to the selection of the binder resin. Specific examples of the binder resin include, but are not limited to, polyamide resins, polyurethane resins, epoxy resins, polyketone resins, polycarbonate resins, silicone resins, acrylic resins, polyvinylbutyral resins, polyvinylformal resins, polyvinylketone resins, polystyrene resins, poly-N-vinylcarbazole resins, and polyacrylamide resins. These can be used alone or in combination.

In addition to the binder resins specified above, the binder resin optionally contains polymerizable charge transport material (charge transport polymer), for example, (1): a polycarbonate resin, a polyester resin, a polyurethane resin, a polyether resin, a polysiloxane resin, or an acrylic resin having an arylamine skeleton, a benzidine skeleton, a hydrazone skeleton, a carbazole skeleton, a stilbene skeleton or a pyrazoline skeleton; and (2): a polymerizable material having a polysilane skeleton.

Specific examples of the charge transport polymers of (1) include, but are not limited to, compounds described in JP-H01-001728-A, JP-H01-009964-A, JP-H01-013061-A, JP-H01-019049-A, JP-H01-241559-A, JP-H04-011627-A, JP-H04-175337-A, JP-H04-183719-A, JP-H04-225014-A, JP-H04-230767-A, JP-H04-320420-A, JP-H05-232727-A, JP-H05-310904-A, JP-H06-234836-A, JP-H06-234837-A, JP-H06-234838-A, JP-H06-234839-A, JP-H06-234840-A, JP-H06-234840-A, JP-H06-234841-A, JP-H06-239049-A, JP-H06-236050-A, JP-H06-236051-A, JP-H06-295077-A, JP-H07-056374-A, JP-H08-176293-A, JP-H08-208820-A, JP-H08-211640-A, JP-H08-253568-A, JP-H08-269183-A, JP-H09-062019-A, JP-H09-043883-A, JP-H09-71642-A, JP-H09-87376-A, JP-H09-104746-A, JP-H09-110974-A, JP-H09-110974-A, JP-H09-110976-A, JP-H09-157378-A, JP-H09-221544-A, JP-H09-227669-A, JP-H09-221544-A, JP-H09-227669-A, JP-H09-235367-A, JP-H09-241369-A, JP-H09-268226-A, JP-H09-272735-A, JP-H09-272735-A, JP-H09-302084-A, JP-H09-302085-A, and JP-H09-328539-A.

Specific examples of the charge transport polymers of (2) include, but are not limited to, polysilylene polymers described in JP-S63-285552-A, JP-H05-19497-A, JP-H05-70595-A, and JP-H10-73944-A.

Other Components

There is no specific limitation to the selection of the other components. A suitable component can be selected to a particular application. Specific examples thereof include, but are not limited to, a low molecular weight charge transport material, a solvent, a leveling agent, and the anti-oxidants specified above.

Low Molecular Weight Charge Transport Material

There is no specific limit to the low molecular weight charge transport material and a suitable low molecular weight charge transport material is selected to a particular application. Specific examples thereof include, but are not limited to, electron transport materials and a hole carrier transport material.

There is no specific limitation to the selection of the low molecular weight charge transport material. A suitable low molecular weight charge transport material can be selected to a particular application. Specific examples thereof include, but are not limited to, chloranil, bromanil, tetracyano ethylene, tetracyanoquino dimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophene-4-one, 1,3,7-trinitrodibenzothhiophene-5,5-dioxide, and diphenoquinone derivatives. These can be used alone or in combination.

There is no specific limit to the hole carrier transport material and a suitable hole carrier transport material is selected to a particular application. Specific examples of the hole carrier transport materials include, but are not limited to, oxazole derivatives, oxadiazole derivatives, imidazole derivatives, monoaryl amine derivatives, diaryl amine derivatives, triaryl amine derivatives, stilbene derivatives, α-phenyl stilbene derivatives, benzidine derivatives, diaryl methane derivatives, triaryl methane derivatives, 9-styryl anthracene derivatives, pyrazoline derivatives, divinyl benzene derivatives, hydrazone derivatives, indene derivatives, butadiene derivatives, pyrene derivatives, bisstilbene derivatives, and enamine derivatives. These can be used alone or in combination.

Solvent

There is no specific limit to the solvent and a suitable solvent is selected to a particular application. Specific examples of the solvent for use in the liquid application for the charge transport layer include, but are not limited to, tetrahydrofuran, dioxane, dioxolan, toluene, dichloromethane, monochlorobenzene, dichloroethane, cyclohexanone, cyclopentanone, anisole, xylene, methylethylketone, acetone, ethyl acetate, and butyl acetate. These can be used alone or in combination.

Leveling Agent

There is no specific limitation to the leveling agent mentioned above and a suitable leveling agent is selected to a particular application. Specific examples thereof include, but are not limited to, silicone oils such as dimethylsilicone oil and methylphenyl silicone oil. These can be used alone or in combination.

Method of Forming Charge Generating Layer

There is no specific limitation to the forming method of the charge generating layer and a suitable forming method is selected to a particular application. Typically, a liquid application obtained by dissolving or dispersing the charge generating material mentioned above and the binder resin mentioned above in the other component mentioned above such as the solvent is applied to the electroconductive substrate described above followed by drying. The liquid application is applicable by the casting method mentioned above.

There is no specific limitation to the thickness of the charge generating layer. The charge generating layer preferably has a thickness of from 0.01 μm to 5 μm and more preferably from 0.05 μm to 2 μm.

Other Layers

There is no specific limitation to the other layer and a suitable other layer is selected to a particular application. Specific examples thereof include, but are not limited to, an undercoating layer and an intermediate layer.

Undercoating Layer

Such an undercoating layer can be provided between the electroconductive substrate and the photosensitive layer.

The undercoating layer contains a resin and an optional component such as the anti-oxidant mentioned above, a fine powder pigment, and a coupling agent.

There is no specific limitation to the resins contained in the undercoating layer and a suitable resin contained in the undercoating layer is selected to a particular application.

Specific examples thereof include, but are not limited to, hydrosoluble resins, such as polyvinyl alcohol, casein, and sodium polyacrylate, alcohol soluble resins such as copolymerized nylon and methoxymethylated nylon, and curing resins which form three dimension network structures, such as polyurethane resins, melamine resins, phenolic resins, alkyd-melamine resins, and epoxy resins.

Considering that a photosensitive layer is formed thereon in a form of solvent, the resin is preferably not or little soluble in conventional known organic solvents.

There is no specific limitation to the fine powder pigment contained in the undercoating layer and any fine powder pigment that can prevent moire and reduce a residual voltage is selected to a particular application. Specific examples thereof include, but are not limited to, metal oxides such as titanium oxides, silica, alumina, zirconium oxides, tin oxides, and indium oxides.

There is no specific limit to the coupling agent in the undercoating layer and a suitable resin contained in the undercoating layer is selected to a particular application. Specific examples thereof include, but are not limited to, a silane coupling agent, a titanium coupling agent, and a chromium coupling agent.

There is no specific limit to the undercoating layer and a suitable undercoating layer can be selected to a particular application. For example, a single layered undercoating layer or a laminate undercoating layer can be used.

There is no specific limitation to the forming method of the undercoating layer and a suitable forming method is selected to a particular application. For example, an undercoating layer can be formed by anodizing $Al_2O_3$ or a vacuum thin-film forming method using an organic compound such as polyparaxylylene (parylene) or an inorganic compound such as $SiO_2$, $SnO_2$, $TiO_2$, ITO, and $CeO_2$.

There is no specific limitation to the thickness of the undercoating layer. It is preferably from 1 μm to 5 μm.

Intermediate Layer

The intermediate layer mentioned above can be provided between the charge transport layer and the cross-linked charge transport layer to reduce mingling of the charge transport layer component to the cross-linked charge transport layer and improve the attachability between both layers.

An intermediate layer which is insoluble or little soluble in the liquid application of the cross-linked charge transport layer is suitable. Also, the intermediate layer contains a binder resin and other components such as the anti-oxidant mentioned above.

There is no specific limitation to the resins contained in the intermediate layer and a suitable resins contained in the intermediate layer is selected to a particular application. Specific examples thereof include, but are not limited to, polyamide, alcohol soluble nylon, water soluble polyvinyl butyral, polyvinyl butyral, and polyvinyl alcohol.

There is no specific limitation to the forming method of the intermediate layer and a suitable forming method is selected to a particular application. For example, like the photosensitive layer described above, the intermediate layer is formed by using a suitable solvent and a suitable application method.

There is no specific limitation to the thickness of the intermediate layer and a suitable thickness is determined to a particular application. It is preferably from 0.05 μm to 2 μm.

Embodiments of the photoreceptor of the present disclosure are described in detail below with reference to the corresponding drawings.

First Embodiment

The layer structure of the photoreceptor according to the first embodiment of the present disclosure is described in detail with reference to the FIG. 1.

FIG. 1 is a most basic structure of a laminate photoreceptor in which a charge generating layer 2 and a charge transport layer 3 are laminated sequentially on an electroconductive substrate 1. When the photoreceptor is negatively charged, hole carrier transport charge transport materials are used in the charge transport layer. When the photoreceptor is positively charged, electron transport charge transport materials are used in the charge transport layer. The uppermost surface layer is the charge transport layer 3 in this structure.

Accordingly, the aromatic ring enclosure structure element in which the hydrocarbon compound represented by the chemical formula 1 is molecule-dispersed in the network structure of the three-dimensionally cross-linked polymer mentioned above is contained in the charge transport layer 3.

Second Embodiment

The layer structure of the photoreceptor according to the second embodiment of the present disclosure is described in detail with reference to FIG. 2.

Figure 2:
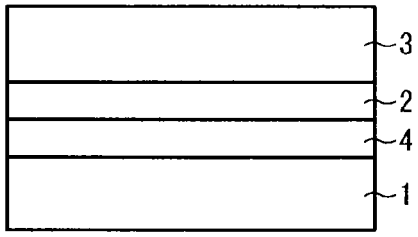
FIG. 2 is a cross section illustrating the layer structure of the image bearing member according to the second embodiment of present invention.

FIG. 2 is the most practically-used structure in which an undercoating layer 4 is added to the basic structure of the most basic laminate photoreceptor. The uppermost surface layer is the charge transport layer 3 in this structure.

Accordingly, the aromatic ring enclosure structure element in which the hydrocarbon compound represented by the chemical formula 1 is molecule-dispersed in the network structure of the three-dimensionally cross-linked polymer mentioned above is contained in the charge transport layer 3.

Third Embodiment

The layer structure of the photoreceptor according to the third embodiment of the present disclosure is described in detail with reference to FIG. 3.

Figure 3:
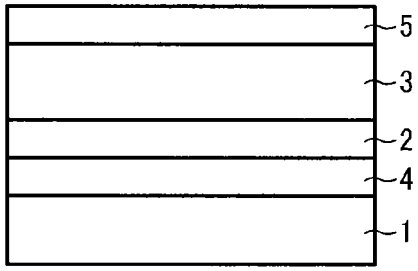
FIG. 3 is a cross section illustrating the layer structure of the image bearing member according to the third embodiment of present invention.

FIG. 3 is a diagram illustrating the structure in which a cross-linked charge transport layer 5 is provided at the uppermost surface as a protective layer.

Accordingly, the aromatic ring enclosure structure element in which the hydrocarbon compound represented by the chemical formula 1 is molecule-dispersed in the network structure of the three-dimensionally cross-linked polymer mentioned above is contained in the cross-linked charge transport layer 5. Although the undercoating layer is not indispensable, it has a feature of preventing the leaking of charges so that the undercoating layer is used in most cases. In this structure of the photoreceptor, the two layers of the charge transport layer 3 and the cross-linked charge transport layer 5 share the feature of moving the charges from the charge generating layer to the surface of the photoreceptor so that the main feature can be separated. For example, it is possible to provide a photoreceptor having both excellent charge transport property and mechanical durability by a combination of the charge transport layer having an excellent charge transport property and the cross-linked charge transport layer having an excellent mechanical durability.

Fourth Embodiment

The layer structure of the photoreceptor according to the fourth embodiment of the present disclosure is described in detail with reference to FIG. 4.

Figure 4:
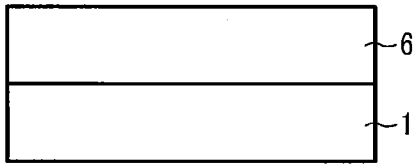
FIG. 4 is a cross section illustrating the layer structure of the image bearing member according to the fourth embodiment of present invention.

FIG. 4 is a diagram illustrating the structure in which a photosensitive layer 6 mainly made of a charge generating material and a charge transport material is provided on the electroconductive substrate 1.

Accordingly, the aromatic ring enclosure structure element in which the hydrocarbon compound represented by the chemical formula 1 is molecule-dispersed in the network structure of the three-dimensionally cross-linked polymer mentioned above is contained in the photosensitive layer 6. In this structure, it is suitable that the cross-linked layer contains the charge generating material. Therefore, a liquid dispersion in which the charge generating material is mixed and dispersed in the liquid application described above is prepared and applied to the electroconductive substrate 1 followed by heating and drying to form a layer that contains the three dimension cross-linked resin by the condensation reaction.

Fifth Embodiment

The layer structure of the photoreceptor according to the fifth embodiment of the present disclosure is described in detail with reference to the FIG. 5.

Figure 5:
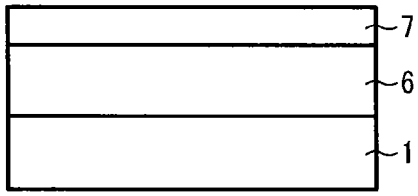
FIG. 5 is a cross section illustrating the layer structure of the image bearing member according to the fifth embodiment of present invention.

FIG. 5 is a diagram illustrating a structure in which a protective layer 7 is formed on the photosensitive layer 6 having a single layer structure.

Accordingly, the aromatic ring enclosure structure element in which the hydrocarbon compound represented by the chemical formula 1 is molecule-dispersed in the network structure of the three-dimensionally cross-linked polymer mentioned above is contained in the protective layer 7.

Image Forming Method and Image Forming Apparatus

The image forming method of the present disclosure includes a development process, an irradiation process, a development process, a transfer process, and optional processes. The image bearing member of the present disclosure is used in the image forming method described above. A combination of the charging process and the irradiation process are also referred to as a latent electrostatic image formation process.

The image forming apparatus of the present disclosure includes an image bearing member (photoreceptor), a charging device (charger), an irradiation device (irradiator), a development device, and other optional devices. The image bearing member of the present disclosure is used in the image forming apparatus described above. A combination of the charger and the irradiator is also referred to as a latent electrostatic image forming device.

Charging Process and Charging Device

The charging process is executed by the charging device and charges the surface of the image bearing member.

There is no specific limit to the charger and a suitable charger can be selected to a particular application. For example, a known contact type charger having an electroconductive or semi-electroconductive roll, brush, film, rubber blade, etc. and a non-contact type charger including a proximity charger having a gap of 100 μm or less between the surface of a photoreceptor and a charger such as a corotron or a scorotron which uses corona discharging can be used.

Irradiation Process and Irradiation Device

The irradiation process is executed by the irradiator and irradiates the surface of the charged image bearing member to form a latent electrostatic image thereon.

There is no specific limit to the irradiator. Any irradiator that can irradiate the surface of the image bearing member charged by the charger according to the image information can be suitably selected to a particular application. Specific examples of such irradiators include, but are not limited to, a photocopying optical system, a rod lens array system, a laser optical system, and a liquid crystal shutter optical system. Such an irradiator uses a light source that can secure high brightness such as a light-emitting diode (LED), a semiconductor laser (LD), and electro luminescence (EL). As to the present disclosure, the rear side irradiation system in which an image bearing member is irradiated from the rear side can be also employed.

Images can be written on the image bearing member in digital form or analogue form.

In a digital data writing system, a latent electrostatic image (negative image) is formed on an image bearing member by a writing light source such as laser beams based on digital image data, toner is attached to the exposed portion by reversal development, and thereafter the toner is transferred to and fixed on a recording medium such as paper.

In an analogue data writing system, light reflected from an original is guided to an image bearing member to form a latent electrostatic image (positive image), toner is attached to non-exposed portions by regular development, and thereafter the toner is transferred to and fixed on a recording medium such as paper. The reversal development is preferable in terms of quality of images, etc.

Development Process and Development Device

The development process is executed by the development device and forms a visible image by developing the latent electrostatic image with toner.

There is no specific limitation to the development device and a suitable development device can be selected to a particular application. There is no specific limit to the development device as long as it develops a latent electrostatic image with the toner or a development agent and any known development device can be selected to a particular application. For example, a development device having a development container which accommodates and applies the toner or the development agent to the latent electrostatic image in a contact or non-contact manner is suitably used. The development device may employ a dry-type development system or a wet-type development system and a single color development system or a multi-color development system. For example, it is suitable to use a development device including a stirrer to triboelectrically charge the development agent and a rotatable magnet roller. In the development device, the toner and a carrier are mixed and stirred to triboelectrically charge the toner due to friction therebetween. The toner is then held on the surface of the rotatable magnet roller to form a magnet brush like a filament. Since the magnet roller is provided in the vicinity of the image bearing member, part of the toner forming the magnet brush borne on the surface of the magnet roller is transferred to the surface of the image bearing member by the electric attraction force. As a result, the latent electrostatic image is developed with the toner to form a visible toner image on the surface of the image bearing member.

Transfer Process and Transfer Device

The transfer process is executed by the transfer device and transfers the visible image to a recording medium.

The transfer device transfers the visible image to a recording medium directly or via an intermediate transfer medium to which the visible image is primarily transferred followed by secondary transfer to the recording medium. Both systems are suitably used. However, if the quality of an image is adversely affected significantly by transfer, the former (direct transfer) is preferable because it has a less number of transfer. The transfer process can be conducted by, for example, charging the image bearing member (photoreceptor) with a transfer charging device by the transfer device.

Fixing Process and Fixing Device

The fixing process is executed by the fixing device and fixes the transferred image on the recording medium.

There is no specific limit to the fixing device and a suitable fixing device can be selected to a particular application. It is preferable to use a known heating and pressing device. Such a known heating and pressing device includes, for example, a combination of a heating roller and a pressing roller or a combination of a heating roller, a pressing roller, and an endless belt. The heating temperature is preferably from 80° C. to 200° C. Fixing can be conducted every time each color toner image is transferred or at once for a multi-color laminated image.

Other Process and Other Device

There is no specific limitation to the other process and other device and these are suitably selected to a particular application. Specific examples thereof include, but are not limited to, a discharging process and a discharging device, a cleaning process and a cleaning device, a recycling process and a recycling device, and a control process and control device.

Discharging Process and Discharging Device

The discharging process is executed by the discharging device and discharges the image bearing member by applying a discharging bias thereto.

There is no specific limit to the discharging device and a suitable discharging device that can apply a discharging bias to the image bearing member is selected to a particular application. For example, a discharging lamp is preferable.

Cleaning Process and Cleaning Device

The cleaning process is executed by the cleaning device and removes residual toner remaining on the image bearing member.

There is no specific limit to the selection of the cleaning device and a suitable known cleaner that can remove residual toner on the image bearing member is selected to a particular application. Preferred specific examples of such cleaners include, but are not limited to, a magnetic brush cleaner, an electrostatic brush cleaner, a magnetic roller cleaner, a blade cleaner, a brush cleaner, and a web cleaner.

Recycling Process and Recycling Device

The recycling process is executed by the recycling device and returns the residual toner removed in the cleaning process to the development device.

There is no specific limit to the recycling device and any known conveying device, etc., can be used.

Control Process and Control Device

The control process is executed by the control device and controls each of the processes described above.

There is no specific limit to the control device and any control device that is able to control the behavior of each device and a suitable control device can be selected to a particular application. For example, devices such as a sequencer and a computer can be used.

Embodiments of the image forming apparatus of the present disclosure are described next.

Figure 6:
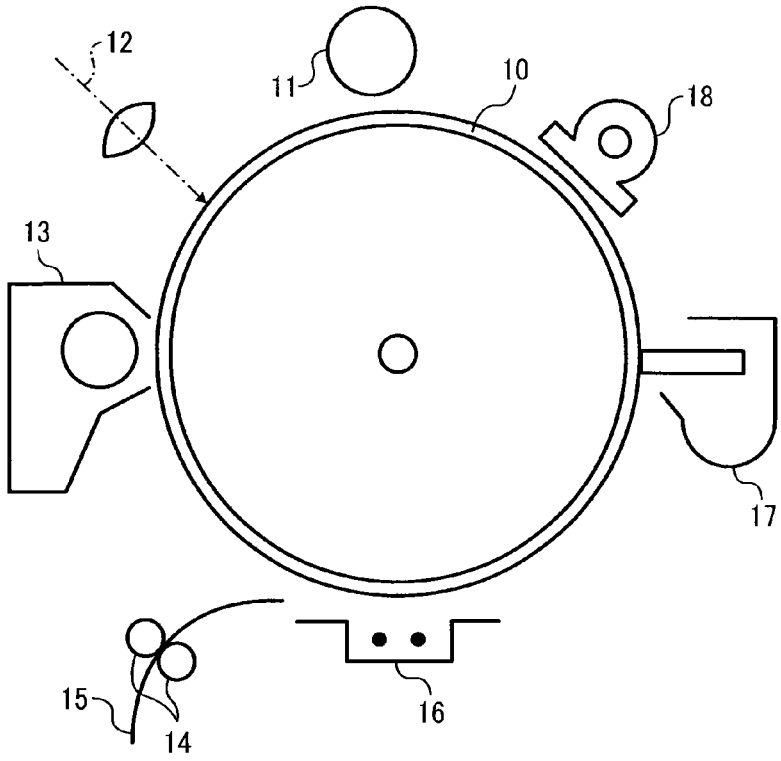
FIG. 6 is a schematic diagram illustrating an example of the image forming apparatus and the electrophotographic processes according to an embodiment of the present invention.

FIG. 6 is a schematic diagram illustrating the electrophotographic process and the image forming apparatus of the present disclosure and the following examples are also within the scope of the present disclosure.

As illustrated in FIG. 6, a photoreceptor 10 rotates in the direction indicated by an arrow in FIG. 6. Around the photoreceptor 10, there are provided a charger 11, an image irradiator 12, a development device 13, a transfer device 16, a cleaner 17, and a discharger 18. The cleaner 17 and the discharger 18 are optional.

As illustrated in FIG. 6, the image forming apparatus basically operates as follows: The charger 11 significantly uniformly charges the surface of the photoreceptor (image bearing member) 10. Next, the image irradiator 12 optically writes an image on the surface of the photoreceptor 10 according to input signals to form a latent electrostatic image thereon. Next, the development member 13 develops the latent electrostatic image to form a toner image on the surface of the photoreceptor 10. The transfer device 16 transfers the formed toner image to a transfer sheet (recording medium) 15 which has been transferred to the transfer position by a transfer roller 14. The toner image is fixed on the transfer sheet by a fixing device. Some of the toner that has not been transferred to the transfer sheet 15 is removed by the cleaner 17. The discharger 18 discharges the charges remaining on the photoreceptor 10 so that the system is ready for the next image forming cycle.

Although the photoreceptor 10 has a drum form in FIG. 6, it may also employ a sheet or endless belt form. As the charger 11 and the transfer device 16, in addition to a corotron, a scorotron, and a solid state charger, any known device can be used which has a roller form charging member or a brush form charging member.

Typical illumination devices, for example, a fluorescent lamp, a tungsten lamp, a halogen lamp, a mercury lamp, a sodium lamp, a light emitting diode (LED), a semiconductor laser (LD), and electroluminescence (EL) can be used as the light source of the irradiator 12 and the discharger 18. Among these, light emitting diodes (LED) and semiconductor lasers (LD) are commonly used. Variety of optical filters, for example, a sharp cut filter, a band-pass filter, a near infrared filter, a dichroic filter, a coherent filter and a color conversion filter, can be used to irradiate an image bearing member with light having entirely a particular wavelength.

The light source, etc. irradiates the photoreceptor 10 by providing processes such as the transfer process, the discharging process, the cleaning process, or a pre-irradiation process in combination with irradiation of light. However, irradiation of the photoreceptor 10 in the discharging process significantly fatigues the photoreceptor 10, which easily leads to reduction of charging amount and an increase in the residual voltage. Therefore, it is suitable in some cases to discharge the photoreceptor 10 by another method such as applying a reversed bias in the charging process or the cleaning process instead of discharging by irradiation in terms of improving the durability of the photoreceptor.

When the photoreceptor 10 is positively (or negatively) charged and irradiated according to image data, a positive (or negative) latent electrostatic image is formed on the photoreceptor 10. When the latent electrostatic image is developed with a negatively (or positively) charged toner (volt-detecting fine particles), a positive image is formed. When the latent electrostatic image is developed using a positively (or negatively) charged toner, a negative image is formed. Any known method can be applied to such a development device and also a discharging device.

Among the contamination materials attached to the surface of the photoreceptor 10, corona products produced by charging and external additives contained in the toner are easily affected by moisture condition, which causes production of defective images. In addition, paper dust is one of such materials causing production of defective images. Furthermore, paper dust attached to the photoreceptor 10 tends to degrade the durability of the photoreceptor 10 and cause non-uniform abrasion. Therefore, a structure in which the photoreceptor 10 does not directly contact paper is preferable in terms of improvement of the quality of images.

Toner that is used to develop the latent image on the photoreceptor 10 by the development unit 13 is transferred to the transfer sheet 15. However, not all of the toner is transferred and consequently some of it remains on the photoreceptor 10. Such residual toner is removed from the photoreceptor 10 by the cleaner 17. This cleaner 17 is a known cleaner such as a cleaning blade or a cleaning brush. Both can be used in combination.

The photoreceptor of the present disclosure is applicable to a photoreceptor having a small diameter because the photoreceptor has an excellent photosensitivity and an excellent stability. Therefore, an image forming apparatus or a system in which the photoreceptor described above is preferably used has multiple photoreceptors corresponding to development units arranged for multiple color toners to conduct processing in parallel, which is an image forming apparatus employing so-called "a tandem system. The image forming apparatus employing the tandem system includes at least four color toners of yellow (Y), magenta (M), cyan (C), and black (K) required for full color printing, development units that accommodate the toners, and at least respective four photoreceptors. Therefore, this image forming apparatus enables full color printing at an extremely high speed in comparison with a typical image forming apparatus for full color printing.

Figure 7:
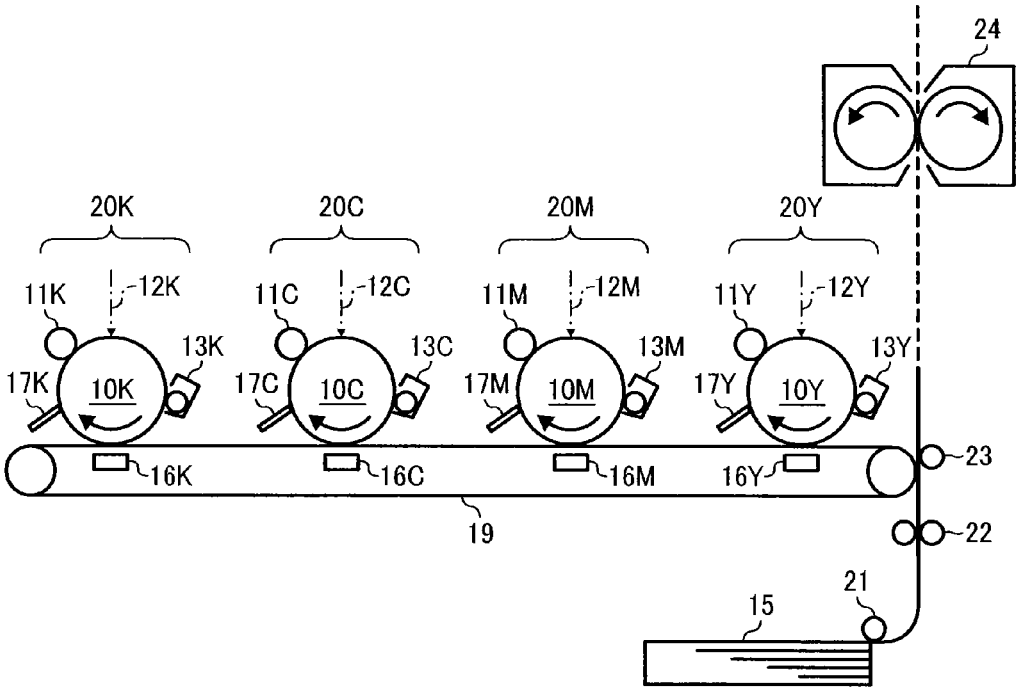
FIG. 7 is a schematic diagram illustrating an example of a tandem type full color image forming apparatus according to an embodiment of the present invention.

FIG. 7 is a schematic diagram illustrating an example of the full color image forming apparatus employing the tandem system and the following variations are within the scope of the present disclosure.

In FIG. 7, the photoreceptors 10C, 10M, 10Y, and 10K have a drum form and rotate in the direction indicated by arrows. There are arranged at least chargers 11C, 11M, 11Y, and 11K, development devices 13C, 13M, 13Y, and 13K, and cleaners 17C, 17M, 17Y, and 17K in this order around the photoreceptors 10C, 10M, 10Y, and 10K relative to the rotation direction of the photoreceptors. An irradiator emits laser beams 12C, 12M, 12Y, and 12K to irradiate the photoreceptors 10C, 10M, 10Y, and 10K from outside the gap provided between the charger 11C, 11M, 11Y, and 11K and the development devices 13C, 13M, 13Y, and 13K to form latent electrostatic images on the photoreceptors 10C, 10M, 10Y, and 10K.

In FIG. 7, four image formation units 20C, 20M, 20Y, and 20K including the photoreceptors 10C, 10M, 10Y, and 10K are arranged along a transfer belt 19 serving as a transfer medium conveyor device. The transfer belt 19 is in contact with the photoreceptors 10C, 10M, 10Y, and 10K between the development devices 13C, 13M, 13Y, and 13K and the corresponding cleaners 17C, 17M, 17Y, and 17K of each image formation unit 20C, 20M, 20Y, and 20K. Transfer brushes 16C, 16M, 16Y, and 16K that apply a transfer bias are provided on the side of the transfer belt 19 which is situated in contact with the photoreceptors 10C, 10M, 10Y, and 10K with the transfer belt 19 therebetween. Each of the image formation unit 20C, 20M, 20Y, and 20K is of the same structure except that toners contained in the development devices 13C, 13M, 13Y, and 13K have different colors from each other.

The color image forming apparatus having the structure illustrated as in FIG. 7 produces images as follows. In the image formation units 20C, 20M, 20Y, and 20K, the photoreceptors 10C, 10M, 10Y, and 10K are charged by the chargers 11C, 11M, 11Y, and 11K that are driven to rotate in the direction indicated by arrows (the same direction as the rotation direction of the photoreceptors 10C, 10M, 10Y, and 10K) and irradiated with the laser beams 12C, 12M, 12Y, and 12K emitted from the irradiator situated outside the photoreceptors 10C, 10M, 10Y, and 10K to produce latent electrostatic images corresponding to an image of each color.

Then, the latent electrostatic images are developed by the development devices 13C, 13M, 13Y, and 13K to form toner images. The development devices 13C, 13M, 13Y, and 13K develop the latent electrostatic images with toner of C (cyan), M (magenta), Y (yellow), and K (black), respectively. Respective toner images formed on the four photoreceptors 10C, 10M, 10Y, and 10K are superimposed on the transfer belt 19.

The transfer sheet 15 is sent out from a tray by a feeding roller 21, temporarily held at a pair of registration rollers 22, and thereafter fed to a transfer member 23 in synchronization with image formation on the photoreceptors 10C, 10M, 10Y, and 10K. The toner images on the transfer belt 19 are transferred to the transfer medium 15 by an electric field formed by a potential difference between the transfer bias applied to the transfer member 23 and the voltage at the transfer belt 19. The toner image transferred onto the transfer sheet is conveyed to a fixing member 24 to fix the toner image on the transfer sheet 15 and discharged to a discharging portion. In addition, toner which has not been transferred to the photoreceptors 10C, 10M, 10Y, and 10K and remains thereon are collected by the cleaners 17C, 17M, 17Y, and 17K.

In addition, the intermediate transfer system as illustrated in FIG. 7 is particularly suitable for an image forming apparatus that can produce full color images. That is, in such a system, multiple toner images are temporarily transferred to and superimposed on the intermediate transfer body, which is advantageous in terms of controlling prevention of color misalignment and improvement of the quality of image.

The intermediate transfer body is made of various kinds of materials and can have various kinds of forms such as a drum and a belt. Any known intermediate transfer body can be employed in the present disclosure, which is preferable in terms of improvement of the durability of the image bearing member and the quality of image.

In FIG. 7, the image formation elements are arranged in the sequence of Y (yellow), M (magenta), C (cyan), and K (black) from the upstream to the downstream relative to the transfer direction of the transfer sheet, but the sequence is not limited thereto. The sequence of the color is arbitrarily determined. In addition, to output an image of only black, providing a mechanism that suspends the image formation units 20C, 20M, and 20Y) other than the black color is particularly suitable for the present disclosure.

Since the image forming apparatus employing a tandem system is able to transfer multiple toner images once, a high speed full color printing is possible. However, such a system requires at least four photoreceptors. Therefore, the size of the apparatus inevitably increases. In addition, depending on the amount of toner, abrasion among the photoreceptors varies, thereby causing problems such as degrading the reproducibility of color or producing defective images. On the other hand, since the image bearing member of the present disclosure has an excellent photosensitivity and stability, the diameter thereof can be reduced. In addition, a rise in the residual voltage is reduced and the impact caused by deterioration of the photosensitivity is limited with regard to the image bearing member of the present disclosure. Therefore, the difference among the photoreceptors with regard to the residual voltage and the photosensitivity over repetitive use is so small that full color images can be produced with excellent color reproducibility for an extended period of time.

Although the image formation device as described above can be assembled into a photocopier, a facsimile machine, or a printer in a fixed manner, each image forming element may form a process cartridge, which is mounted onto such an apparatus.

Process Cartridge

The process cartridge of the present disclosure includes the image bearing member (photoreceptor) of the present disclosure and at least one device selected from other optional devices such as a charging device, an irradiation device, a development device, a transfer device, a cleaning device, and a discharging device and detachably attachable to an image forming apparatus. For this reason, the image stability is good during repetitive image forming operations and quality images can be produced for an extended period of time. Also the process cartridge has a long working life. In particular, blade abrasion caused by friction between the image bearing member and the cleaning blade is subdued in a process cartridge having a cleaning blade as the cleaning device. As a result, a process cartridge having a long working life is provided corresponding to the abrasion resistance of the image bearing member.

Figure 8:
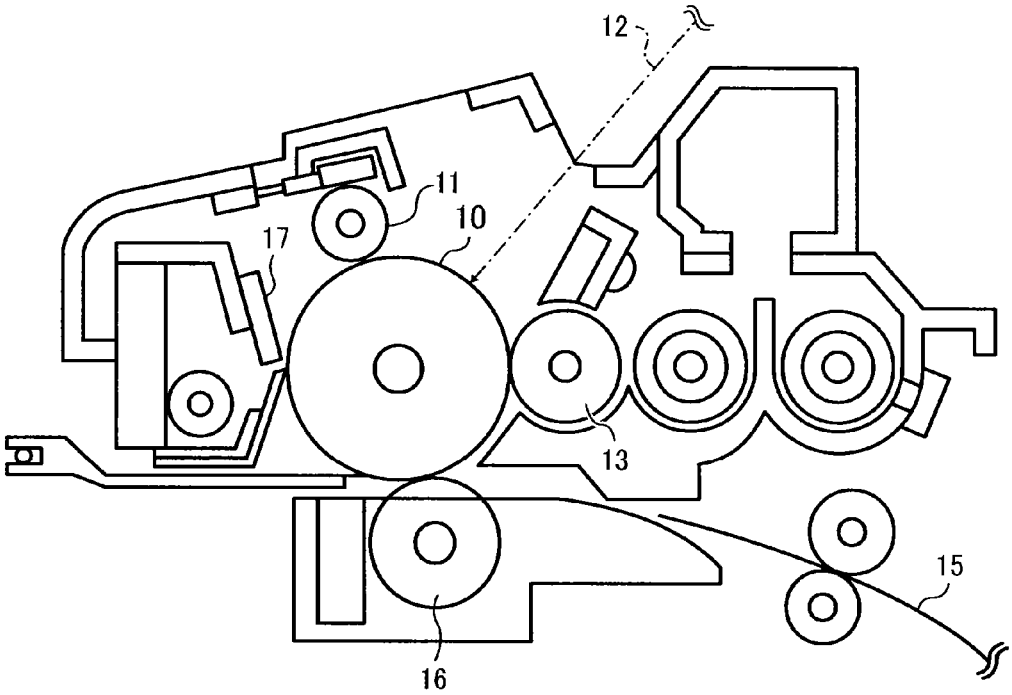
FIG. 8 is a schematic diagram illustrating an example of a process cartridge according to an embodiment of the present invention.

The process cartridge illustrated in FIG. 8 is a part (device) that includes the photoreceptor 10 and other members such as the charger 11, the irradiator 12, the development device 13, the transfer device 16, the cleaner 17, and the discharger.

Having generally described preferred embodiments of this invention, further understanding can be obtained by reference to certain specific examples, which are provided herein for the purpose of illustration only and are not intended to be limiting. In the descriptions in the following examples, the numbers in parts represent weight ratios in parts unless otherwise specified.

EXAMPLES

Next, the present disclosure is described in detail with reference to Examples and Comparative Examples but not limited thereto.

In Examples and Comparative Examples, p-Tol$SO_3$ represents paratoluene sulfuric acid, t-$Bu_3$P represents tritertial butyl phosphine, t-BuONa represents sodium tertial buthoxide, $Pd(OAc)_2$ represents palladium acetate, and $Pd[(t\text{-}Bu)_3P]_2$ represents bis(tri-t-buthoxyphosphine)palladium.

Synthesis Example 1

Synthesis of Intermediate of Three-Dimensionally Cross-Linked Polymer Material Synthesis of 4-[tetrahydro-2H-pyran-2-yl)oxy]methyl bromobenzene as an intermediate of the three dimension cross-linked polymer was conducted as follows: 50.43 g of 4-bromobenzyl alcohol, 45.35 g of 3,4-dihydro-2H-pyran, and 150 ml of tetrahydrofuran were placed in a flask. The mixture was stirred at 5° C. and 0.512 g of paratoluene sulfonic acid was put therein to prepare a solution.

Figure 10:
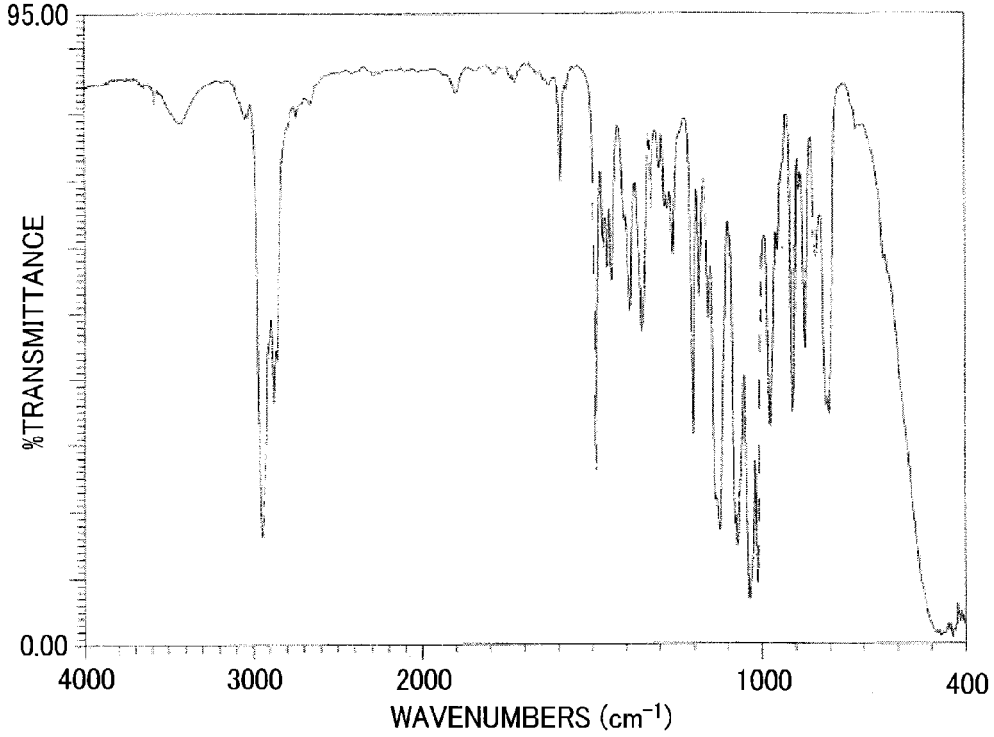
FIG. 10 is a graph illustrating an infrared absorption spectrum (KBr tablet method) of a compound obtained in Synthesis Example 1 with an X axis of wavenumber (cm-1) and a Y axis of transparency (%)

Next, this solution was stirred at room temperature for two hours. Subsequent to extraction by ethyl acetate, the resultant was dehydrated by magnesium sulfate followed by adsorption treatment by activated earth and silica gel. Subsequent to filtration, washing, and condensation, the target product was obtained (yield: 72.50 g, colorless oily material). The reaction formula is as follows: FIG. 10 is a graph illustrating an infrared absorption spectrum (KBr tablet method) of the compound obtained in Synthesis Example 1.

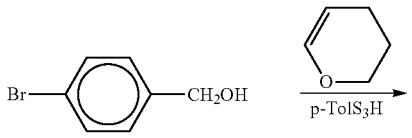

-continued

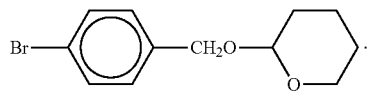

Synthesis Example 2

Synthesis of Intermediate of Three-Dimensionally Cross-Linked Polymer Material

Figure 11:
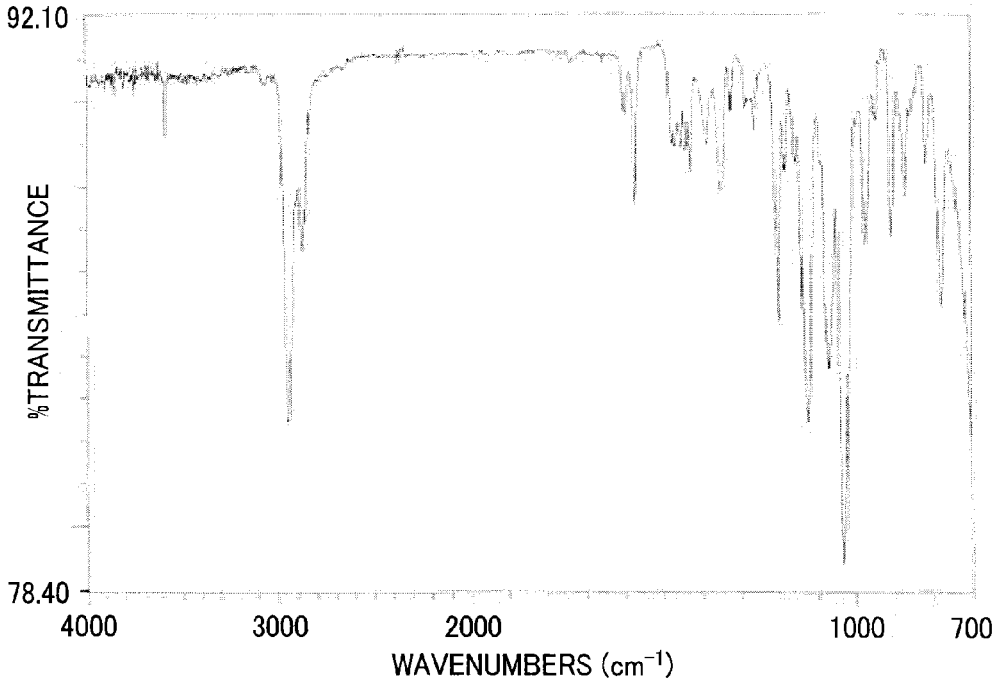
FIG. 11 is a graph illustrating an infrared absorption spectrum (KBr tablet method) of a compound obtained in Synthesis Example 2 with an X axis of wavenumber (cm-1) and a Y axis of transparency (%)

Synthesis of 3-[tetrahydro-2H-pyran-2-yl)oxy]methyl bromobenzene as an intermediate of the three dimension cross-linked polymer was conducted as follows: 25.21 g of 3-bromobenzyl alcohol, 22.50 g of 3,4-dihydro-2H-pyran, and 50 ml of tetrahydrofuran were placed in a flask. The mixture was stirred at 5° C. and 0.259 g of paratoluene sulfonic acid was added thereto to prepare a solution. Next, this solution was stirred at room temperature for one hour. Subsequent to extraction by ethyl acetate, the resultant was dehydrated by magnesium sulfate followed by adsorption treatment by activated earth and silica gel. Subsequent to filtration, washing, and condensation, the target product was obtained (yield: 36.84 g, colorless oily material). The reaction formula is as follows: FIG. 11 is a graph illustrating an infrared absorption spectrum (KBr tablet method) of the compound obtained in Synthesis Example 2.

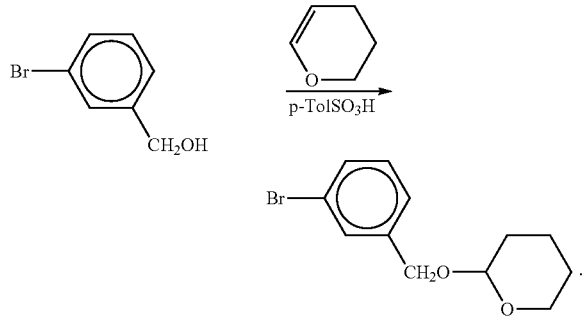

Synthesis Example 3

Synthesis of Intermediate Methylol Compound

Figure 12:
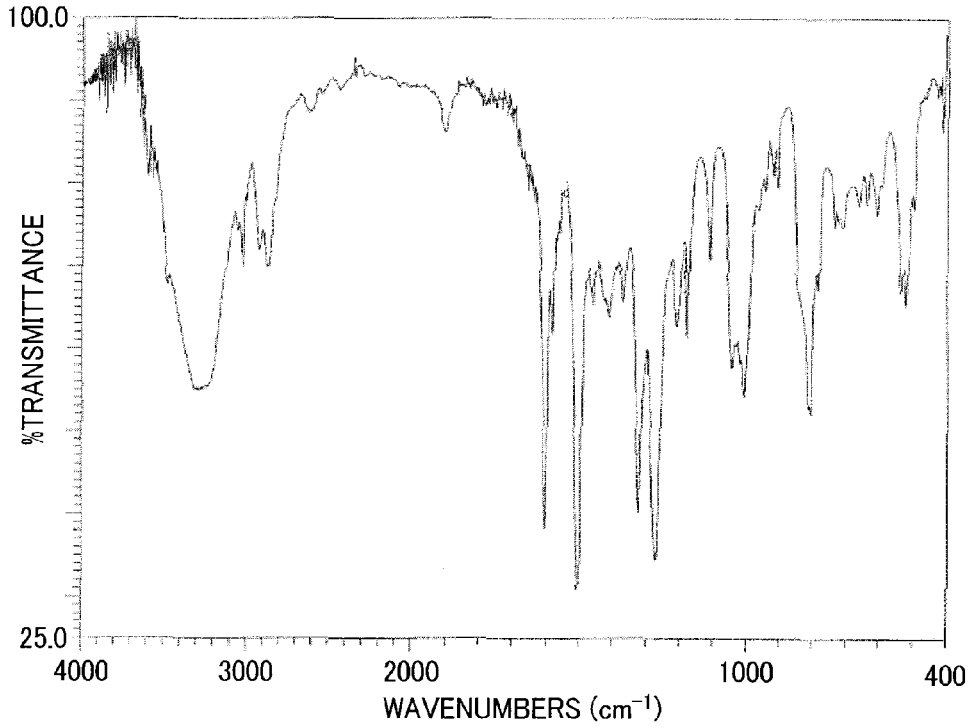
FIG. 12 is a graph illustrating an infrared absorption spectrum (KBr tablet method) of a compound obtained in Synthesis Example 3 with an X axis of wavenumber (cm-1) and a Y axis of transparency (%)

Methylol intermediate of 4,4'-bis[di(4-hydroxymethylphenyl)amino]diphenyl methane was synthesized in the following procedure. 12.30 g of an intermediate aldehyde compound and 150 ml of ethanol were placed in a flask. The mixture was stirred at room temperature and 3.63 g of sodium boron hydride was put therein to prepare a solution. Next, this solution was stirred at room temperature for four hours. Subsequent to extraction by ethyl acetate, the resultant was dehydrated by magnesium sulfate followed by adsorption treatment by activated earth and silica gel. Subsequent to filtration, washing, and condensation, an amorphous material was obtained. The amorphous material was dispersed by n-hexane followed by filtration, washing, and drying to obtain a target product (yield: 12.0 g, pale yellow white amorphous). The reaction formula is as follows: FIG. 12 is a graph illustrating an infrared absorption spectrum (KBr tablet method) of the compound obtained in Synthesis Example 3.

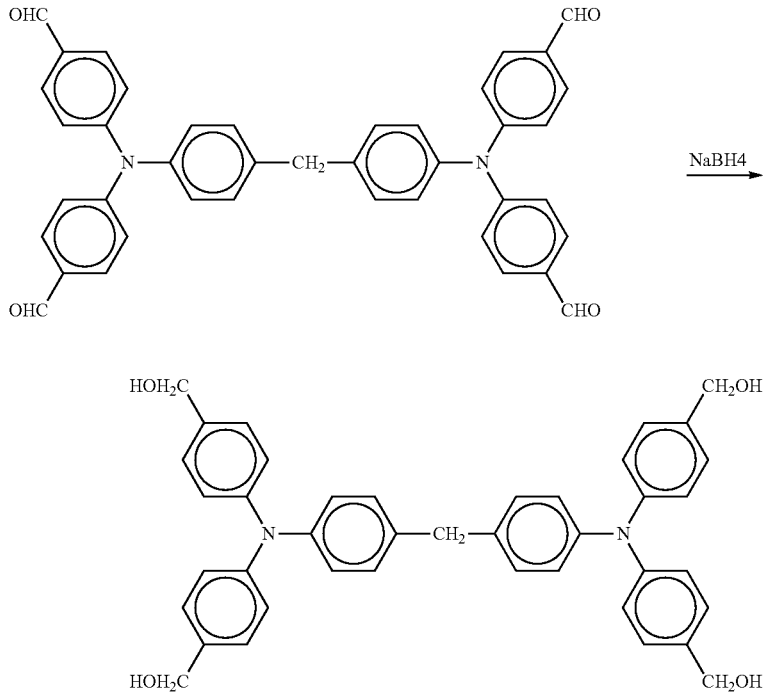

Synthesis Example 4

Synthesis of Three-Dimensionally Cross-Linked Polymer Material

Figure 13:
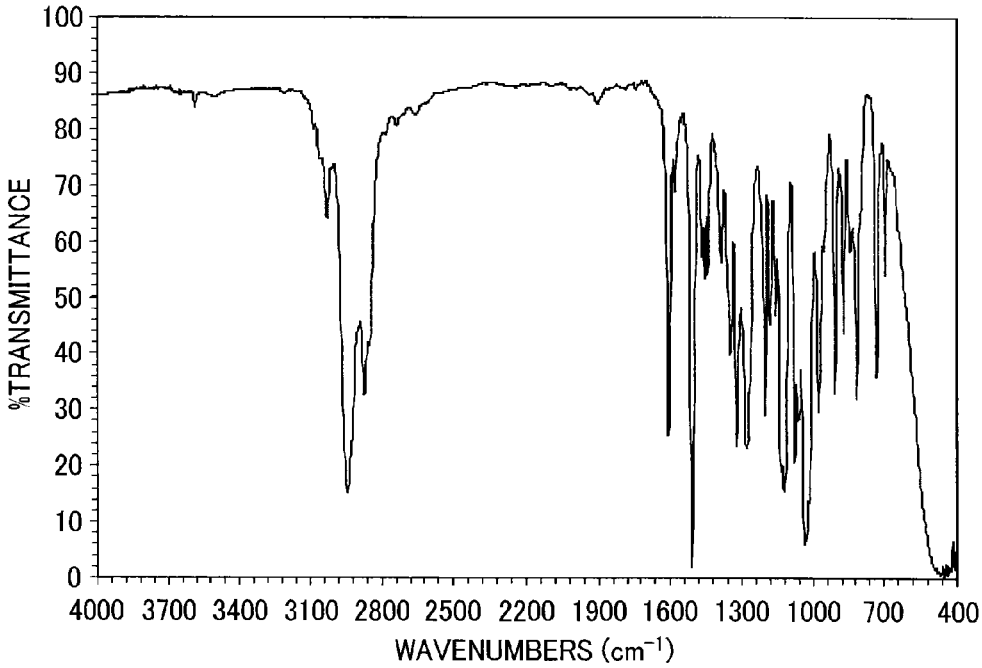
FIG. 13 is a graph illustrating an infrared absorption spectrum (KBr tablet method) of a compound obtained in Synthesis Example 4 with an X axis of wavenumber (cm-1) and a Y axis of transparency (%)

[tetrahydro-2H-pyran-2-yl)oxy]methyl group-containing charge transport compound (represented by Chemical structure 2-4, which was a material of a three-dimensionally cross-linked polymer, was synthesized in the following procedure. 3.4 g of an intermediate methylol compound, 4.65 g of 3,4-dihydro-2H-pyran, and 100 ml of tetrahydrofuran were placed in a flask. The mixture was stirred at 5° C. 58 mg of paratoluene sulfonic acid was put therein to prepare a solution. Next, this solution was stirred at room temperature for five hours. Subsequent to extraction by ethyl acetate, the resultant was dehydrated by magnesium sulfate followed by adsorption treatment by activated earth and silica gel. Subsequent to filtration, washing, and condensation, a yellow oily material was obtained. This yellow oily material was subject to refinement (toluene/ethyl acetate=10/1 in volume ratio) by silica gel column to separate and obtain a target product (yield: 2.7 g, colorless oily material). The reaction formula is as follows: FIG. 13 is a graph illustrating an infrared absorption spectrum (KBr tablet method) of the compound obtained in Synthesis Example 4.

Chemical Structure 2-4

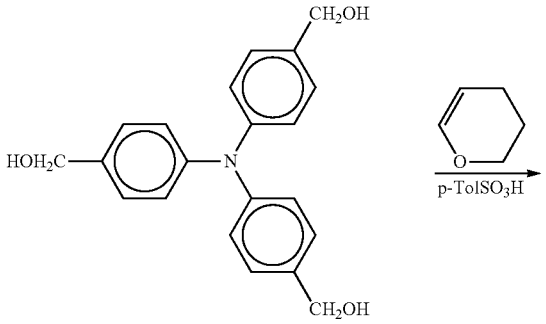

-continued

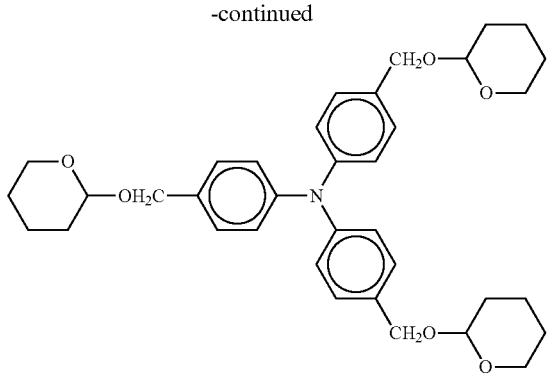

Synthesis Example 5

Synthesis of Three-Dimensionally Cross-Linked Polymer Material

Figure 14:
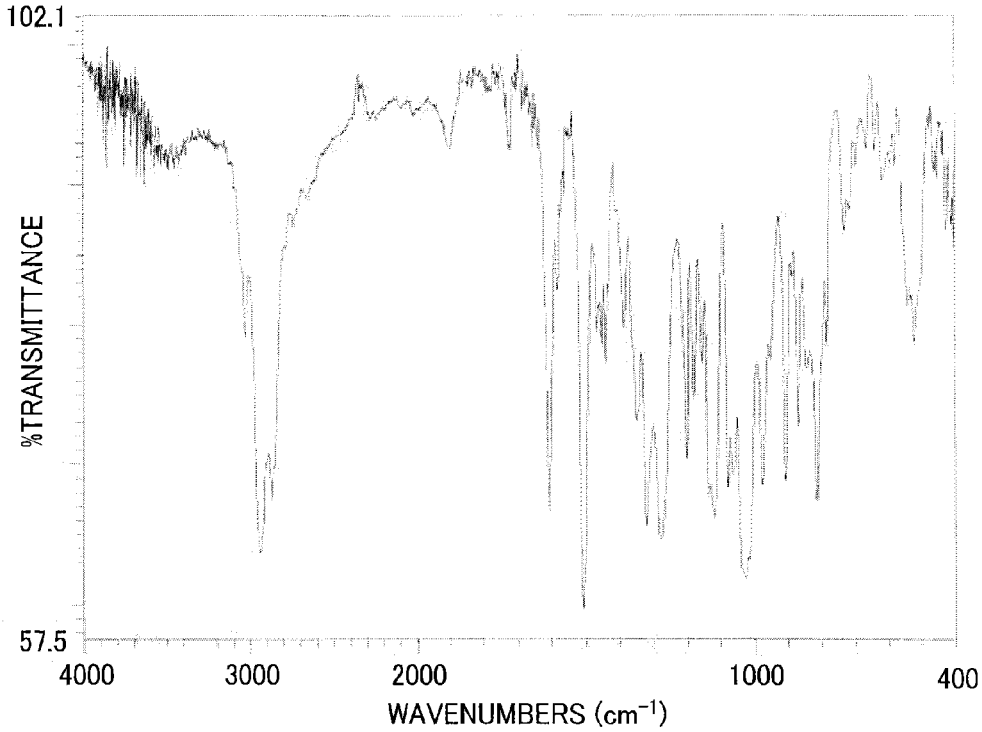
FIG. 14 is a graph illustrating an infrared absorption spectrum (KBr tablet method) of a compound obtained in Synthesis Example 5 with an X axis of wavenumber (cm-1) and a Y axis of transparency (%)

[tetrahydro-2H-pyran-2-yl)oxy]methyl group-containing charge transport compound (represented by Chemical structure 3-1, which was a material of a three-dimensionally cross-linked polymer, was synthesized in the following procedure. 2.99 g of 4,4'-diaminodiphenyl methane, 17.896 g of the compound of Synthesis Example 1, 0.336 g of palladium acetate, 13.83 g of tertial buthoxysodium, and 100 ml of o-xylene were placed in a flask. The mixture was stirred at room temperature in an Ar gas atmosphere while dripping 1.214 g of tritertial butyl phosphine to prepare a solution. Next, this solution was stirred at 80° C. for one hour. Subsequent to one-hour stirring by reflux, the solution was diluted with toluene. The resultant was dehydrated by magnesium sulfate followed by adsorption treatment by activated earth and silica gel. Subsequent to filtration, washing, and condensation, a yellow oily material was obtained. This yellow oily material was subject to refinement (toluene/ethyl acetate=20/1 in volume ratio) by silica gel column to separate and obtain a target product (yield: 5.7 g, pale yellow amorphous material). FIG. 14 is a graph illustrating an infrared absorption spectrum (KBr tablet method) of the compound obtained in Synthesis Example 5. The reaction formula is as follows:

It was also possible to synthesize the thus-obtained compound by conducting reaction between the intermediate methylol compound obtained in Synthesis Example 3 and 3,4-dihydro-2H-pyrane in the same manner as in Synthesis Example 4.

Chemical Structure 3-1

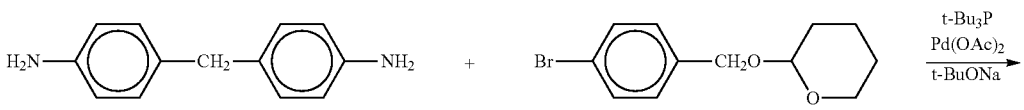

-continued

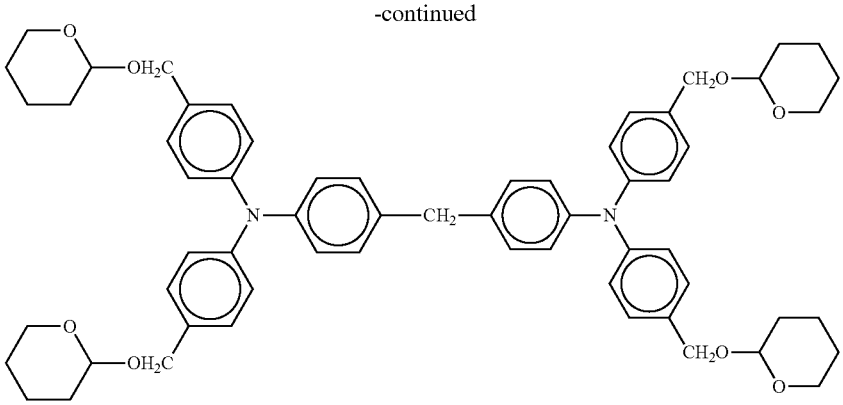

Synthesis Example 6

Synthesis of Three-Dimensionally Cross-Linked Polymer Material

Figure 15:
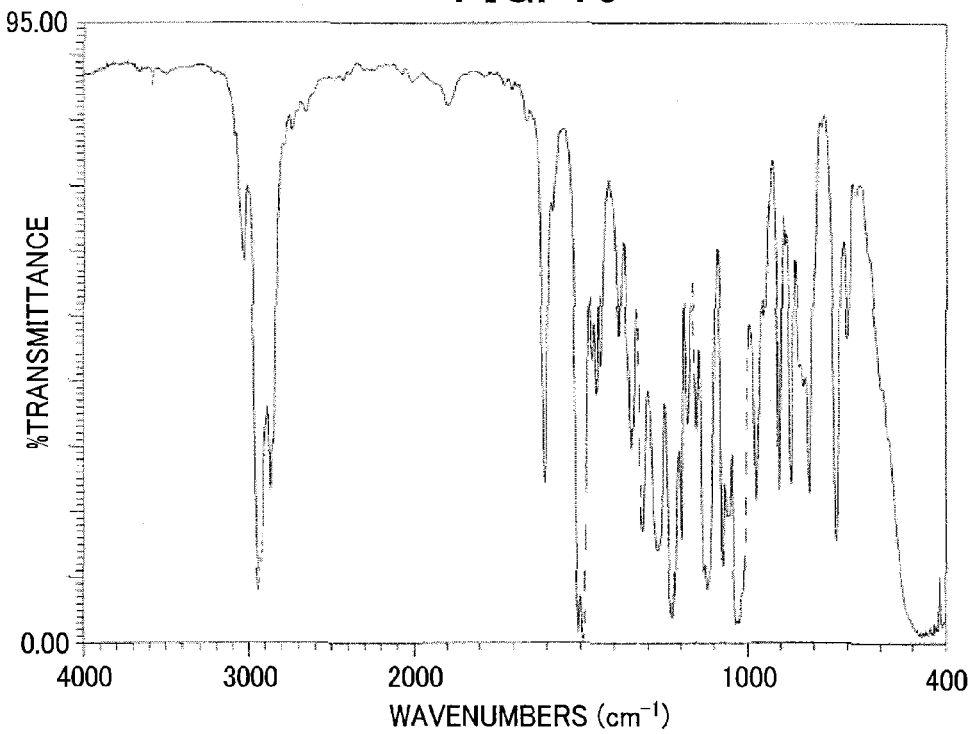
FIG. 15 is a graph illustrating an infrared absorption spectrum (KBr tablet method) of a compound obtained in Synthesis Example 6 with an X axis of wavenumber (cm-1) and a Y axis of transparency (%)

[tetrahydro-2H-pyran-2-yl)oxy]methyl group-containing charge transport compound (represented by Chemical structure 3-8, which was a material of a three-dimensionally cross-linked polymer, was synthesized in the following procedure. 3.0 g of 4,4'-diaminodiphenyl ether, 17.896 g of the compound of Synthesis Example 1, 0.336 g of palladium acetate, 13.83 g of tertial buthoxysodium, and 100 ml of o-xylene were placed in a flask. The mixture was stirred at room temperature in an Ar gas atmosphere while dripping 1.214 g of tritertial butyl phosphine to prepare a solution. Next, this solution was stirred at 80° C. for one hour. Subsequent to one-hour stirring by reflux, the solution was diluted with toluene. The resultant was dehydrated by magnesium sulfate followed by adsorption treatment by activated earth and silica gel. Subsequent to filtration, washing, and condensation, a yellow oily material was obtained. This yellow oily material was subject to refinement (toluene/ethyl acetate=10/1 in volume ratio) by silica gel column to separate and obtain a target product (yield: 5.7 g, pale yellow oily material). The reaction formula is as follows: FIG. 15 is a graph illustrating an infrared absorption spectrum (KBr tablet method) of the compound obtained in Synthesis Example 6.

Chemical Structure 3-8

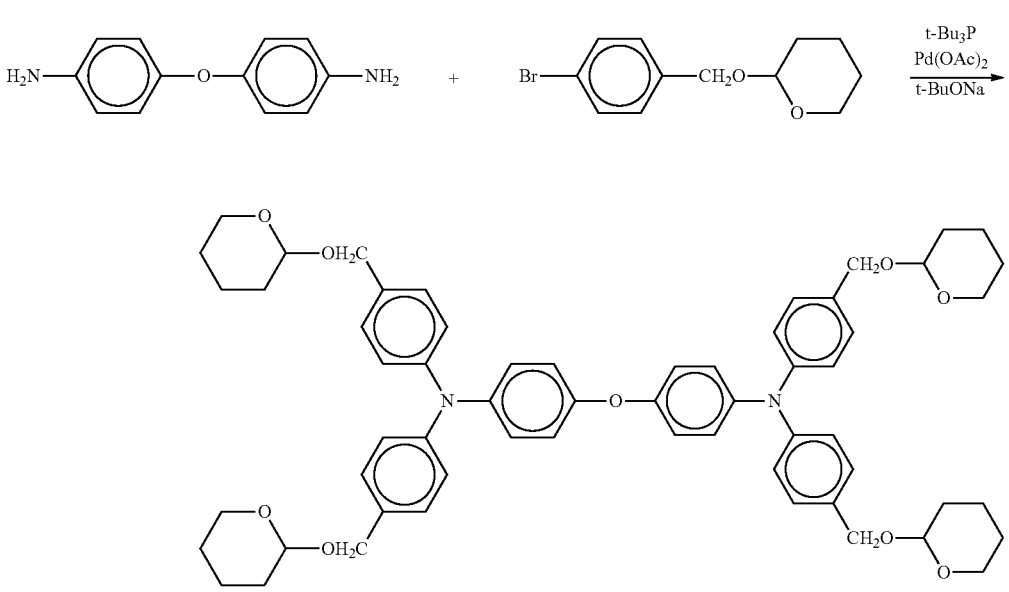

Synthesis Example 7

Synthesis of Three-Dimensionally Cross-Linked Polymer Material

Figure 16:
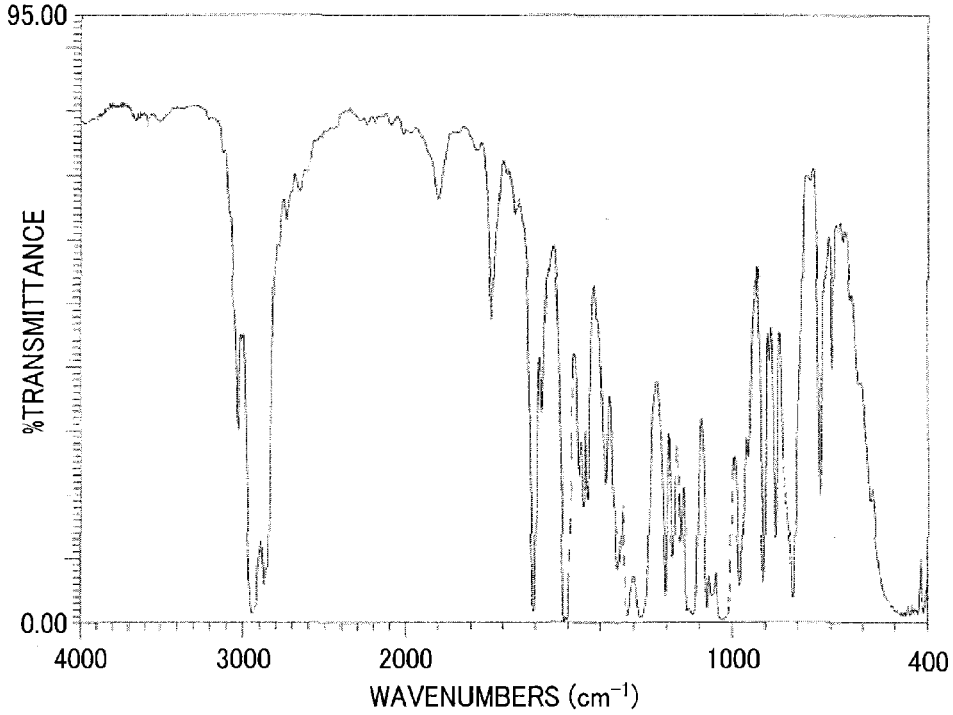
FIG. 16 is a graph illustrating an infrared absorption spectrum (KBr tablet method) of a compound obtained in Synthesis Example 7 with an X axis of wavenumber (cm-1) and a Y axis of transparency (%)

[tetrahydro-2H-pyran-2-yl)oxy]methyl group-containing charge transport compound (represented by Chemical structure 3-13, which was a material of a three-dimensionally cross-linked polymer, was synthesized in the following procedure. 3.18 g of 4,4'-ethylene dianiline, 17.896 g of the compound of Synthesis Example 1, 0.336 g of palladium acetate, 13.83 g of tertial buthoxysodium, and 100 ml of o-xylene were placed in a flask. The mixture was stirred at room temperature in an Ar gas atmosphere while dripping 1.214 g of tritertial butyl phosphine to prepare a solution. Next, this solution was stirred at 80° C. for one hour. Subsequent to one-hour stirring by reflux, the solution was diluted with toluene. The resultant was dehydrated by magnesium sulfate followed by adsorption treatment by activated earth and silica gel. Subsequent to filtration, washing, and condensation, a yellow oily material was obtained. This yellow oily material was subject to refinement (toluene/ethyl acetate=20/1 in volume ratio) by silica gel column to separate and obtain a target product (yield: 5.7 g, pale yellow oily material). The reaction formula is as follows: FIG. 16 is a graph illustrating an infrared absorption spectrum (KBr tablet method) of the compound obtained in Synthesis Example 7.

cedure. 9.323 g of 1,1-bis(4-aminophenyl)cyclohexene, 45.55 g of the compound of Synthesis Example 1, 0.785 g of palladium acetate, 32.28 g of tertial buthoxysodium, and 300 ml of o-xylene were placed in a flask. The mixture was stirred at room temperature in an Ar gas atmosphere while dripping 2.43 g of tritertial butyl phosphine to prepare a solution. Next, this solution was stirred at 80° for one hour. Subsequent to two-hour stirring by reflux, the solution was diluted with toluene. The resultant was dehydrated by magnesium sulfate followed by adsorption treatment by activated earth and silica Chemical Structure 3-13

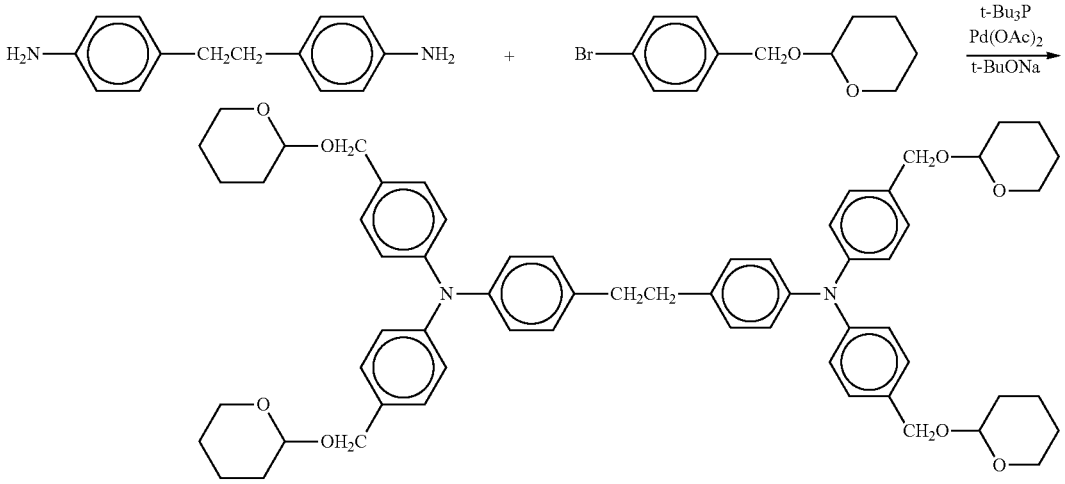

Synthesis Example 8

Synthesis of Three-Dimensionally Cross-Linked Polymer Material

Figure 17:
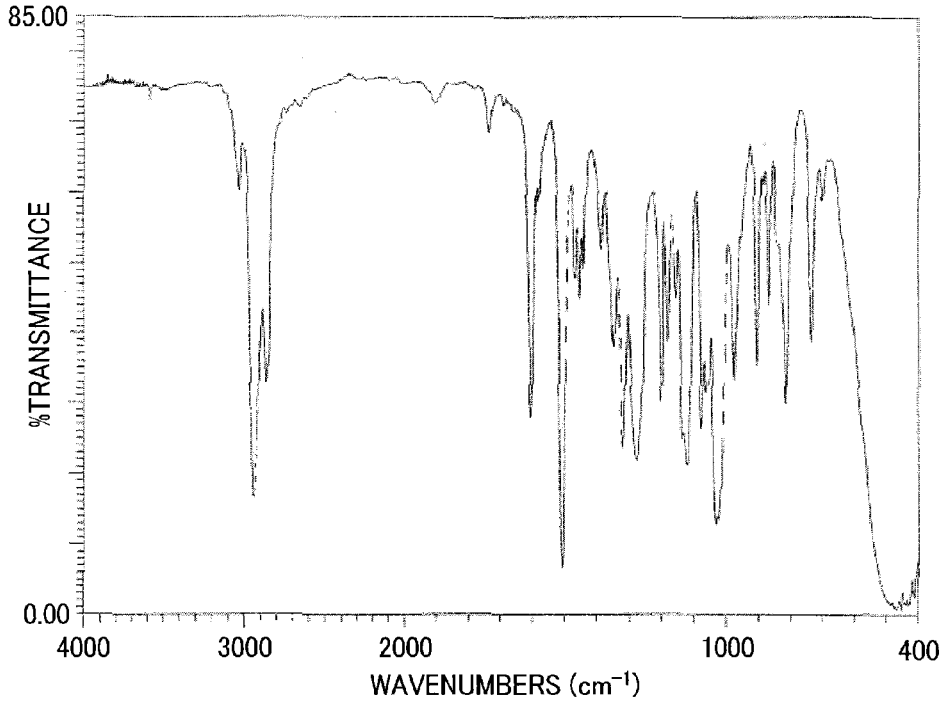
FIG. 17 is a graph illustrating an infrared absorption spectrum (KBr tablet method) of a compound obtained in Synthesis Example 8 with an X axis of wavenumber (cm-1) and a Y axis of transparency (%)

[tetrahydro-2H-pyran-2-yl)oxy]methyl group-containing charge transport compound (represented by Chemical structure 3-18, which was a material of a three-dimensionally cross-linked polymer, was synthesized in the following progel. Subsequent to filtration, washing, and condensation, a yellow oily material was obtained. This yellow oily material was subject to refinement (toluene/ethyl acetate=10/1 in volume ratio) by silica gel column to separate and obtain a target product (yield: 11.4 g, yellow amorphous material). The reaction formula is as follows: FIG. 17 is a graph illustrating an infrared absorption spectrum (KBr tablet method) of the compound obtained in Synthesis Example 8.

Chemical Structure 3-18

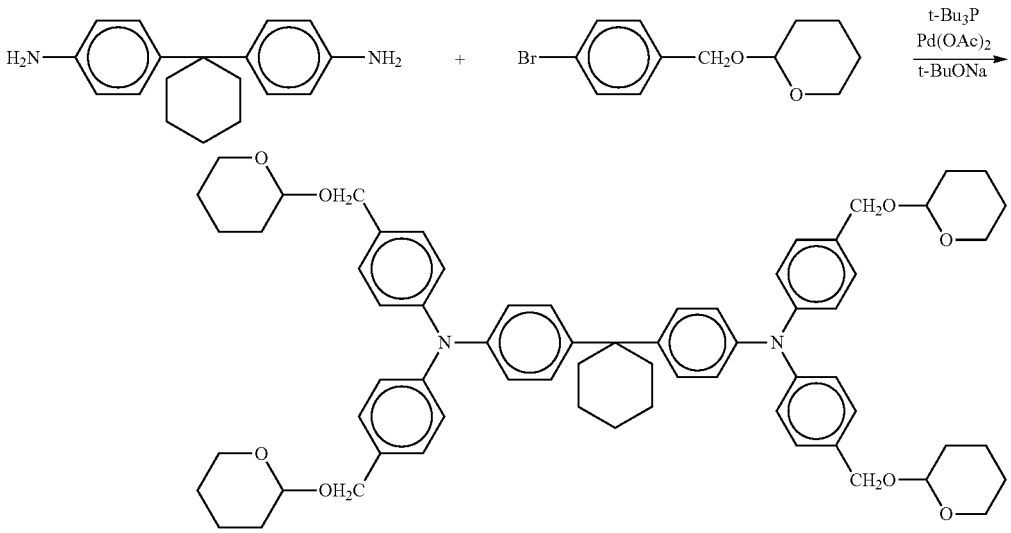

Synthesis Example 9

Synthesis of Three-Dimensionally Cross-Linked Polymer Material

Figure 18:
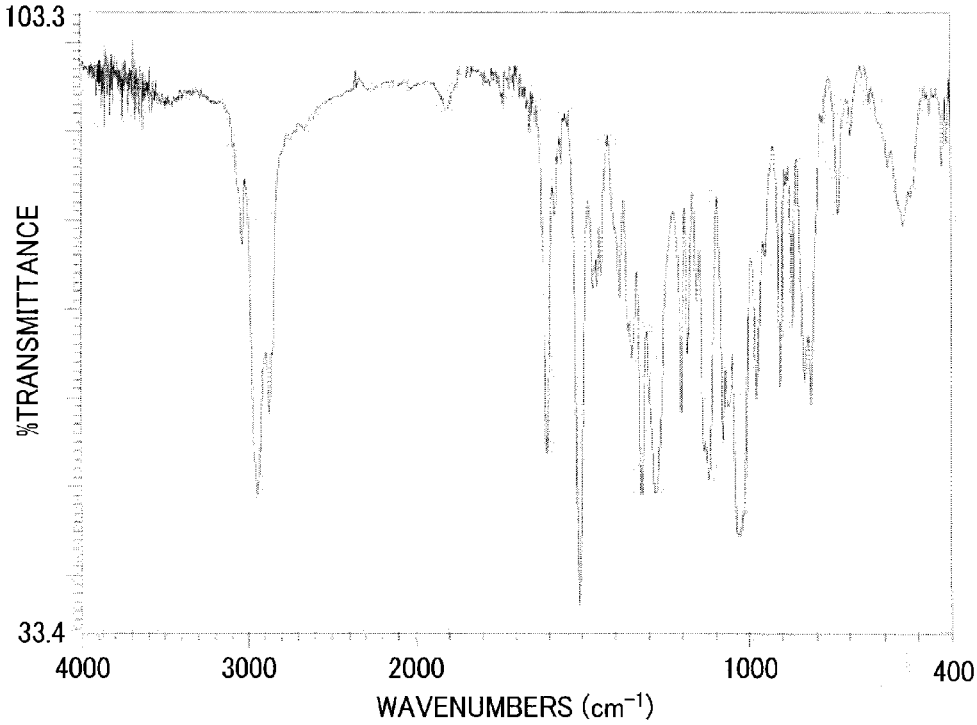
FIG. 18 is a graph illustrating an infrared absorption spectrum (KBr tablet method) of a compound obtained in Synthesis Example 9 with an X axis of wavenumber (cm-1) and a Y axis of transparency (%)

[tetrahydro-2H-pyran-2-yl)oxy]methyl group-containing charge transport compound (represented by Chemical structure 3-21, which was a material of a three-dimensionally cross-linked polymer, was synthesized in the following procedure. 10.335 g of α,α'-bis(4-aminophenyl)-1,4-diisopropyl benzene, 39.05 g of the compound of Synthesis Example 1, 0.673 g of palladium acetate, 27.677 g of tertial buthoxysodium, and 200 ml of o-xylene were placed in a flask. The mixture was stirred at room temperature in an Ar gas atmosphere while dripping 2.43 g of tritertial butyl phosphine to prepare a solution. Next, this solution was stirred at 80° for one hour. Subsequent to two-hour stirring by reflux, the solution was diluted with toluene. The resultant was dehydrated by magnesium sulfate followed by adsorption treatment by activated earth and silica gel. Subsequent to filtration, washing, and condensation, a yellow oily material was obtained. This yellow oily material was subject to refinement (toluene/ethyl acetate=10/1 in volume ratio) by silica gel column to separate and obtain a target product (yield: 23.5 g, pale yellow amorphous material). The reaction formula is as follows: FIG. 18 is a graph illustrating an infrared absorption spectrum (KBr tablet method) of the compound obtained in Synthesis Example 9.

Synthesis Example 10

Synthesis of Three-Dimensionally Cross-Linked Polymer Material

Figure 19:
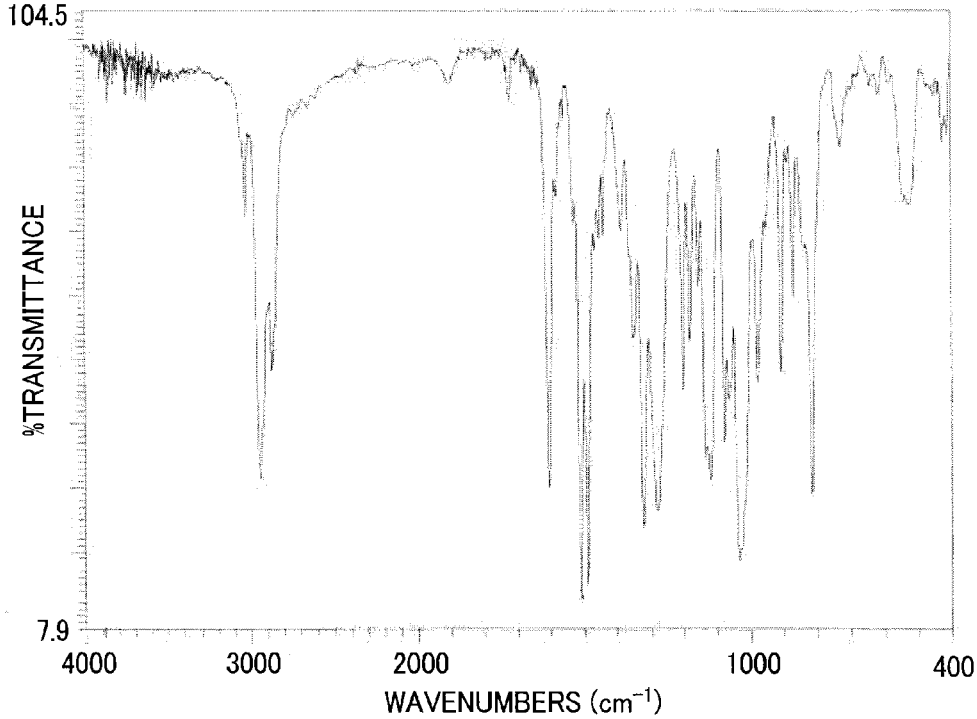
FIG. 19 is a graph illustrating an infrared absorption spectrum (KBr tablet method) of a compound obtained in Synthesis Example 10 with an X axis of wavenumber (cm-1) and a Y axis of transparency (%)

[tetrahydro-2H-pyran-2-yl)oxy]methyl group-containing charge transport compound (represented by Chemical structure 4-3, which was a material of a three-dimensionally cross-linked polymer, was synthesized in the following procedure. 1.30 g of 4,4'-diamino-p-terphenyl, 6.508 g of the compound of Synthesis Example 1, 3.844 g of tertial buthoxysodium, and 52 mg of bis)tri-t-buthoxy phosphine)palladium, and 50 ml of o-xylene were placed in a flask. The mixture was stirred at room temperature in an Ar gas atmosphere to prepare a solution. Next, this solution was stirred by reflux for one hour and thereafter the solution was diluted with toluene. The resultant was dehydrated by magnesium sulfate followed by adsorption treatment by activated earth and silica gel. Subsequent to filtration, washing, and condensation, a yellow oily material was obtained. This yellow oily material was subject to refinement (toluene/ethyl acetate=20/1 in volume ratio) by silica gel column to separate and obtain a target product (yield: 1.95 g, pale yellow amorphous material). The reaction formula is as follows: FIG. 19 is a graph illustrating an infrared absorption spectrum (KBr tablet method) of the compound obtained in Synthesis Example 10.

Chemical Structure 3-21

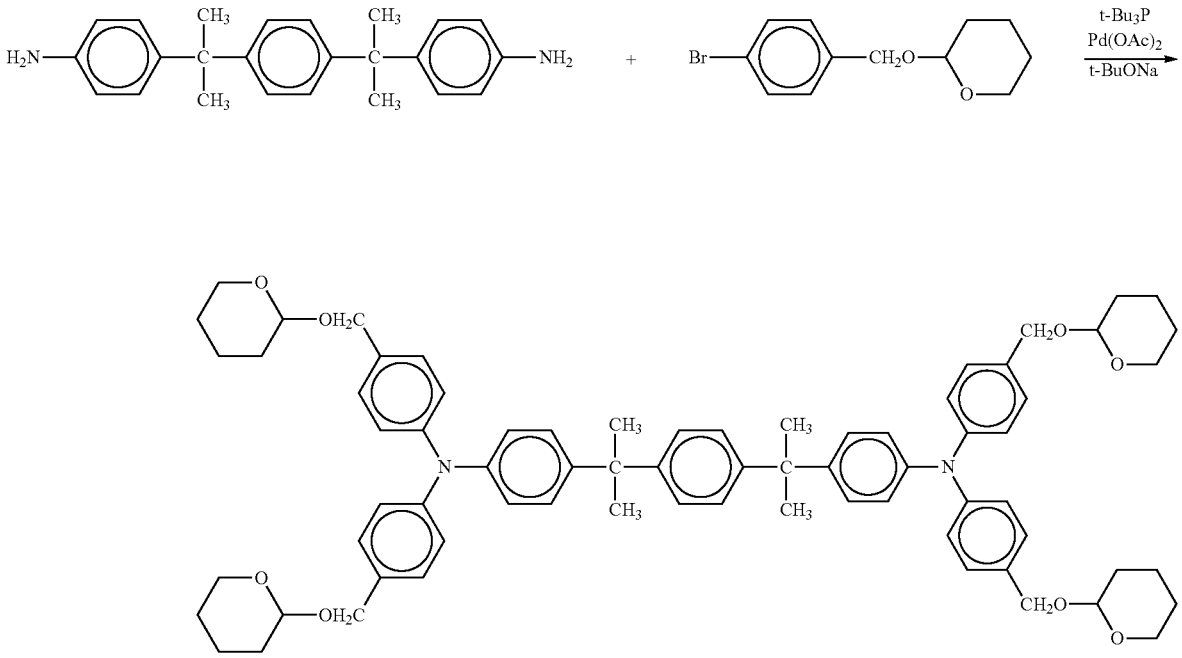

Chemical Structure 4-3

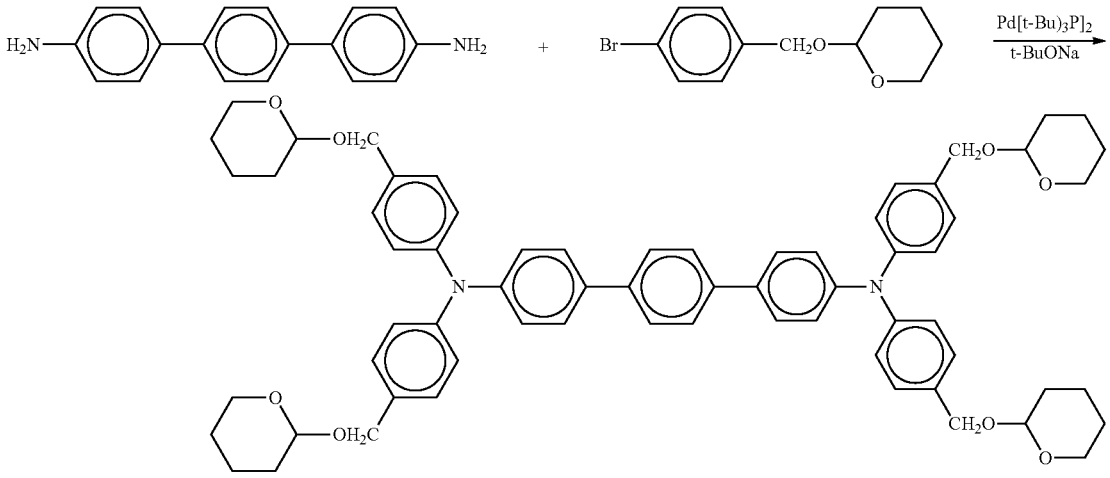

Synthesis Example 11

Synthesis of Three-Dimensionally Cross-Linked Polymer Material

Figure 20:
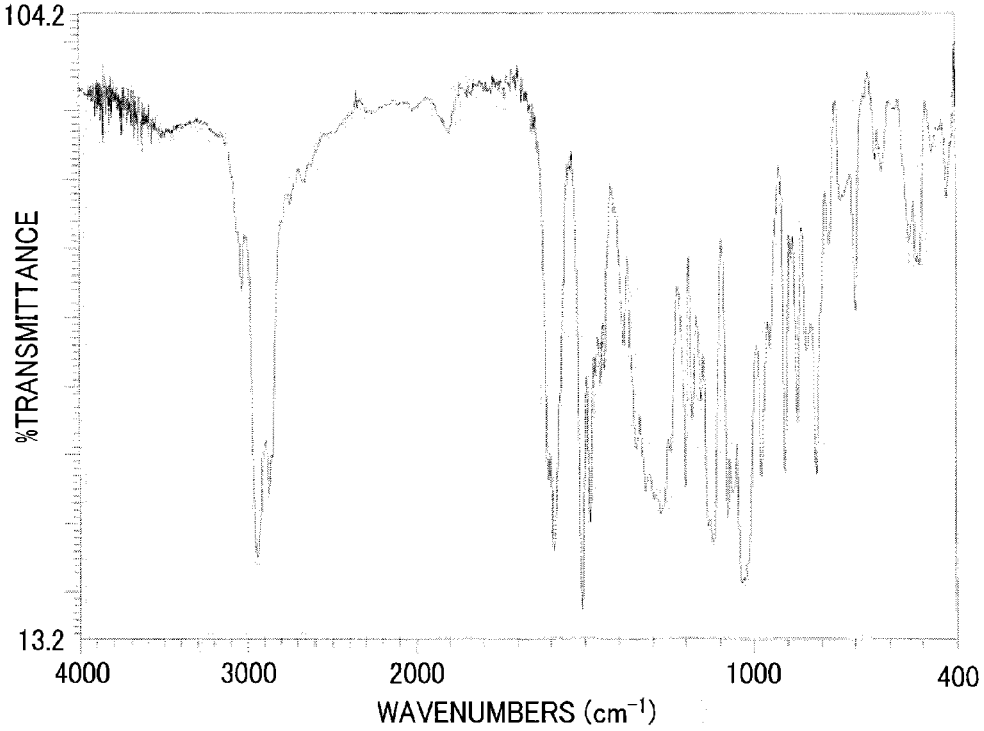
FIG. 20 is a graph illustrating an infrared absorption spectrum (KBr tablet method) of a compound obtained in Synthesis Example 11 with an X axis of wavenumber (cm-1) and a Y axis of transparency (%)

[tetrahydro-2H-pyran-2-yl)oxy]methyl group-containing charge transport compound (represented by Chemical structure 4-5, which was a material of a three-dimensionally cross-linked polymer, was synthesized in the following procedure. 0.541 g of 1,3-phenylene diamine, 6.508 g of the compound of Synthesis Example 1, 3.844 g of tertial buthoxysodium, and 52 mg of bis(tri-t-buthoxy phosphine)palladium, and 20 ml of o-xylene were placed in a flask. The mixture was stirred at room temperature in an Ar gas atmosphere to prepare a solution. Next, this solution was diluted with toluene. The resultant was dehydrated by magnesium sulfate followed by adsorption treatment by activated earth and silica gel. Subsequent to filtration, washing, and condensation, a yellow oily material was obtained. This yellow oily material was subject to refinement (toluene/ethyl acetate=10/1 in volume ratio) by silica gel column to separate and obtain a target product (yield: 3.02 g, pale yellow amorphous material). The reaction formula is as follows: FIG. 20 is a graph illustrating an infrared absorption spectrum (KBr tablet method) of the compound obtained in Synthesis Example 11.

Chemical Structure 4-5

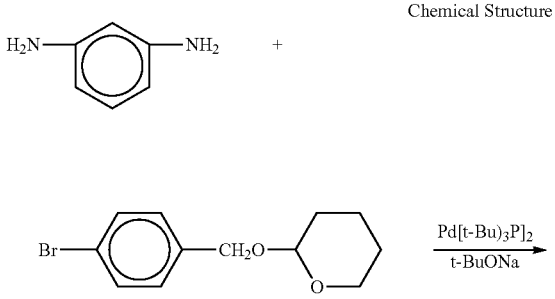

-continued

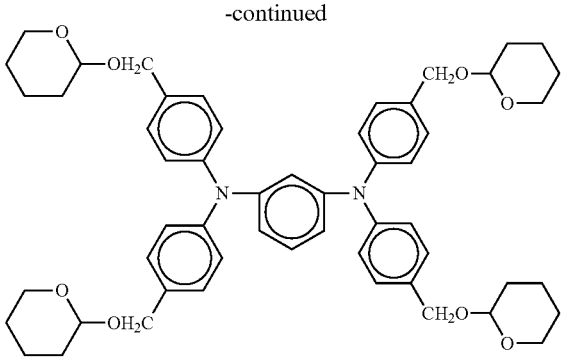

Synthesis Example 12

Synthesis of Three-Dimensionally Cross-Linked Polymer Material

[tetrahydro-2H-pyran-2-yl)oxy]methyl group-containing charge transport compound (represented by Chemical structure 4-12, which was a material of a three-dimensionally cross-linked polymer, was synthesized in the following procedure.

Figure 21:
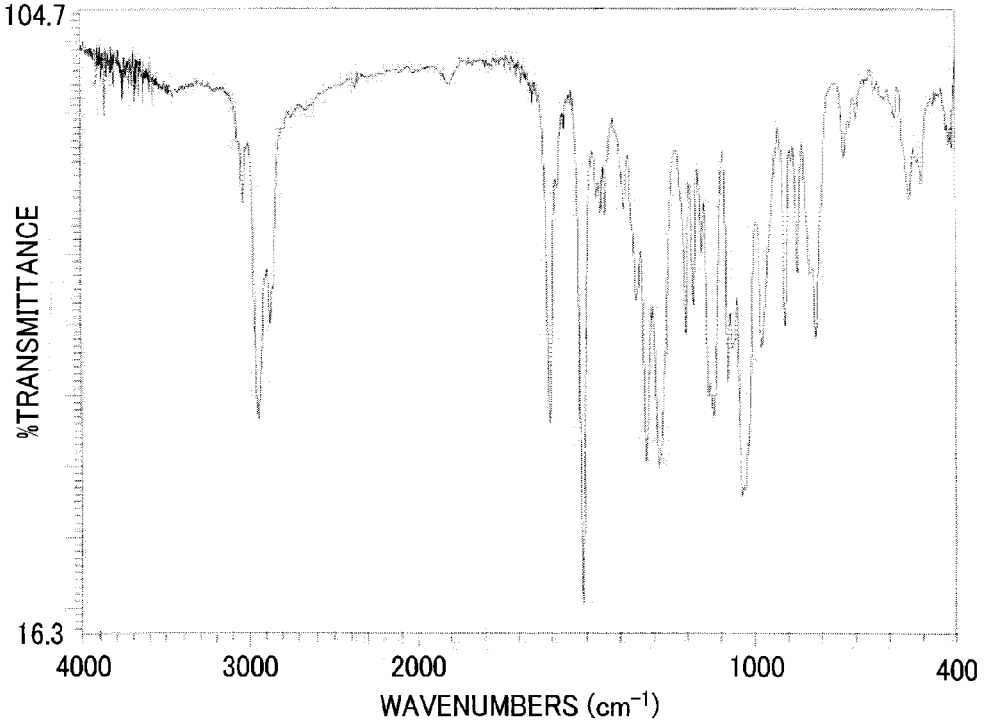
FIG. 21 is a graph illustrating an infrared absorption spectrum (KBr tablet method) of a compound obtained in Synthesis Example 12 with an X axis of wavenumber (cm-1) and a Y axis of transparency (%)

1.42 g of 4,4'-diamino-stilbene.dihydrochloride, 6.51 g of the compound of Synthesis Example 1, 9.61 g of tertial buthoxysodium, and 52 mg of bis(tri-t-buthoxy phosphine) palladium, and 50 ml of o-xylene were placed in a flask. The mixture was stirred at room temperature in an Ar gas atmosphere to prepare a solution. Next, this solution was stirred by reflux for one hour and thereafter the solution was diluted with toluene. The resultant was dehydrated by magnesium sulfate followed by adsorption treatment by activated earth and silica gel. Subsequent to filtration, washing, and condensation, a yellow oily material was obtained. This yellow oily material was subject to refinement (toluene/ethyl acetate=10/1 in volume ratio) by silica gel column to separate and obtain a target product (yield: 1.6 g, pale yellow amorphous material). The reaction formula is as follows: FIG. 21 is a graph illustrating an infrared absorption spectrum (KBr tablet method) of the compound obtained in Synthesis Example 12.

Chemical structure 4-12

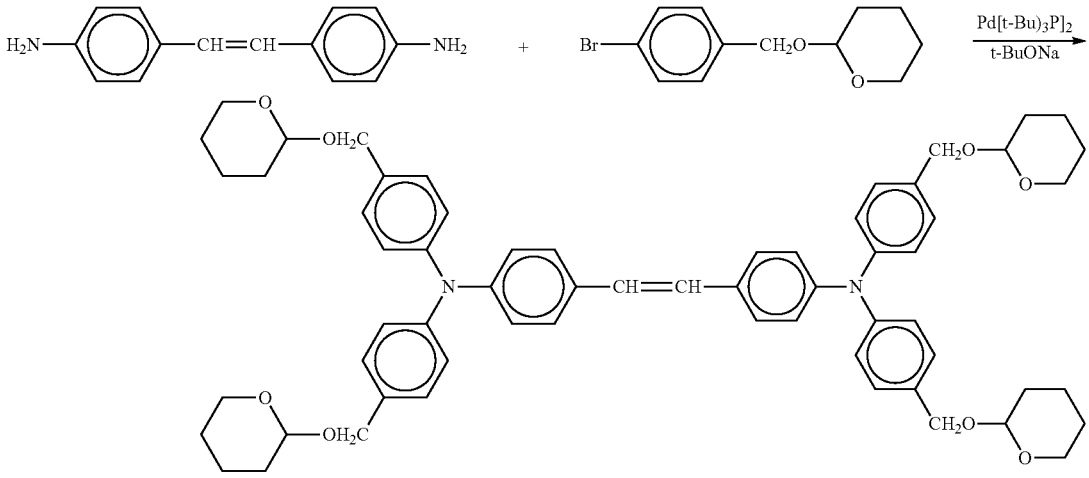

Synthesis Example 13

Synthesis of Three-Dimensionally Cross-Linked Polymer Material

[tetrahydro-2H-pyran-2-yl)oxy]methyl group-containing charge transport compound (represented by Chemical structure 4-17, which was a material of a three-dimensionally cross-linked polymer, was synthesized in the following procedure.

Figure 22:
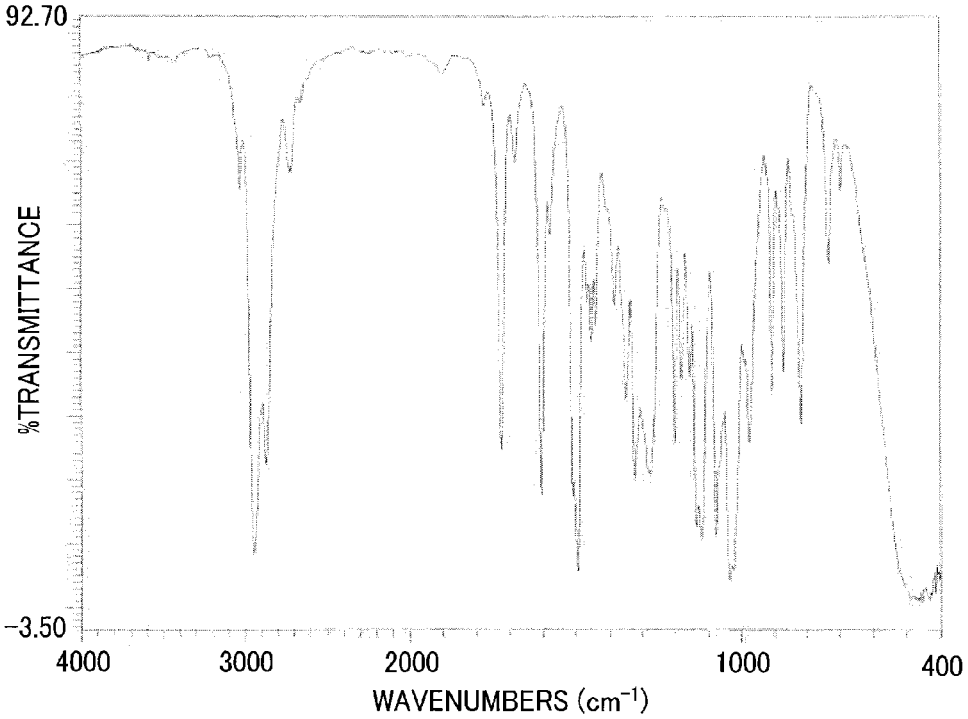
FIG. 22 is a graph illustrating an infrared absorption spectrum (KBr tablet method) of a compound obtained in Synthesis Example 13 with an X axis of wavenumber (cm-1) and a Y axis of transparency (%)

1.274 g of an intermediate methylol compound, 1.346 g of 3,4-dihydro-2H-pyran, and 20 ml of tetrahydrofuran were placed in a flask. The mixture was stirred at 5° C. and 14 mg of paratoluene sulfonic acid was put therein to prepare a solution. Next, this solution was stirred at room temperature four hours. Subsequent to extraction by ethyl acetate, the resultant was dehydrated by magnesium sulfate followed by adsorption treatment by activated earth and silica gel. Subsequent to filtration, washing, and condensation, a yellow oily material was obtained. This yellow oily material was subject to refinement (toluene/ethyl acetate=20/1 in volume ratio) by silica gel column to separate and obtain a target product (yield: 1.4 g, yellow oily material). The reaction formula is as follows: FIG. 22 is a graph illustrating an infrared absorption spectrum (KBr tablet method) of the compound obtained in Synthesis Example 13.

Chemical structure 4-17

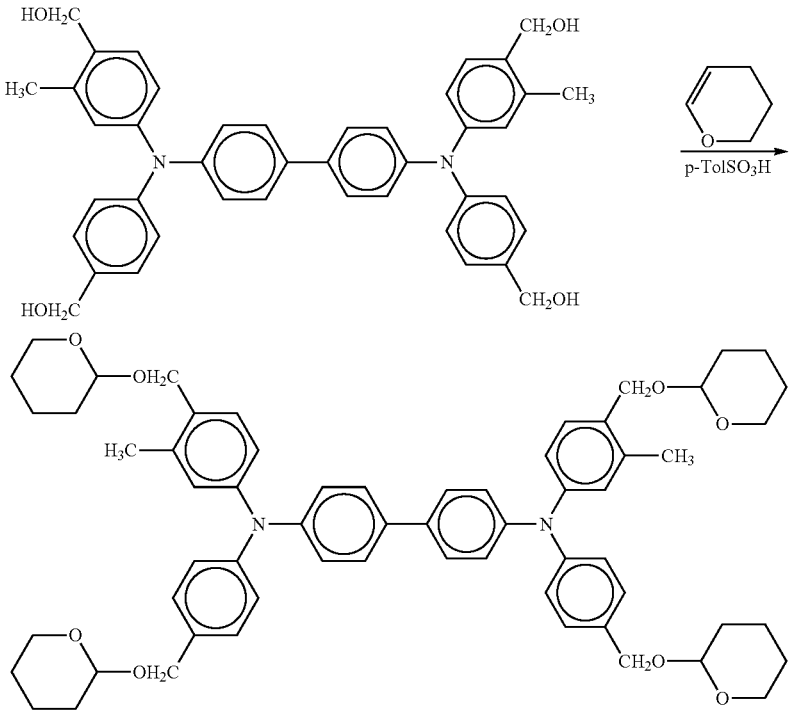

Synthesis Example 14

Synthesis of Three-Dimensionally Cross-Linked Polymer Material

Figure 23:
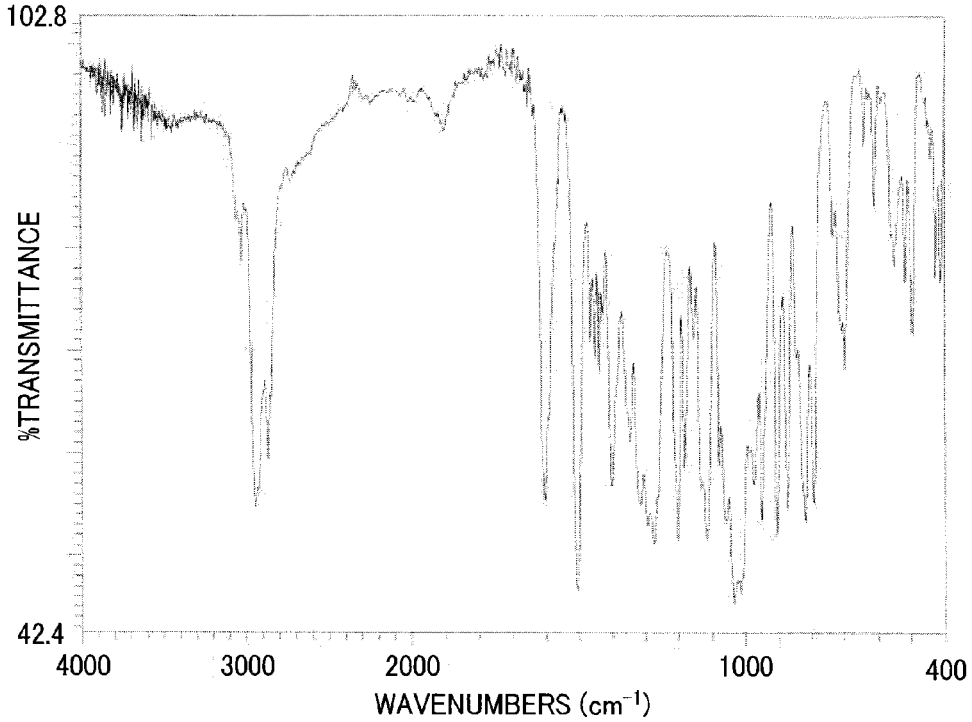
FIG. 23 is a graph illustrating an infrared absorption spectrum (KBr tablet method) of a compound obtained in Synthesis Example 14 with an X axis of wavenumber (cm-1) and a Y axis of transparency (%)

[tetrahydro-2H-pyran-2-yl)oxy]methyl group-containing charge transport compound (represented by Chemical structure 4-24, which was a material of a three-dimensionally cross-linked polymer, was synthesized in the following procedure. 0.791 g of 1,5-diaminonaphthalene, 6.508 g of the compound of Synthesis Example 1, 3.844 g of tertial buthoxysodium, and 52 mg of bis(tri-t-buthoxy phosphine) palladium, and 20 ml of o-xylene were placed in a flask. The mixture was stirred at room temperature in an Ar gas atmosphere to prepare a solution. Next, this solution was stirred by reflux for one hour and thereafter the solution was diluted with toluene. The resultant was dehydrated by magnesium sulfate followed by adsorption treatment by activated earth and silica gel. Subsequent to filtration, washing, and condensation, a yellow oily material was obtained. This yellow oily material was subject to refinement (toluene/ethyl acetate=9/1 in volume ratio) by silica gel column to separate and obtain a target product (yield: 2.56 g, pale yellow amorphous material). The reaction formula is as follows: FIG. 23 is a graph illustrating an infrared absorption spectrum (KBr tablet method) of the compound obtained in Synthesis Example 14.

Chemical Structure 4-24

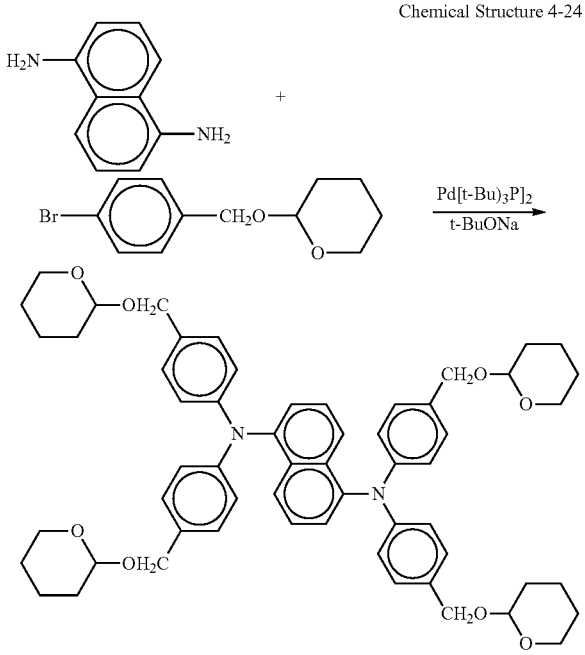

As described above, various kinds of the charge transport compounds having three or more [(tetrahydro-2H-pyran-2-yl)oxy]methyl groups can be synthesized by a combination of the method of directly formylating charge transport compounds and coupling reaction of halogenated aromatic intermediate compounds formed by methylating [tetrahydro-2H-pyran-2-yl)oxy] and amine compounds. For example, the compound represented by Chemical structure 3-26 can be obtained in the same manner as in Synthesis Example 5 except that the intermediate obtained in Synthesis Example 2 is used instead of the intermediate obtained in Synthesis Example 1.

Synthesis Example 15

Synthesis of Titanylphthalocyanine Crystal

Titanylphthalocyanine crystal was synthesized based on JP-2004-83859-A.

First, 292 parts of 1,3-diiminoisoindoline and 1,800 parts of sulfolane were mixed and 204 parts of titanium tetrabutoxido was dripped thereto in a nitrogen atmosphere to obtain a solution. Thereafter, the solution was heated gradually to 180° C., and the resultant was stirred for five hours to conduct reaction while the reaction temperature was maintained in a range of from 170° C. to 180° C. After the reaction was complete, the resultant was naturally cooled down and the precipitation was filtered. The filtered resultant was washed with chloroform until the obtained powder became blue. Next, the resultant powder was washed with methanol several times. Further, the resultant was washed with hot water of 80° C. several times and dried to obtain a coarse titanyl phthalocyanine. The thus-obtained coarse titanyl phthalocyanine was dissolved in strong sulfuric acid having an amount 20 times as much as that of the titanyl phthalocyanine. The resultant was dripped to iced water having an amount 100 times as much as that of the solution followed by filtering the thus-obtained precipitated crystal. The filtered substance was washed with deionized water having a pH of 7.0 and a specific electric conductivity of 1.0 μS/cm repeatedly until the deionized water after washing became neutral (the pH value and the specific electric conductivity were 6.8 and 2.6 μS/cm, respectively) to obtain a wet cake (water paste) of a titanylphthalocyanine pigment.

40 parts of the thus-obtained wet cake (water paste) was put in 200 parts of tetrahydrofuran and vigorously stirred by a HOMOMIXER (MARKII f model, manufactured by KENIS, Ltd.) at 2,000 rpm at room temperature until the paste changed from navy blue to light blue (20 minutes after initiation of the stirring), immediately followed by filtration with a reduced pressure. The crystal obtained on the filtration device were washed with tetrahydrofuran to produce a wet cake of a pigment. The wet cake was then dried for 2 days at 70° C. under a reduced pressure of 5 mmHg to produce 8.5 parts of a titanyl phthalocyanine crystal. The solid portion concentration of the wet cake was 15% by weight. The mass ratio of the solvent for crystal conversion to the wet cake was 33.

Figure 9:
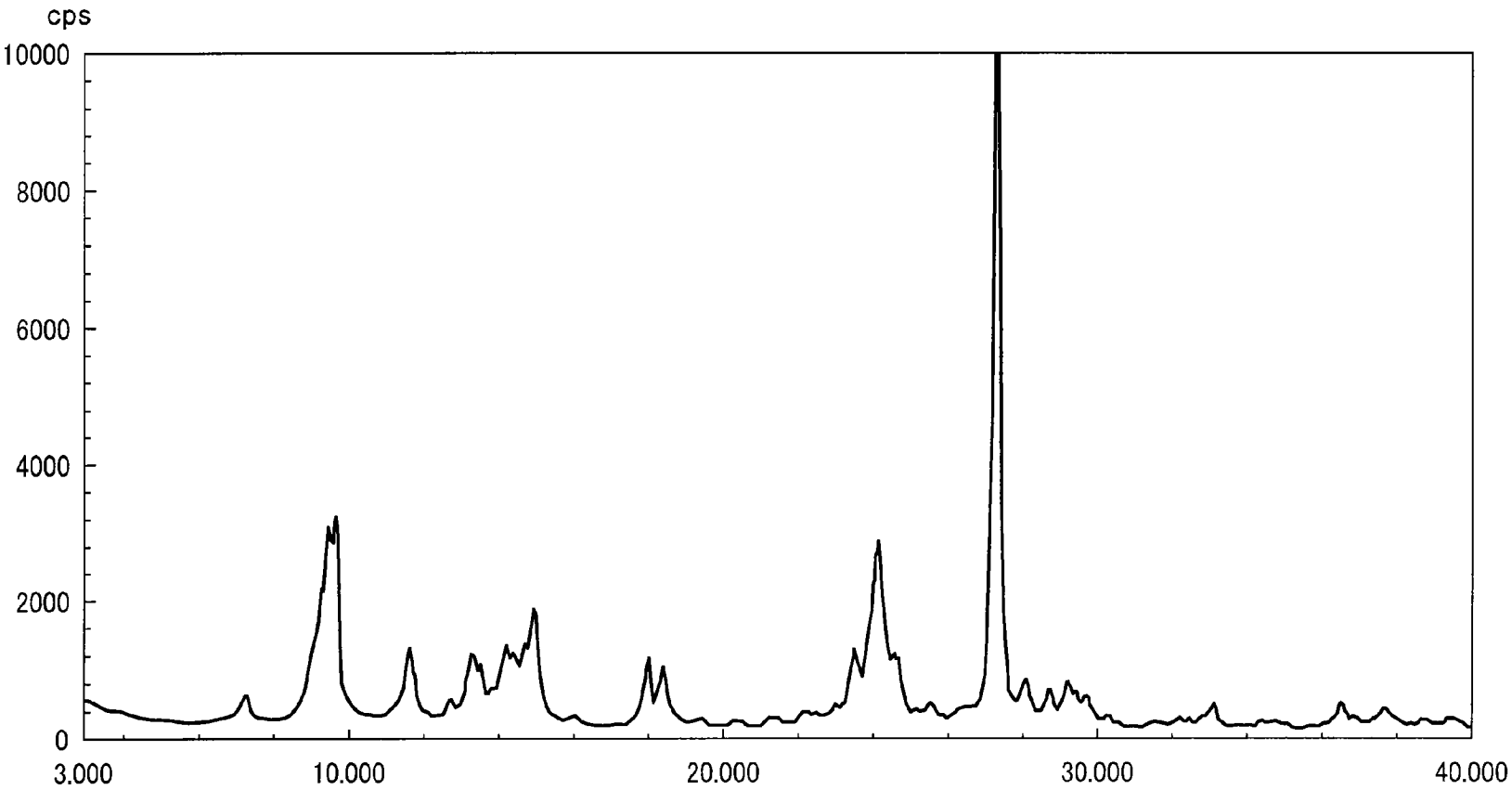
FIG. 9 is a graph illustrating the result of an X-ray diffraction spectrum of titanylphthalocyanine powder manufactured in Examples.

The X ray diffraction spectrum of the thus-obtained titanyl phthalocyanine powder was observed under the following conditions. It was found that the thus-obtained titanyl phthalocyanine powder had a CuKα X ray diffraction spectrum having a wavelength of 1.542 Å such that the maximum diffraction peak was observed at a Bragg (2θ) angle of 27.2±0.2°, the main peaks at a Bragg (2θ) angle of 9.4±0.2°, 9.6±0.2°, and 24.0±0.2°, and a peak at a Bragg (2θ) angle of 7.3±0.2° as the lowest angle diffraction peak while having no peak between the peak at 7.3° and the peak at 9.4° and no peak at 26.3°. The results are shown in FIG. 9.

Measuring Conditions of X Ray Diffraction Spectrum
X ray tube: Cu
Voltage: 50 kV
Current: 30 mA
Scanning speed: 2°/min
Scanning range: 3° to 40°
Time constant: 2 seconds Example 1

Manufacturing of Image Bearing Member

The liquid application of an undercoating layer, the liquid application of a charge generating layer, and the liquid application of a charge transport layer which have the following recipes were applied to a surface-ground aluminum cylinder having a diameter of 60 mm in this order followed by drying to form an undercoating layer having a thickness of 3.5 μm, a charge generating layer having a thickness of 0.2 μm, and a charge transport layer having a thickness of 22 μm.

The liquid application of the cross-linked charge transport layer having the following recipe was spray-coated on the prepared charge transport layer followed by drying at 150° for 30 minutes to form a cross-linked charge transport layer having a thickness of 5.5 μm to manufacture an image bearing member (photoreceptor) of the present disclosure.

| Recipe of Liquid Application of Undercoating Layer | |
|---|---|
| Alkyd resin (Beckozole 1307-60-EL, manufactured by Dainippon Ink and Chemicals, Inc.): | 6.0 parts |
| Melamine resin (SuperBeckamine G-821-60, manufactured by Dainippon Ink and Chemicals, Inc.): | 4.0 parts |
| Titanium oxide (CREL, manufactured by ISHIHARA SANGYO KAISHA, LTD): | 50.0 parts |
| Methylethylketone: | 50.0 parts |

| Recipe of Liquid Application of Charge Generating Layer | |
|---|---|
| Polyvinyl butyral {XYHL, manufactured by Union Carbide Corporation (UCC)}: | 0.5 parts |
| Cyclohexanone: | 200.0 parts |
| Methylethylketone: | 80.0 parts |
| Titanyl phthalocyanine synthesized in Synthesis Example 15: | 1.5 parts |

| Recipe of Liquid Application of Charge Transport Layer | |
|---|---|
| Bisphenol Z polycarbonate (PanLite TS-2050, manufactured by Teijin Chemicals Ltd.): | 10.0 parts |
| Tetrahydrofuran solution of 1% by weight Silicone oil (KF-50-100 CS, manufactured by Shin-Etsu Chemical Co., Ltd.): | 0.2 parts |
| Tetrahydrofuran: | 100 parts |
| Low molecular weight charge transport polymer represented by the following Chemical structure A-1: | 10.0 parts |

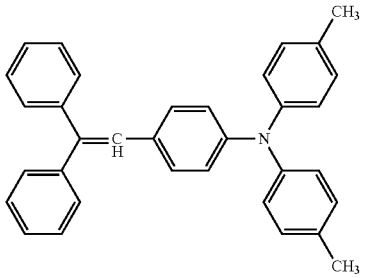

Chemical Structure A-1

| Recipe of Liquid Application of Cross-Linked Charge Transport Layer | |
|---|---|
| Compound represented by Chemical structure 2-4 synthesized in Synthesis Example 4: | 7.0 parts |
| Hydrocarbon compound represented by Chemical formula 1 (represented by Chemical structure 1-1): | 3.0 parts |
| Acid catalyst (p-toluene sulfonic acid): | 0.01 parts |
| Tetrahydrofuran (dehydrated): | 66.7 parts |

Examples 2 to 14

Manufacturing of Image Bearing Member

Image bearing members of Examples 2 to 14 were manufactured in the same manner as in Example 1 except that the compound represented by Chemical structure 2-4 and the hydrocarbon compound represented by Chemical formula 1 synthesized in Synthesis Example 4 in the liquid application of charge transport layer were changed as shown in Table 1.

Example 15

Manufacturing of Image Bearing Member

The image bearing member of Example 15 was manufactured in the same manner as in Example 1 except that the liquid application of the cross-linked charge transport layer was changed to the following recipe.

| Recipe of Liquid Application of Cross-Linked Charge Transport Layer | |
|---|---|
| Compound represented by Chemical structure 3-1 synthesized in Synthesis Example 5: | 5.0 parts |
| Hydrocarbon compound represented by Chemical formula 1 (represented by Chemical structure 1-2): | 5.0 parts |
| Acid catalyst (Nacure 2500 (manufactured by Kusumoto Chemicals, Ltd.): | 0.1 parts |
| Tetrahydrofuran (dehydrated): | 90.0 parts |

Example 16

Manufacturing of Image Bearing Member

The image bearing member of Example 16 was manufactured in the same manner as in Example 1 except that the liquid application of the cross-linked charge transport layer was changed to the following recipe.

| Recipe of Liquid Application of Cross-Linked Charge Transport Layer | |
|---|---|
| Compound represented by Chemical structure 3-1 synthesized in Synthesis Example 5: | 8.0 parts |
| Hydrocarbon compound represented by Chemical formula 1 (represented by Chemical structure 1-2): | 2.0 parts |
| Acid catalyst (p-toluene sulfonic acid-hydrate): | 0.02 parts |
| Tetrahydrofuran (dehydrated): | 90.0 parts |

Comparative Example 1

Manufacturing of Image Bearing Member

The image bearing member of Comparative Example 1 was manufactured in the same manner as in Example 1 except that the liquid application of the cross-linked charge transport layer was changed to the following recipe.

| Recipe of Liquid Application of Cross-Linked Charge Transport Layer | |
|---|---|
| Compound represented by Chemical structure 2-4 synthesized in Synthesis Example 4: | 10.0 parts |
| Acid catalyst (p-toluene sulfonic acid-hydrate): | 0.01 parts |
| Tetrahydrofuran (dehydrated): | 66.7 parts |

Comparative Example 2

Manufacturing of Image Bearing Member

The image bearing member of Comparative Example 2 was manufactured in the same manner as in Example 1 except that the liquid application of the cross-linked charge transport layer was changed to the following recipe.

However, the compatibility between the methylol intermediate and the hydrocarbon compound represented by Chemical formula 1 (represented by Chemical structure 1-2) was so bad that the all the surface was clouded by phase separation, which made it impossible to evaluate the image bearing member.

| Recipe of Liquid Application of Cross-Linked Charge Transport Layer | |
|---|---|
| Intermediate methylol compound prepared in Synthesis Example 3: | 7.0 parts |
| Hydrocarbon Compound Represented by Chemical Formula 1 (compound represented by Chemical structure 1-2): | 3.0 parts |
| Acid catalyst (p-toluene sulfonic acid): | 0.01 parts |
| Tetrahydrofuran (dehydrated): | 66.7 parts |

Comparative Example 3

Manufacturing of Image Bearing Member

The image bearing member of Comparative Example 3 was manufactured in the same manner as in Example 1 except that the liquid application of the cross-linked charge transport layer was changed to the following recipe.

However, the surface of the thus-obtained photoreceptor was liquid and phase separation of the hydrocarbon compound represented by Chemical formula 1 (represented by Chemical Structure 1-2) was observed, which made it impossible to evaluate the image bearing member.

| Recipe of Liquid Application of Cross-Linked Charge Transport Layer | |
|---|---|
| Charge transport compound represented by the following Chemical Structure A-2: | 7.0 parts |
| Hydrocarbon Compound Represented by Chemical Formula 1 (compound represented by Chemical Structure 1-2): | 3.0 parts |
| Acid catalyst (p-toluene sulfonic acid): | 0.01 parts |
| Tetrahydrofuran (dehydrated): | 66.7 parts |

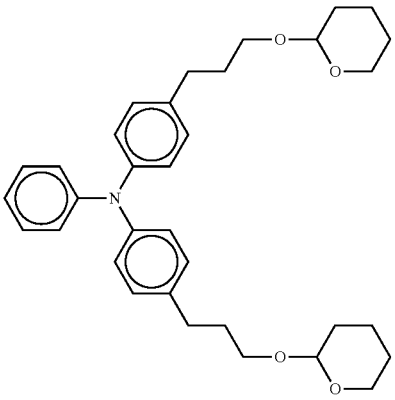

Chemical Structure A-2

Comparative Example 4

Manufacturing of Image Bearing Member

The image bearing member of Comparative Example 4 was manufactured in the same manner as in Example 1 except that the liquid application of the cross-linked charge transport layer was changed to the following recipe.

However, the surface of the thus-obtained photoreceptor was viscous and phase separation of the hydrocarbon compound represented by Chemical Formula 1 (represented by Chemical Structure 1-2) was observed, which made it impossible to evaluate the image bearing member.

| Recipe of Liquid Application of Cross-Linked Charge Transport Layer | |
|---|---|
| Charge transport compound represented by the following Chemical structure A-3: | 3.0 parts |
| Hydrocarbon compound represented by Chemical formula 1 (compound represented by Chemical structure 1-2): | 3.0 parts |
| Resole type phenolic resin: PL-2211 (manufactured by GUN EI CHEMICAL INDUSTRY CO., LTD.): | 3.5 parts |
| Acid catalyst (Nacure 2500 (manufactured by Kusumoto Chemicals, Ltd.): | 0.2 parts |
| Isopropanol: | 15.0 parts |
| Methylethylketone: | 5.0 parts |

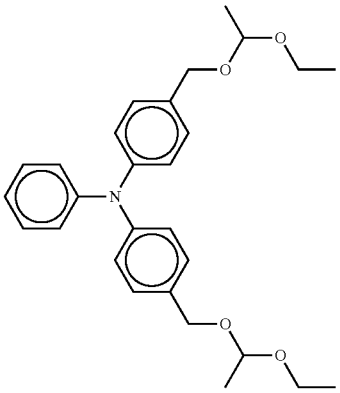

Chemical Structure A-3

Comparative Example 5

Manufacturing of Image Bearing Member

The liquid application of cross-linked charge transport layer in Example 1 was changed to the following recipe. After natural drying for 20 minutes, the coated layer was cured by exposure to light under the condition of: a metal halide lamp 160 W/cm; irradiation distance: 120 mm; Irradiation intensity: 500 mW/cm$^2$, and irradiation time: 180 seconds. The cured layer was dried at 130° C. for 30 minutes to obtain a cross-linked charge transport layer having a thickness of 5.5 μm.

However, the surface of the thus-obtained image bearing member was viscous and phase separation of the hydrocarbon compound represented by Chemical Formula 1 (represented by Chemical Structure 1-2) was observed with white turbidity, which made it impossible to evaluate the image bearing member.

| Composition of Liquid Application of Cross-Linked Charge Transport Layer | |
|---|---|
| Radical polymerizable charge transport compound represented by the following Chemical structure A-4: | 5.0 parts |
| Multi-functional radical polymerizable monomer (trimethylol propane triacrylate (KAYARAD TMPTA, molecular weight: 296; number of functional groups: 3, ratio of molecular weight to number of functional groups = 99, manufactured by Nippon Kayaku Co., Ltd.): | 5.0 parts |
| Hydrocarbon compound represented by Chemical formula 1 (represented by Chemical structure 1-2): | 3.0 parts |
| Photopolymerization initiator: (1-hydroxy-cyclohexyl-phenyl-ketone (IRGACURE 184, manufactured by Chiba Specialty Chemicals, Ltd.)}: | 1.0 part |
| Tetrahydrofuran: | 100.0 parts |

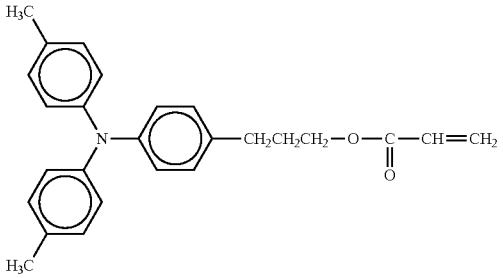

Chemical structure A-4

Comparative Example 6

Manufacturing of Image Bearing Member

The image bearing member of Comparative Example 6 was manufactured in the same manner as in Example 1 except that the liquid application of the cross-linked charge transport layer was changed to the following recipe.

However, the surface of the thus-obtained image bearing member was viscous and phase separation of the compound represented by Chemical Structure 1-2 was observed with white turbidity, which made it impossible to evaluate the image bearing member.

| Recipe of Liquid Application of Cross-Linked Charge Transport Layer | |
|---|---|
| Hydroxyl group-containing charge transport compound represented by the following Chemical structure A-5: | 2.5 parts |
| Hydrocarbon Compound Represented by Chemical Formula 1 (compound represented by Chemical Structure 1-2): | 2.0 parts |
| Tolylene diisocyanate: | 2.5 parts |
| Tetrahydrofuran: | 50.0 parts |

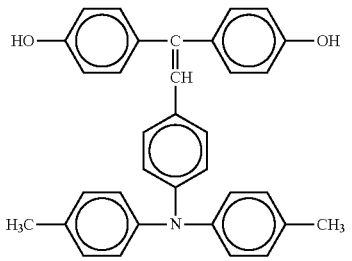

Chemical Structure A-5

Comparative Example 7

Manufacturing of Image Bearing Member

The image bearing member of Comparative Example 7 was manufactured in the same manner as in Example 1 except that no cross-linked charge transport layer was provided.

Comparative Example 8

Manufacturing of Image Bearing Member

The image bearing member of Comparative Example 8 was manufactured in the same manner as in Example 1 except that the liquid application of the cross-linked charge transport layer was changed to the following recipe.

| Recipe of Liquid Application of Cross-Linked Charge Transport Layer | |
|---|---|
| Compound represented by Chemical structure 3-1 synthesized in Synthesis Example 5: | 7.0 parts |
| Terphenyl: | 3.0 parts |
| Acid catalyst (p-toluene sulfonic acid): | 0.01 parts |
| Tetrahydrofuran (dehydrated): | 66.7 parts |

Comparative Example 9

Manufacturing of Image Bearing Member

The image bearing member of Comparative Example 9 was manufactured in the same manner as in Example 1 except that the liquid application of the cross-linked charge transport layer was changed to the following recipe.

| Recipe of Liquid Application of Cross-Linked Charge Transport Layer | |
|---|---|
| Compound represented by Chemical structure 3-1 synthesized in Synthesis Example 5: | 6.0 parts |
| Bis(1-naphthyl)phenyl amine: | 4.0 parts |
| Acid catalyst (p-toluene sulfonic acid): | 0.01 parts |
| Tetrahydrofuran (dehydrated): | 66.7 parts |

Comparative Example 10

Manufacturing of Image Bearing Member

The image bearing member of Comparative Example 10 was manufactured in the same manner as in Comparative Example 5 except that the liquid application of the cross-linked charge transport layer was changed to the following recipe.

| Recipe of Liquid Application of Cross-Linked Charge Transport Layer | |
|---|---|
| Radical polymerizable charge transport compound represented by the following Chemical structure A-4: | 10.0 parts |
| Multi-functional radical polymerizable monomer (trimethylol propane triacrylate (KAYARAD TMPTA, molecular weight: 296; number of functional groups: 3, ratio of molecular weight to number of functional groups = 99, manufactured by Nippon Kayaku Co., Ltd.): | 10.0 parts |
| Photopolymerization initiator: (1-hydroxy-cyclohexyl-phenyl-ketone (IRGACURE 184, manufactured by Chiba Specialty Chemicals, Ltd.)}: | 1.0 part |
| Tetrahydrofuran: | 100.0 parts |

Comparative Example 11

Manufacturing of Image Bearing Member

The image bearing member of Comparative Example 11 was manufactured in the same manner as in Comparative Example 6 except that the liquid application of the cross-linked charge transport layer was changed to the following recipe.

| Recipe of Liquid Application of Cross-Linked Charge Transport Layer | |
|---|---|
| Hydroxyl group-containing charge transport compound represented by the following Chemical structure A-5: | 5.0 parts |
| Tolylene diisocyanate: | 5.0 parts |
| Tetrahydrofuran: | 50.0 parts |

TABLE 1

| | Cross-linked charge transport layer of image bearing member | | |
|---|---|---|---|
| | Hydrocarbon compound represented by Chemical Formula 1 | | Charge transport compound having three or more [tetrahydro-2H-pyran-2-yl)oxy] |
| | Kind | Mixing ratio (% by weight) | methyl groups linked with aromatic rings |
| Example 1 | Chemical Structure 1-1 | 30 | Chemical Structure 2-4 |
| Example 2 | Chemical Structure 1-1 | 30 | Chemical Structure 3-1 |
| Example 3 | Chemical Structure 1-2 | 30 | Chemical Structure 3-1 |
| Example 4 | Chemical Structure 1-3 | 30 | Chemical Structure 3-1 |
| Example 5 | Chemical Structure 1-4 | 30 | Chemical Structure 3-1 |
| Example 6 | Chemical Structure 1-2 | 30 | Chemical Structure 3-8 |
| Example 7 | Chemical Structure 1-2 | 30 | Chemical Structure 3-13 |
| Example 8 | Chemical Structure 1-2 | 30 | Chemical Structure 3-18 |
| Example 9 | Chemical Structure 1-2 | 30 | Chemical Structure 3-21 |
| Example 10 | Chemical Structure 1-2 | 30 | Chemical Structure 4-3 |
| Example 11 | Chemical Structure 1-2 | 30 | Chemical Structure 4-5 |

TABLE 1-continued

| | Cross-linked charge transport layer of image bearing member | | |
|---|---|---|---|
| | Hydrocarbon compound represented by Chemical Formula 1 | | Charge transport compound having three or more [tetrahydro-2H-pyran-2-yl)oxy] |
| | Kind | Mixing ratio (% by weight) | methyl groups linked with aromatic rings |
| Example 12 | Chemical Structure 1-2 | 30 | Chemical Structure 4-12 |
| Example 13 | Chemical Structure 1-2 | 30 | Chemical Structure 4-17 |
| Example 14 | Chemical Structure 1-2 | 30 | Chemical Structure 4-24 |
| Example 15 | Chemical Structure 1-2 | 50 | Chemical Structure 3-1 |
| Example 16 | Chemical Structure 1-2 | 20 | Chemical Structure 3-1 |
| Comparative Example 1 | — | — | Chemical Structure 2-4 |
| Comparative Example 2 | Chemical Structure 1-2 | 30 | — |
| Comparative Example 3 | Chemical Structure 1-2 | 30 | — |
| Comparative Example 4 | Chemical Structure 1-2 | 30.9 | — |
| Comparative Example 5 | Chemical Structure 1-2 | 21.4 | — |
| Comparative Example 6 | Chemical Structure 1-2 | 28.6 | — |
| Comparative Example 7 | — | — | |
| Comparative Example 8 | — | — | Chemical Structure 3-1 |
| Comparative Example 9 | — | — | Chemical Structure 3-1 |
| Comparative Example 10 | — | — | — |
| Comparative Example 11 | — | — | — |

Evaluation

The image bearing members manufactured in Examples 1 to 16 and Comparative Examples 1 to 11 were evaluated.

The cross-linked charge transport layer of the image bearing members of Examples 1 to 16 were visually confirmed to be uniformly transparent. This indicated the hydrocarbon compound represented by Chemical formula 1 was uniformly molecule-dispersed in the gaps of the three dimension network structure of the three dimension cross-linked polymer.

Evaluation of Abrasion Amount of Organic Image Bearing Member and Cleaning Blade During Machine-Run Test Each of the image bearing members manufactured in Examples 1 to 16 and Comparative Examples 1, 7, 10, and 11 were mounted onto a process cartridge for a digital full color multi-functional machine (MP C7500 SP, manufactured by Ricoh Co., Ltd.). Each of the process cartridge was installed into a digital full color multi-functional machine to output belt-like patterns of intermediate colors of yellow, magenta, cyan, and black with a run length of 500 A4 sheets (Ricoh My Recycle paper GP, manufactured by Ricoh Co., Ltd.) with a resolution of 600 dpi×600 dpi repeatedly at 60 sheets per minute until the total number of printouts reached 50,000 sheets. The abrasion amount of the image bearing members of each color station and the abrasion amount of the cleaning blades were measured.

The abrasion amount of the image bearing member was indicated by the decrease of the layer thickness obtained by subtracting the initial layer thickness from the layer thickness after the 50,000 outputs.

Figure 24:
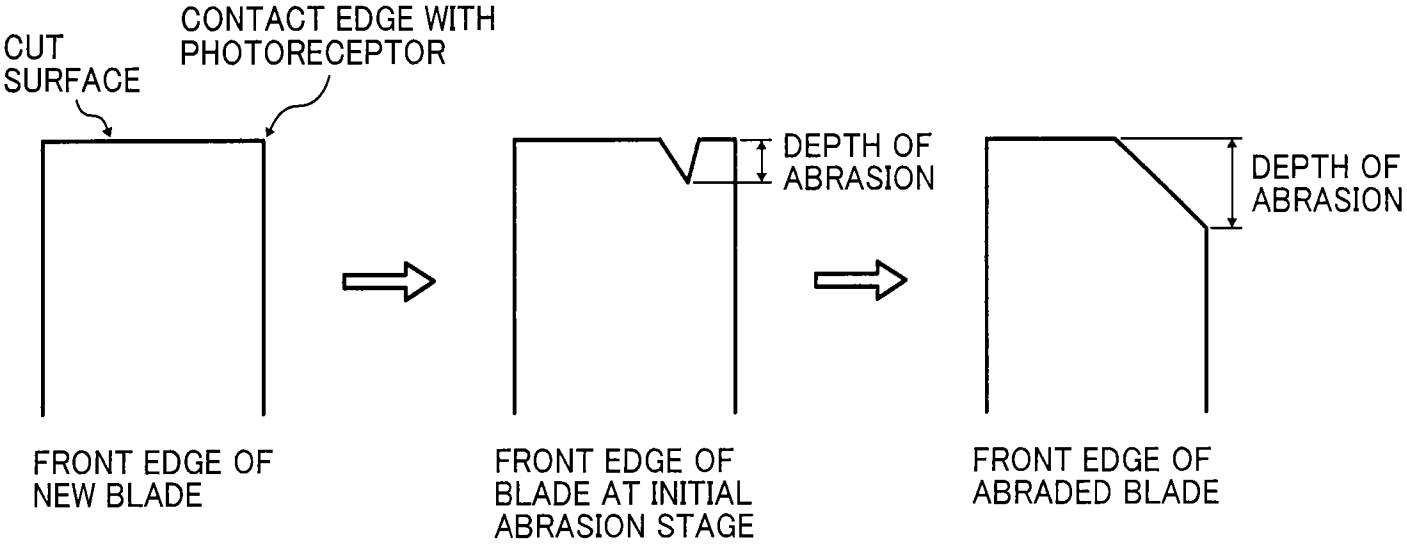
FIG. 24 is a diagram illustrating a method of measuring the depth of abrasion of a cleaning blade.

The abrasion amount of the cleaning blade was indicated by abrasion depth from the cut surface thereof as illustrated in FIG. 24 by measuring the front end of the cleaning blade with a laser microscope (VK-9500).

In addition, with regard to this machine, poor cleaning performance tends to occur frequently, which leads to production of images with background fouling due to passing-through of toner when the abrasion depth of the cleaning blade surpasses 30 μm.

Taking this into account, the number of output images at the abrasion depth of 30 μm was proportionally calculated by the measuring results to deduce the working life length of the cleaning blade. Considering that defective images with mottles tend to be produced due to charge leakage phenomenon if the thickness of the surface layer of the image bearing member is reduced by 5 μm, the number of output images when the surface layer of the image bearing member is reduced by 5 μm is proportionally calculated from the measuring results of the thickness to deduce the life length of the image bearing member.

The shorter of the life length of the cleaning blade and the life length of the image bearing member was determined as the deduced life length of the process cartridge requiring no part replacement.

The tendency of the abrasion amount of the image bearing members of each color station and the abrasion amount of the cleaning blades was the same.

The measuring results at the cyan station are shown in Table 2 as the representative.

TABLE 2

| | Evaluation | | |
|---|---|---|---|
| | Abrasion amount of image bearing member (μm) | Abrasion amount of cleaning blade (μm) | Deduced working life length of cartridge (×1,000 sheets) |
| Example 1 | 0.4 | 10.1 | 148.5 |
| Example 2 | 0.5 | 9.4 | 159.6 |
| Example 3 | 0.5 | 8.6 | 174.4 |
| Example 4 | 0.5 | 8.7 | 172.4 |
| Example 5 | 0.6 | 8.6 | 174.4 |
| Example 6 | 0.5 | 8.1 | 185.2 |
| Example 7 | 0.7 | 8.2 | 182.9 |
| Example 8 | 0.5 | 8.8 | 170.4 |
| Example 9 | 0.8 | 8.5 | 176.5 |
| Example 10 | 1 | 8.2 | 182.9 |
| Example 11 | 0.9 | 9.4 | 159.6 |
| Example 12 | 1.1 | 9.3 | 161.3 |
| Example 13 | 1 | 8.5 | 176.5 |
| Example 14 | 1.1 | 8.8 | 170.5 |
| Example 15 | 1.2 | 7.9 | 189.9 |
| Example 16 | 0.3 | 10.3 | 145.6 |
| Comparative Example 1 | 0.2 | 23.6 | 63.6 |
| Comparative Example 2 | — | — | — |
| Comparative Example 3 | — | — | — |
| Comparative Example 4 | — | — | — |
| Comparative Example 5 | — | — | — |
| Comparative Example 6 | — | — | — |
| Comparative Example 7 | 5.2 | 5.1 | 48.1 |

TABLE 2-continued

| | Evaluation | | |
|---|---|---|---|
| | Abrasion amount of image bearing member (μm) | Abrasion amount of cleaning blade (μm) | Deduced working life length of cartridge (×1,000 sheets) |
| Comparative Example 8 | 1.7 | 24.4 | 61.5 |
| Comparative Example 9 | 1.9 | 18.8 | 79.8 |
| Comparative Example 10 | 0.2 | 21.4 | 70.1 |
| Comparative Example 11 | 0.4 | 27.5 | 54.5 |

As described above, in Comparative Example 1 using no hydrocarbon represented by Chemical Formula 1, although the abrasion amount of the image bearing was small, the abrasion amount of the cleaning blade was large. For this reason, the deduced working life length of the process cartridge was shorter than 70,000 sheets while the deduced working life lengths of the process cartridges of Examples were significantly prolonged to 140,000 sheets or more.

In addition, when the hydrocarbon compound represented by the Chemical formula 1 for use in the present disclosure was added to a conventional thermocuring composition, as shown in the results of Comparative Examples 2 to 6, no uniform layer was formed or curing was not good due to phase separation, thereby failing to form a surface layer.

Moreover, as shown in Comparative Example 7, when no protective layer was formed, the abrasion of the image bearing member was rate-controlling, resulting in a process cartridge having a significantly short deduced working life length.

In addition, as shown in Comparative Examples 8 and 9, when a filler other than the hydrocarbon compound represented by Chemical formula 1 was added for curing to the charge transport compound having three or more [tetrahydro-2H-pyran-2-yl)oxy]methyl groups linked with aromatic rings for use in the present disclosure, the abrasion amount of the cleaning blade was rate-controlling. For this reason, the deduced working life length of the cartridge was not improved much in comparison with that of an image bearing member with no protective layer.

Furthermore, in Comparative Example 10 in which the conventional acrylic-curing protective layer is formed and Comparative Example 11 in which the conventional urethane-curing protective layer is formed, the abrasion of the cleaning blade was rate-controlling. For this reason, the deduced working life length of the cartridge was not improved much in comparison with that of an image bearing member with no protective layer.

Therefore, the image bearing member of the present disclosure reduces abrasion of the image bearing member in comparison with an image bearing member with no protective layer. Also, the abrasion of the cleaning blade was reduced by the protective layer of the image bearing member of the present disclosure in comparison with a conventional protective layer. For this reason, the deduced working life length of the image bearing member of the present disclosure is significantly prolonged without a part replacement. Therefore, an image forming apparatus having a long working life and an image forming method can be also provided.

As shown in Examples 1 to 16, when an image bearing member having the combination of Chemical Formula 2-1 and Chemical Formula 1, Chemical Formula 3-1 and Chemical Formula 1, or Chemical Formula 4-1 and Chemical Formula 1 was formed, the abrasion amount of the image bearing member and the abrasion amount of the cleaning blade struck a balance so that the life length of a process cartridge without a part replacement was prolonged significantly.

In particular, as shown in Examples 2 to 14 in which the mixing ratio of the compound represented by Chemical formula 1 was adjusted to 30% by weight, it was found that the combination of Chemical Formula 3-1 and Chemical Formula 1 or Chemical Formula 4-1 and Chemical Formula 1 was preferable because it prolonged the working life length of the process cartridge.

Furthermore, the abrasion amount of the cleaning blade of Examples 3 to 5 was less than that of Example 2. This indicates that the structure element of Chemical Formula 1-1 of Chemical Formula 1 is more preferable.

In addition, as shown in Examples 3, 15, and 16, the image bearing members are good in a wide range of from 20% by weight to 50% by weight of the mixing ratio of the hydrocarbon compound represented by Chemical Formula 1. Moreover, as the mixing ratio of Chemical Formula 1 increases, the abrasion amount of the image bearing member tends to increase and the abrasion amount of the cleaning blade tends to decrease. When the mixing ratio surpasses 50% by weight, the working life length depends on the abrasion amount of the image bearing member. When the mixing ratio is less than 20% by weight, the abrasion amount of the cleaning blade is anticipated to increase. That indicates that the mixing ratio of the hydrocarbon compound represented by Chemical Formula 1 is preferably from 20% by weight to 50% by weight.

As described above, according to the present invention, it is possible to design and provide an image bearing member having excellent mechanical durability while reducing the abrasion resistance of a cleaning blade that contacts the image bearing member. Therefore, the present invention also provides a method of manufacturing the image bearing member, an image forming apparatus in particular that can output quality images stably over the entire process with a long working life, an image forming method, and a process cartridge.

Having now fully described embodiments of the present invention, it will be apparent to one of ordinary skill in the art that many changes and modifications can be made thereto without departing from the spirit and scope of embodiments of the invention as set forth herein.

What is claimed is:

1. An image bearing member comprising:

a substrate; and a photosensitive layer overlying the substrate, wherein an uppermost surface layer of the image bearing member comprises:

a hydrocarbon compound represented by the following Chemical Formula 1; and a three-dimensionally cross-linked polymer formed by polymerization reaction of a charge transport compound having three or more [tetrahydro-2H-pyran-2-yl)oxy]methyl groups linked with aromatic rings, wherein, in the polymerization reaction, part of the three or more [(tetrahydro-2H-pyran-2-yl)oxy]methyl groups is severed and detached from the charge transport compound, $Ph_1$-$Q_1$-$Ph_2$-$Q_2$-$Ph_3$ Chemical Formula 1 where $Q_1$ and $Q_2$ independently represent methylene groups or ethylene groups, $Ph_1$ and $Ph_3$ independently represent phenyl groups with which one or two methyl groups are bonded, and $Ph_2$ represents a phenylene group or a phenylene group having one methyl group;

wherein the hydrocarbon compound of Chemical Formula 1 is present in the uppermost surface layer in an amount of from 20% by weight to 50% by weight, based on total content of the uppermost surface layer.

2. The image bearing member according to claim 1, wherein, in Chemical Formula 1, $Q_1$ and $Q_2$ are methylene groups, $Ph_1$ and $Ph_3$ are phenyl groups with which two methyl groups are bonded, and $Ph_2$ is a phenylene group.

3. The image bearing member according to claim 1, wherein the photosensitive layer comprises: a charge generating layer; a charge transport layer; and a cross-linked charge transport layer in this order, wherein the cross-linked charge transport layer forms the uppermost surface layer.

4. The image bearing member according to claim 1, wherein the three-dimensionally cross-linked polymer is formed by mixing and heating a curing catalyst and the charge transport compound having three or more [tetrahydro-2H-pyran-2-yl)oxy]methyl groups linked with aromatic rings to sever and detach part of the [(tetrahydro-2H-pyran-2-yl)oxy]methyl groups for the polymerization reaction.

5. The image bearing member according to claim 1, wherein the charge transport compound having three or more [tetrahydro-2H-pyran-2-yl)oxy]methyl groups linked with aromatic rings is represented by the following Chemical Formula 2, Chemical Formula 2

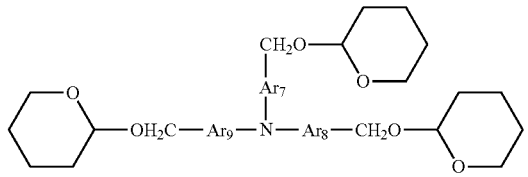

where $Ar_7$, $Ar_8$, and $Ar_9$ independently represent divalent aromatic hydrocarbon groups having 6 to 18 carbon atoms that optionally have alkyl substitution groups.

6. The image bearing member according to claim 5, wherein the compound represented by Chemical Formula 2 is represented by the following Chemical Formula 2-1, Chemical Formula 2-1

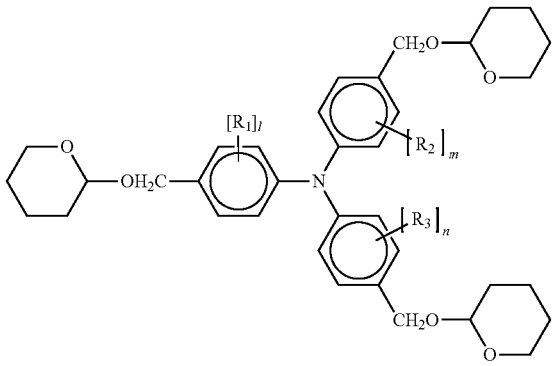

where, $R_1$, $R_2$, and $R_3$ independently represent hydrogen atoms, methyl groups, or ethyl groups and l, m, and n independently represent integers of from 1 to 4.

7. The image bearing member according to claim 1, wherein the charge transport compound having three or more [tetrahydro-2H-pyran-2-yl)oxy]methyl groups linked with aromatic rings is represented by the following Chemical Formula 3, Chemical Formula 3

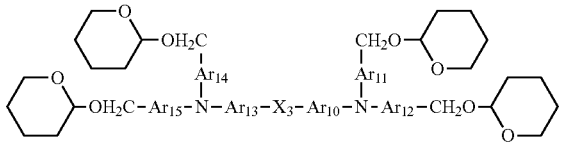

where $X_3$ represents an alkylene group having 1 to 4 carbon atoms, an alkylidene group having 2 to 6 carbon atoms, a divalent group in which two alkylidene groups having 2 to 6 carbon atoms are bonded via a phenylene group, or an oxygen atom and $Ar_{10}$, $Ar_{11}$, $Ar_{12}$, $Ar_{13}$, $Ar_{14}$, and $Ar_{15}$ independently represent divalent aromatic hydrocarbon groups having 6 to 18 carbon atoms that optionally have alkyl substitution groups.

8. The image bearing member according to claim 7, wherein the charge transport compound represented by the following chemical formula 3 is represented by the following Chemical Formula 3-1, Chemical Formula 3-1

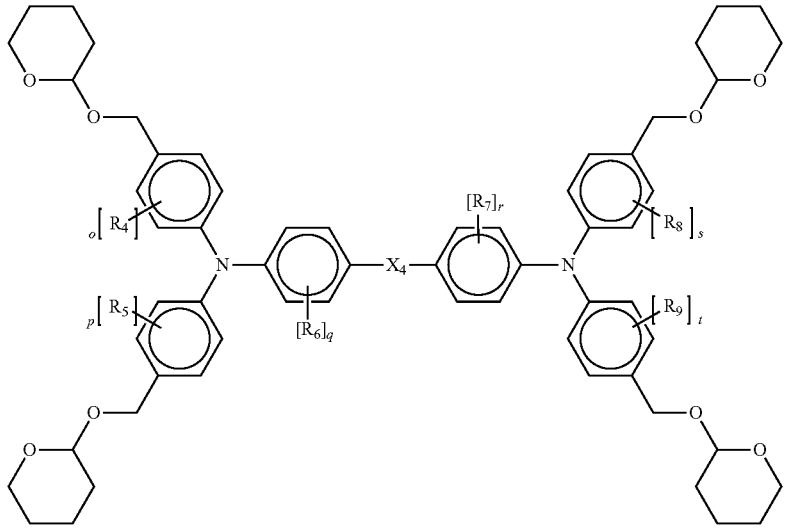

where $X_4$ represents —$CH_2$—, $CH_2CH_2$—, —$C(CH_3)_2$-Ph-$C(CH_3)_2$—, —$C(CH_2)_5$— or —O—, $R_4$, $R_5$, $R_6$, $R_7$, $R_8$, and $R_9$ independently represent hydrogen atoms, methyl groups, or ethyl groups, Ph represents a phenylene group, and o, p, q, r, s, and t independently represent integers of from 1 to 4.

9. The image bearing member according to claim 1, wherein the charge transport compound having three or more [tetrahydro-2H-pyran-2-yl)oxy]methyl groups linked with aromatic rings is represented by the following Chemical Formula 4, Chemical Formula 4

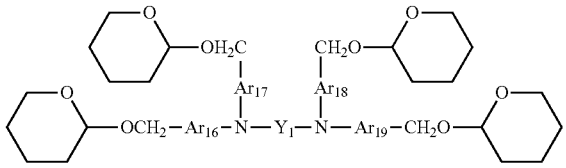

where $Y_1$ represents a divalent group of benzene, biphenyl, terphenyl, stilbene, distyryl benzene, or a condensed polycyclic aromatic hydrocarbon group, $Ar_{16}$, $Ar_{17}$, $Ar_{18}$, and $Ar_{19}$ independently represent divalent aromatic hydrocarbon groups having 6 to 18 carbon atoms that optionally have alkyl substitution groups.

10. The image bearing member according to claim 9, wherein the compound represented by the Chemical Formula 4 is represented by the following Chemical Formula 4-1, Chemical Formula 4-1

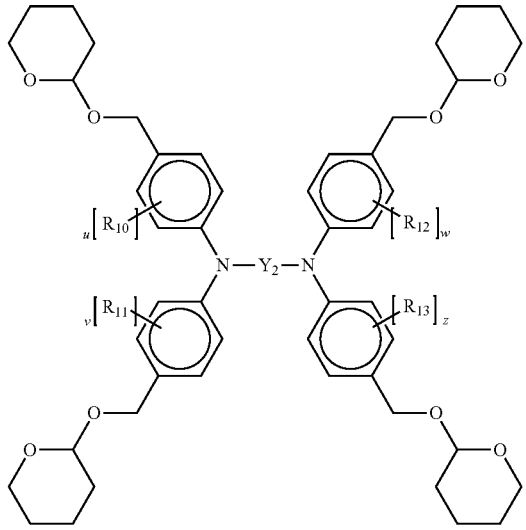

where $Y_2$ represents a divalent group of benzene, biphenyl, terphenyl, stilbene, and naphthalene, $R_{10}$, $R_{11}$, $R_{12}$, and $R_{13}$ independently represent hydrogen atoms, methyl groups, or ethyl groups, u, v, w, and z independently represent integers of from 1 to 4.

11. A manufacturing method of the image bearing member according to claim 1, comprising:

adding an acid catalyst to a liquid application of an uppermost surface layer; and forming an uppermost surface layer of the image bearing member that comprises a substrate and a photosensitive layer overlying the substrate using the liquid application of the uppermost surface layer by a spray coating method followed by heating at 130° C. to 150° C. for 20 minutes to 60 minutes to conduct curing reaction, the uppermost surface layer comprising a hydrocarbon compound represented by the following Chemical Formula 1 and a three-dimensionally cross-linked polymer by polymerization reaction in which part of three or more [(tetrahydro-2H-pyran-2-yl)oxy]methyl groups is severed and detached from a charge transport compound having the three or more [tetrahydro-2H-pyran-2-yl)oxy]methyl groups linked with aromatic rings, Chemical Formula 1

$$Ph_1\text{-}Q_1\text{-}Ph_2\text{-}Q_2\text{-}Ph_3 \qquad \text{Chemical Formula 1}$$

where $Q_1$ and $Q_2$ independently represent methylene groups or ethylene groups, $Ph_1$ and $Ph_3$ independently represent phenyl groups with which one or two methyl groups are bonded, and $Ph_2$ represents a phenylene group or a phenylene group having one methyl group;

wherein the hydrocarbon compound of Chemical Formula 1 is present in the uppermost surface layer in an amount of from 20% by weight to 50% by weight, based on total content of the uppermost surface layer.

12. An image forming method comprising:

charging a surface of the image bearing member of claim 1;

irradiating the surface of the image bearing member of claim 1 to write a latent electrostatic image thereon;

developing the latent electrostatic image with toner to form a visible image; and transferring the visible image onto a recoding medium; and fixing the visible image on the recording medium.

13. The image forming method according to claim 12, wherein, in the step of irradiating, the latent electrostatic image is written in digital form.

14. An image forming apparatus comprising:

the image bearing member of claim 1;

a charger to charge a surface of the image bearing member of claim 1;

an irradiator to irradiate the surface of the image bearing member of claim 1 to write a latent electrostatic image thereon;

a development device to develop the latent electrostatic image with toner to form a visible image;

a transfer device to transfer the visible image to a recording medium; and a fixing device to fix the visible image on the recording medium.

15. The image forming apparatus according to claim 14, wherein the irradiator writes the latent electrostatic image on the surface of the image bearing member of claim 1 in digital form.

16. A process cartridge comprising:

the image baring member of claim 1; and at least one of a charger to charge a surface of the image bearing member of claim 1;

an irradiator to irradiate the surface of the image bearing member of claim 1;

a development device to develop the latent electrostatic image with toner to form a visible image;

a transfer device to transfer the visible image to a recording medium; and a cleaning device to clean the surface of the image bearing member of claim 1, wherein the process cartridge is detachably attachable to an image forming apparatus.

* * * * *